US011262154B2

(12) United States Patent
Springer

(10) Patent No.: US 11,262,154 B2
(45) Date of Patent: Mar. 1, 2022

(54) ARCHERY RELEASE DEVICE AND METHOD OPERABLE TO GENERATE A PULLING FORCE

(71) Applicant: Copper John Corporation, Auburn, NY (US)

(72) Inventor: Eric C. Springer, Moravia, NY (US)

(73) Assignee: Copper John Corporation, Auburn, NY (US)

( * ) Notice: Subject to any disclaimer, the term of this patent is extended or adjusted under 35 U.S.C. 154(b) by 0 days.

(21) Appl. No.: 16/849,605

(22) Filed: Apr. 15, 2020

(65) Prior Publication Data

US 2020/0326149 A1 Oct. 15, 2020

Related U.S. Application Data

(63) Continuation of application No. 16/402,873, filed on May 3, 2019, now Pat. No. 10,641,578, which is a continuation of application No. 15/842,764, filed on Dec. 14, 2017, now Pat. No. 10,281,231.

(60) Provisional application No. 62/434,373, filed on Dec. 14, 2016.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 228,302 | A | 6/1880 | Beard | |
| 229,089 | A | 6/1880 | Burnham | |
| 2,133,650 | A | 10/1938 | Baker | |
| 2,819,707 | A | 1/1958 | Kayfes et al. | |
| 3,009,454 | A | 11/1961 | Floyd | |
| 3,656,467 | A | 4/1972 | Halter | |
| 3,757,763 | A | 9/1973 | Pinti et al. | |
| 3,768,456 | A | 10/1973 | Hansen et al. | |
| 3,853,111 | A | 12/1974 | Stanislawski et al. | |
| 3,916,868 | A * | 11/1975 | Wolfe | F41B 5/1469 124/35.2 |
| 3,942,507 | A | 3/1976 | Opal | |
| 3,965,884 | A | 6/1976 | Killian | |
| 4,036,204 | A | 7/1977 | Scott | |
| 4,041,926 | A | 8/1977 | Troncosco, Jr. et al. | |

(Continued)

OTHER PUBLICATIONS

Various prior art releases (1) downloaded from http://www.archeryhistory.com/releases/releasespics/pse.jpg, Dec. 2009.

(Continued)

*Primary Examiner* — John A Ricci
(74) *Attorney, Agent, or Firm* — Barclay Damon LLP

(57) ABSTRACT

An archery release device and method operable to generate a pulling force are described herein. The archery release device, in an embodiment, includes a body, at least one element moveably coupled to the body, and a force generator coupled to the body. The force generator is configured to apply a pulling force that pulls the at least one element. As a result of the archery release device being uncocked, the force generator is configured to cause the at least one element to move relative to the body.

24 Claims, 51 Drawing Sheets

(56) References Cited

U.S. PATENT DOCUMENTS

| | | | |
|---|---|---|---|
| 4,160,437 | A | 7/1979 | Fletcher |
| 4,424,791 | A | 1/1984 | Muehleisen |
| 4,509,497 | A | 4/1985 | Garvison |
| 4,539,968 | A | 9/1985 | Garvison |
| 4,567,875 | A | 2/1986 | Fletcher |
| 4,574,767 | A | 3/1986 | Gazzara |
| 4,612,907 | A | 9/1986 | Gantt |
| 4,620,523 | A | 11/1986 | Peck |
| 4,674,469 | A | 6/1987 | Peck |
| 4,854,293 | A | 8/1989 | Roberts |
| 4,881,516 | A | 11/1989 | Peck |
| 5,009,214 | A | 4/1991 | Wilde |
| 5,025,772 | A | 6/1991 | Stevenson |
| 5,096,170 | A | 3/1992 | Albin |
| 5,205,268 | A | 4/1993 | Savage |
| 5,261,581 | A | 11/1993 | Harden |
| 5,273,021 | A | 12/1993 | Tepper |
| 5,323,754 | A | 6/1994 | Pittman et al. |
| 5,448,983 | A | 9/1995 | Scott |
| 5,546,924 | A | 8/1996 | Todd |
| 5,595,167 | A | 1/1997 | Scott |
| 5,596,977 | A | 1/1997 | Scott |
| 5,685,286 | A | 11/1997 | Summers |
| 5,692,490 | A | 12/1997 | Walker |
| 5,694,915 | A | 12/1997 | Summers |
| 5,765,536 | A | 6/1998 | Scott |
| 5,803,068 | A | 9/1998 | Summers |
| 5,850,825 | A | 12/1998 | Scott |
| 5,937,842 | A | 8/1999 | Summers et al. |
| 6,032,661 | A | 3/2000 | Goff et al. |
| 6,205,991 | B1 | 3/2001 | Summers et al. |
| 6,302,093 | B1 | 10/2001 | Holland |
| 6,571,786 | B2 | 6/2003 | Summers et al. |
| 6,631,709 | B2 | 10/2003 | Carter et al. |
| 6,647,976 | B2 | 11/2003 | Summers et al. |
| 6,712,060 | B2 | 3/2004 | Egusquiza |
| 6,736,124 | B2 | 5/2004 | Carter |
| 6,895,951 | B2 | 5/2005 | Summers et al. |
| 6,945,241 | B2 | 9/2005 | Pellerite |
| 6,953,035 | B1 | 10/2005 | Summers |
| D597,164 | S | 7/2009 | Jones |
| 7,654,254 | B1 | 2/2010 | Rentz et al. |
| 8,622,051 | B2 | 1/2014 | Summers |
| 8,746,221 | B2 | 6/2014 | Rentz |
| 8,770,178 | B2 * | 7/2014 | Kempf ..... F41A 19/10 124/25 |
| 8,869,781 | B2 | 10/2014 | Jones |
| 9,027,540 | B2 | 5/2015 | Springer |
| 9,250,032 | B2 | 2/2016 | Kelly et al. |
| 9,255,762 | B2 | 2/2016 | Kelly et al. |
| 9,261,323 | B2 | 2/2016 | Springer |
| 9,618,295 | B1 | 4/2017 | Rentz |
| 9,625,230 | B2 | 4/2017 | Kelly et al. |
| 9,863,736 | B2 | 1/2018 | Kelly et al. |
| 2003/0159682 | A1 | 8/2003 | Pellerite |
| 2004/0079351 | A1 | 4/2004 | Summers et al. |
| 2007/0181113 | A1 | 8/2007 | Porter |
| 2008/0149084 | A1 | 6/2008 | Whalen et al. |
| 2009/0056689 | A1 | 3/2009 | Jones |
| 2009/0090342 | A1 | 4/2009 | Freitag et al. |
| 2009/0095270 | A1 | 4/2009 | Graves |
| 2010/0108047 | A1 | 5/2010 | Jones |
| 2011/0168146 | A1 | 7/2011 | Deceuster |
| 2012/0192844 | A1 | 8/2012 | Springer |
| 2012/0285431 | A1 | 11/2012 | Summers |
| 2013/0025578 | A1 | 1/2013 | Jones |
| 2013/0092140 | A1 | 4/2013 | Rentz |
| 2015/0219418 | A1 | 8/2015 | Whalen |

OTHER PUBLICATIONS

Various prior art releases (2) downloaded from http://www.archeryhistory.com/releases/releasespics/release4.jpg, Dec. 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (Jan. 2010).

Carter Enterprises; Carter Whisper Tech Tip Multipurpose Rope Leash; Mar. 21, 2016; retrieved from the Internet: <https://www.youtube.com/watch?v=NkpbmDUyWTM>; 7 pages.

Carter Enterprises; Whisper; on or before Dec. 31, 2011; retrieved from the Internet <https://carterenterprises.com/releases/thumb-trigger/whisper>; 1 page.

Carter Enterprises; 2012 Carter Catalog; on or before Dec. 31, 2012; 16 pages.

T.R.U. Ball; 2012 Product Guide; on or before Dec. 31, 2012; 20 pages.

* cited by examiner

ARCHERY RELEASE DEVICE AND METHOD OPERABLE TO GENERATE A PULLING FORCE

CROSS-REFERENCE TO RELATED APPLICATIONS

This application is a continuation of, and claims the benefit and priority of, U.S. patent application Ser. No. 16/402,873 filed on May 3, 2019, which is a continuation of U.S. patent application Ser. No. 15/842,764 (now U.S. Pat. No. 10,281,231) filed on Dec. 14, 2017, which is a non-provisional of, and claims the benefit and priority of, U.S. Provisional Patent Application No. 62/434,373 filed on Dec. 14, 2016. The entire contents of such applications are hereby incorporated by reference.

BACKGROUND

Archery release aids are used to hold a bowstring in the drawn position. The known release aids attach to the bowstring and pull the bowstring to the drawn position. The user activates the release aid, either by activating a trigger or by jerking the release, to cause the bowstring to slide off of the release aid's hook, thereby allowing the bowstring to fire an arrow.

There are known release aids that include a release case, a hook and one or more linkage components coupled to the hook. Some of the known release aids have triggers coupled to the linkage components, and some of the known release aids have finger extensions with some level of adjustability. All of the known release aids, however, have problems and deficiencies with respect to force transmission efficiency, reliability, ergonomics, adjustability, repeatability, ease of operation or release responsiveness. Consequently, archers can encounter a loss in desired settings, misfires, impairment of shooting performance, muscle fatigue, pain and reduced shooting accuracy.

The foregoing background describes some, but not necessarily all, of the problems, disadvantages and shortcomings related to the known archery release aids.

DETAILED DESCRIPTION

Figure 1:
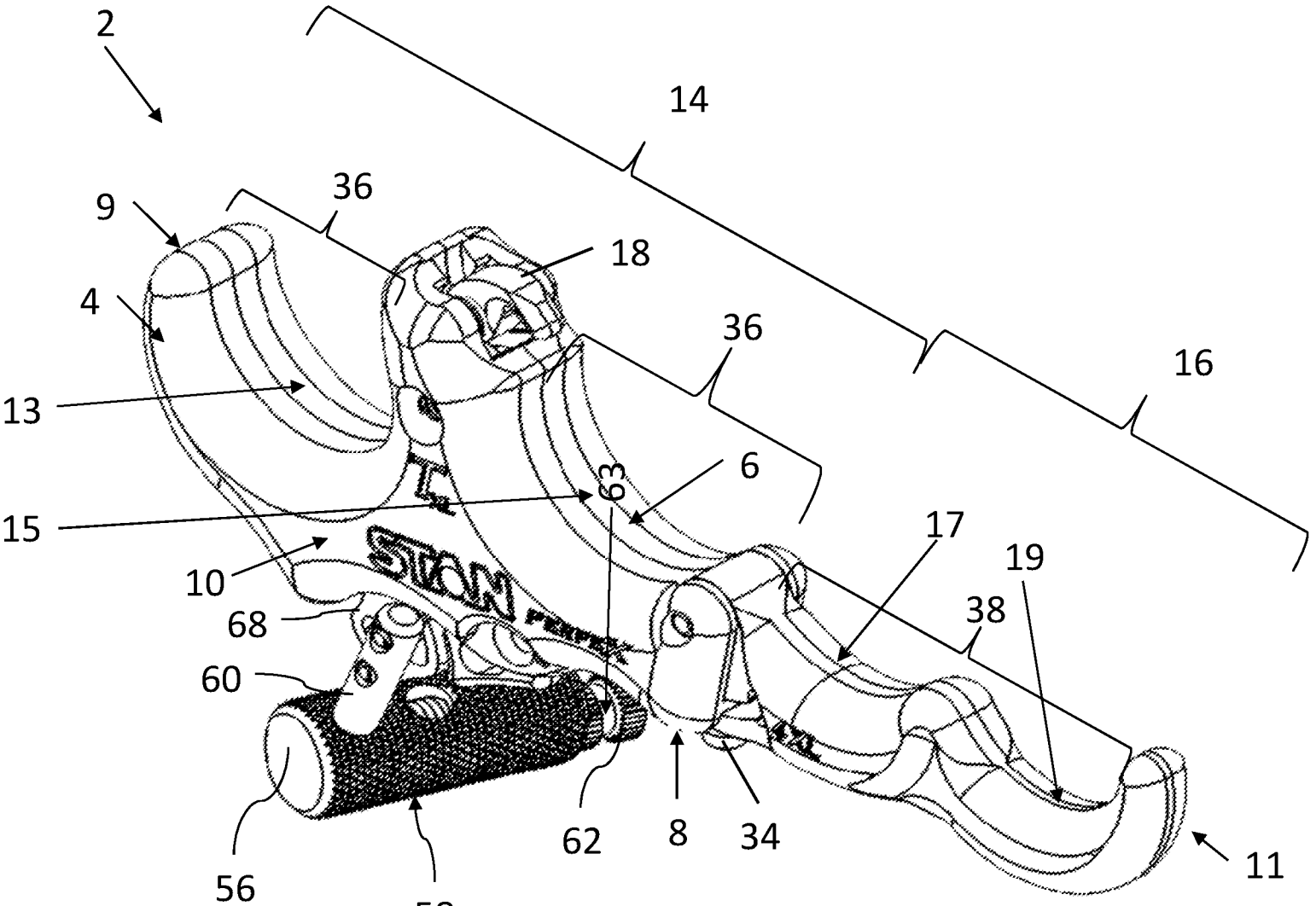
FIG. 1 is an isometric side view of an embodiment of an archery release device.

In an embodiment illustrated in FIGS. 1-7, an archery release device 2 includes a housing 4 having a front surface 6, a rear surface 8, and at least two side surfaces 10, 12. The side surfaces 10, 12 join the front surface 6 to the rear surface 8. In use, the front surface 6 of the archery release device 2 faces the target and the rear surface 8 faces the archer in a direction opposite of the target. The archery release device 2 also has a top surface 9 and a bottom surface 11. A bowstring hook, cord hook or cord holder 18 is coupled to the housing 4, typically to the front surface 6, and is configured to hold a bowstring, draw string or draw cord (not shown). Depending upon the embodiment, the archery release device 2 can be a triggerless release, such as a back tension release, or the archery release device 2 can be a trigger-based release. In a handheld triggerless embodiment, the archery release device 2 is configured to disengage the draw cord in response to the archer's pulling or jerking on the archery release device 2. The spike in force resulting from the jerking or quick pull can be caused by tensing of the archer's back, arm or hand muscles. In a handheld trigger-based embodiment, the archery release device 2 has includes a trigger moveable relative to the housing 4, a release button, release switch or other touch-responsive release controller operable to move the trigger, thereby causing the archery release device 2 to release the draw cord.

Figure 2:
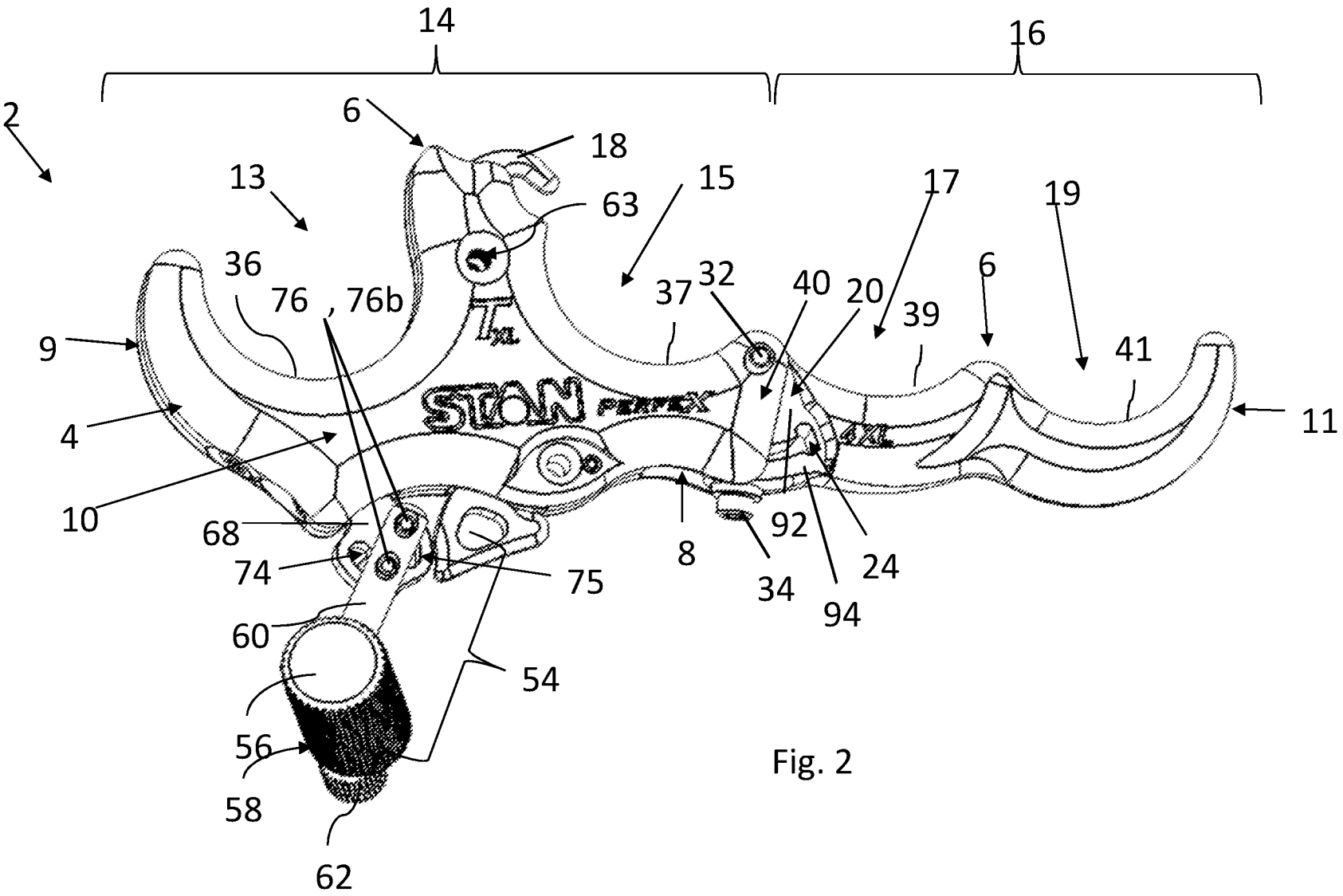
FIG. 2 is another isometric side view of the archery release device of FIG. 1.
Figure 3:
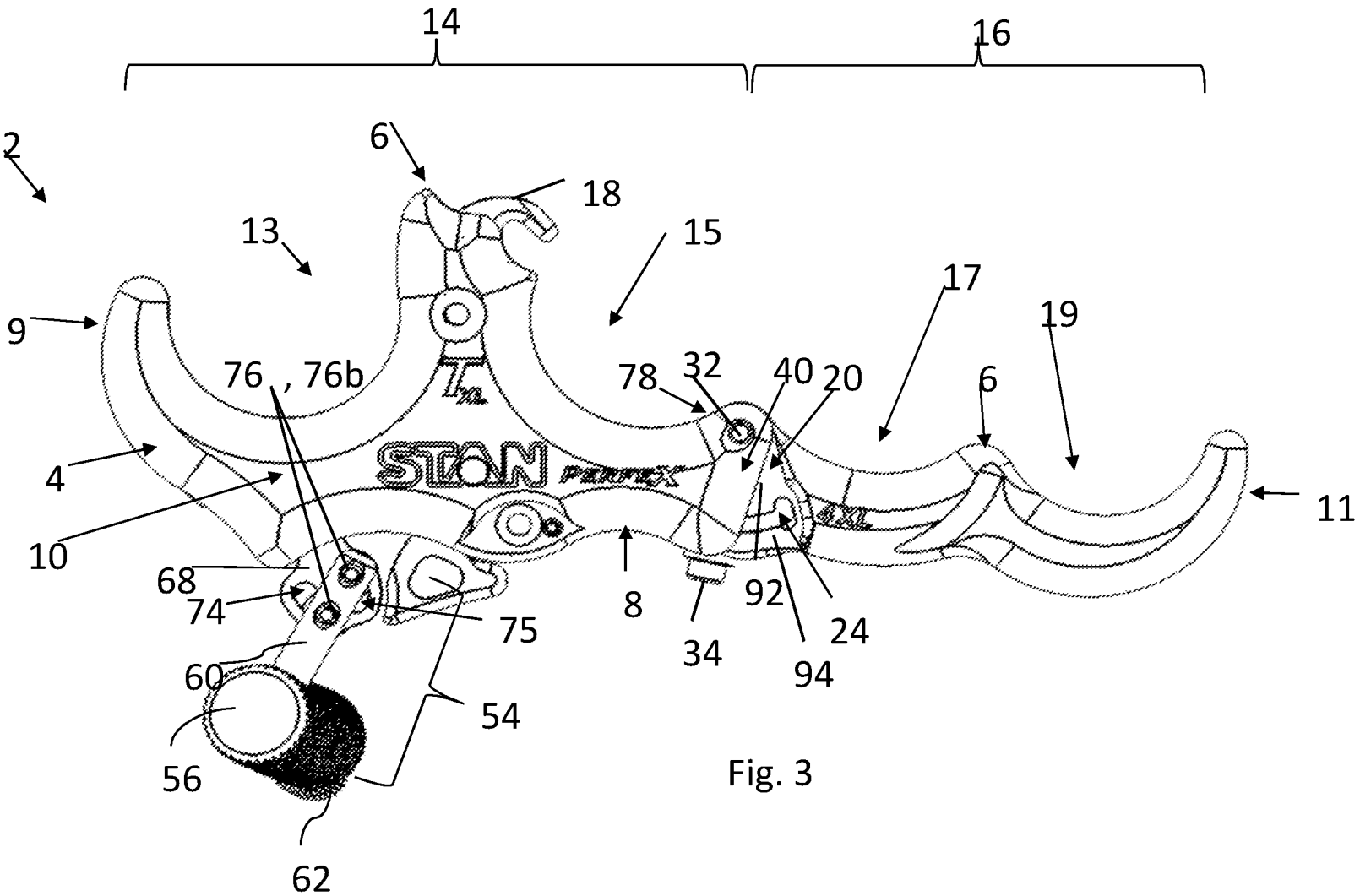
FIG. 3 is a side view of the archery release device of FIG. 1.
Figure 4:
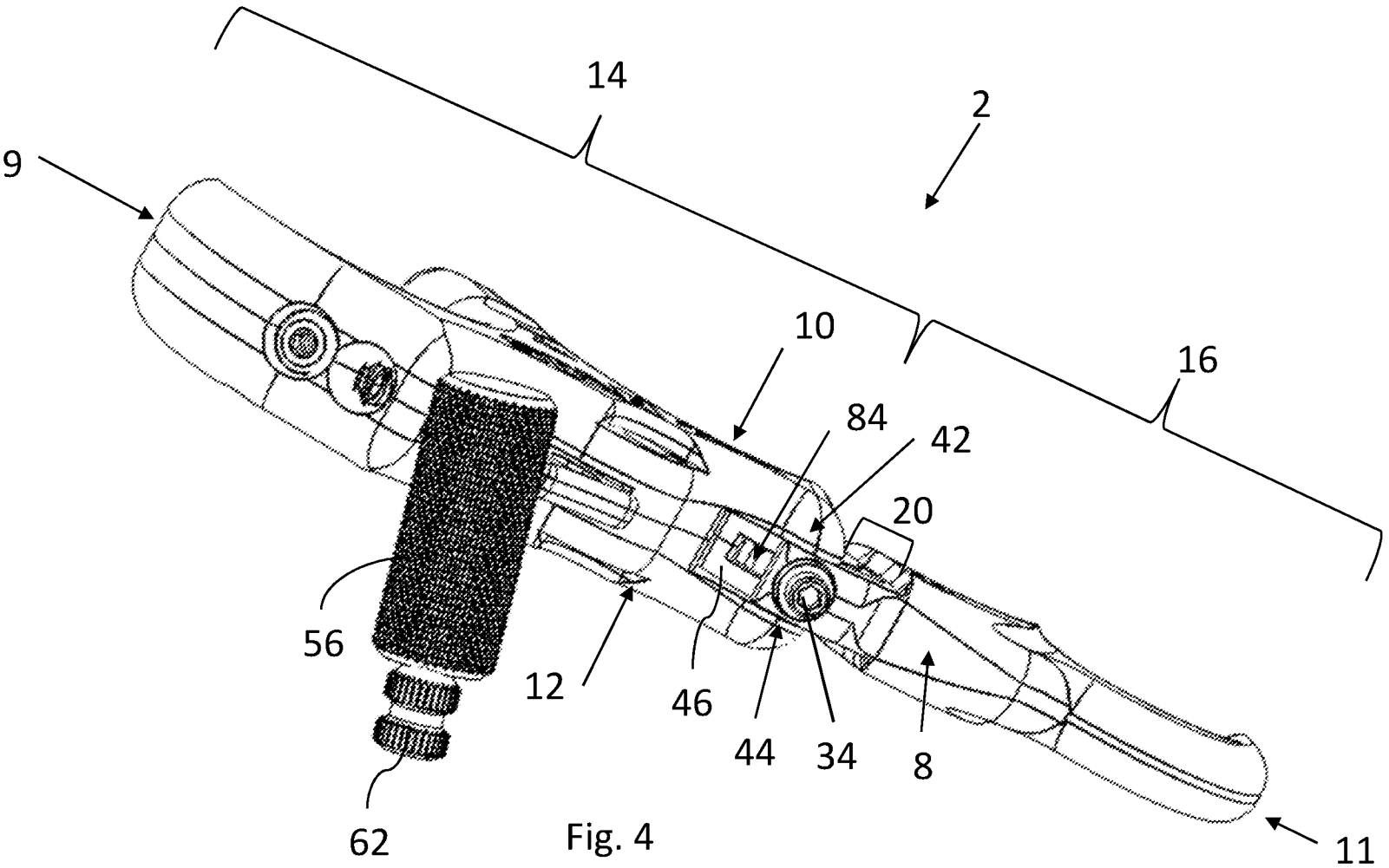
FIG. 4 is a rear isometric view of the archery release device of FIG. 1.
Figure 5:
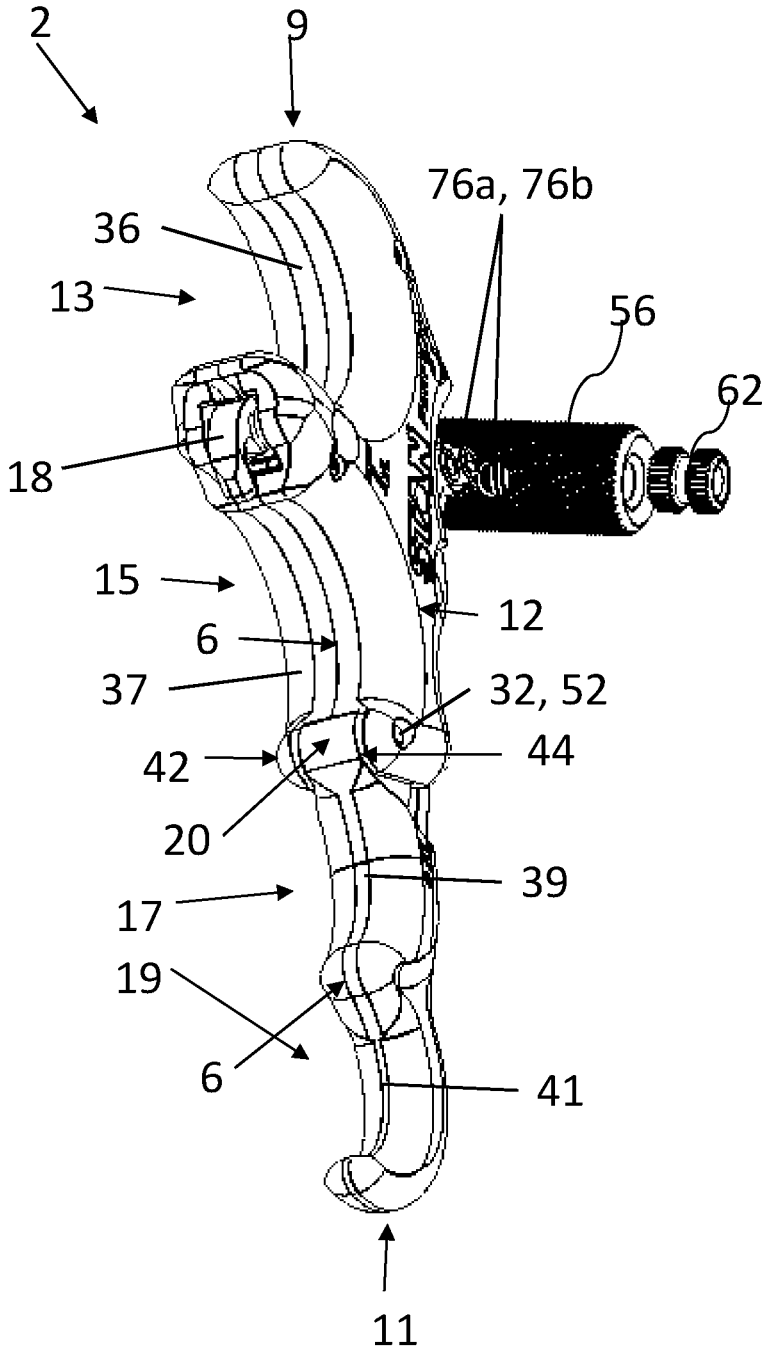
FIG. 5 is a front isometric view of the archery release device of FIG. 1.
Figure 6:
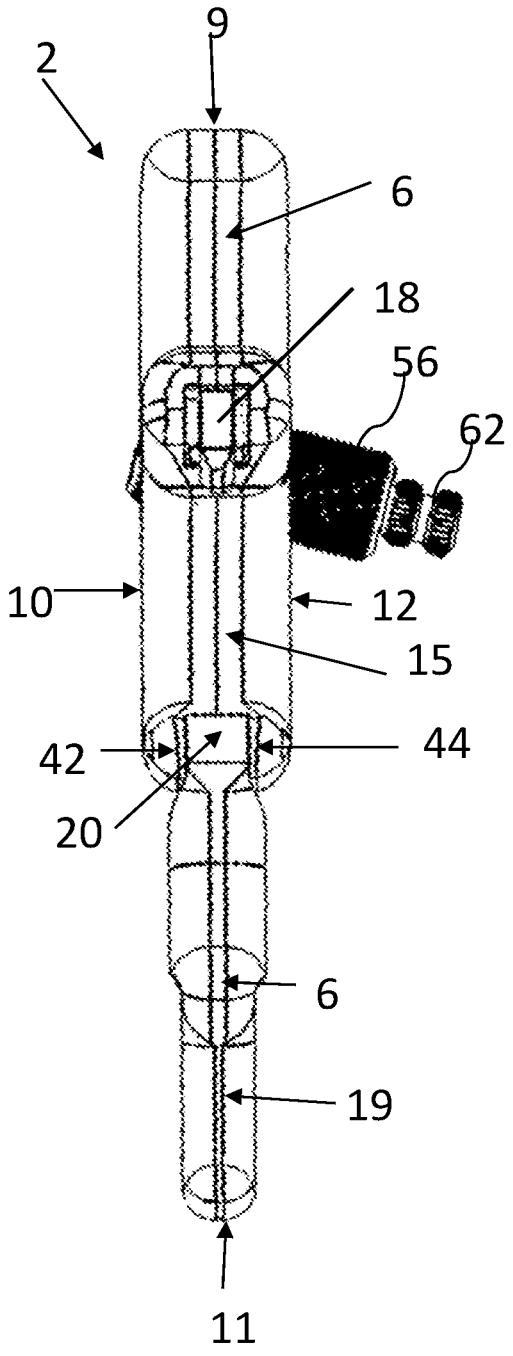
FIG. 6 is a front view of the archery release device of FIG. 1.
Figure 7:
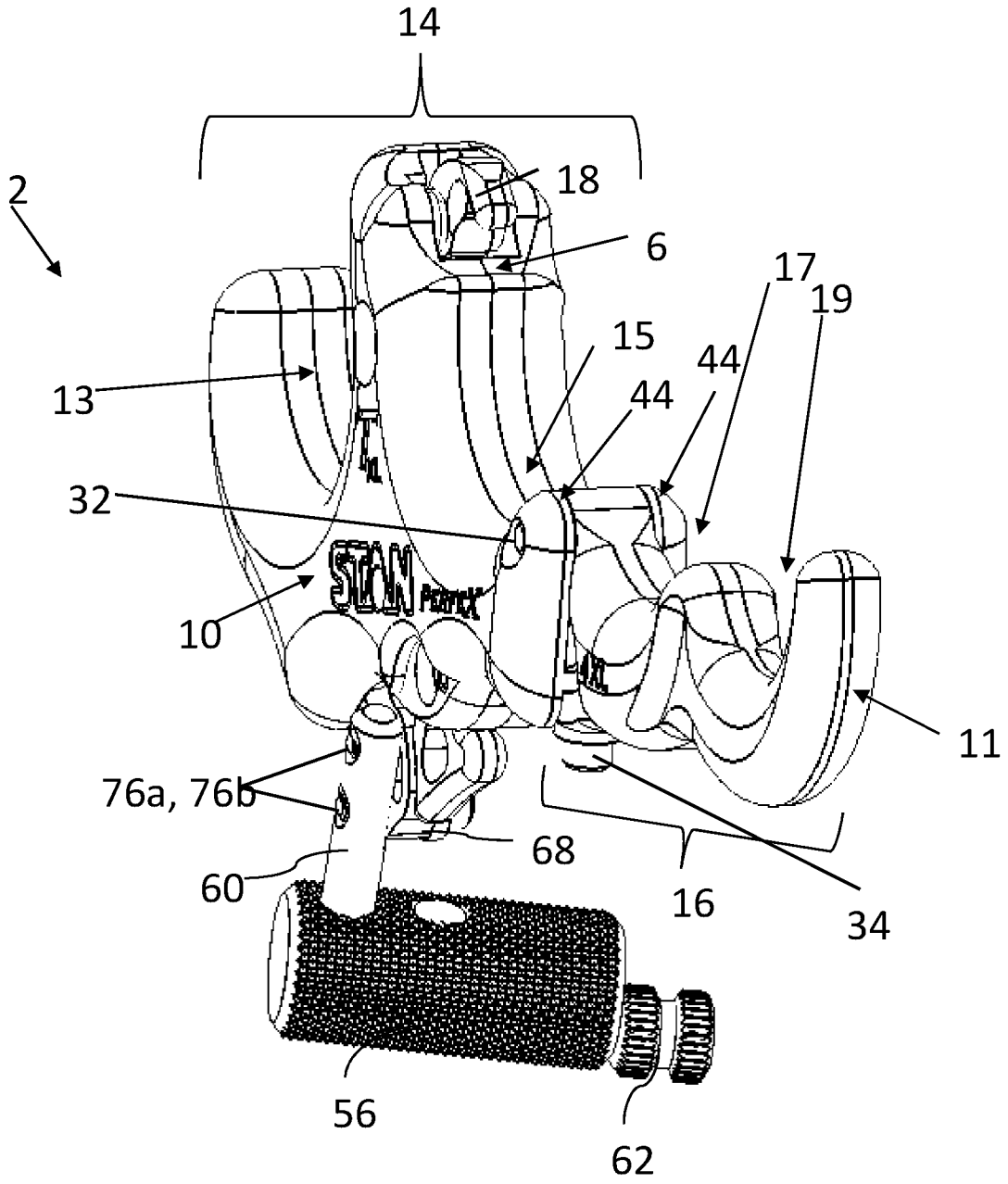
FIG. 7 is a bottom isometric view of the archery release device of FIG. 1.

With particular reference to FIG. 2, opposite the draw cord hook 18, is a thumb grasp or thumb rest assembly 54. As particularly illustrated by FIGS. 2 and 8-9C, the thumb grasp assembly 54 includes a thumb rest body 56 having a surface 58 upon which an archer's thumb (not shown) rests or can rest during operation. In an embodiment, the surface 58 is textured to improve the grip of the surface 58. The thumb grasp assembly 54 additionally includes an arm member 60 coupled to and extending from the thumb grasp body 56. Depending upon the embodiment, the arm member 60 can be threadably coupled to or otherwise fastened to the thumb grasp body 56, or the thumb grasp body 56 and the arm member 60 can be formed as a unitary member. In the embodiment shown, the thumb grasp body 56 defines a channel configured to receive a safety device 62, such as a pin or screw. The user can remove the safety device 62 from the thumb grasp body 56 and insert the safety device 62 into the safety opening 63 (FIG. 1). Once inserted into the safety opening 63, the safety device 62 is operable to prevent the cord holder 18 from releasing the draw cord.

In an embodiment, the arm member 60 includes at least one bore, aperture, or opening 64 extending through the arm member 60. In the illustrated embodiment, the arm member 60 includes a first and second bore or aperture 64*a*, 64*b* extending through the arm member 60 parallel to an axis $X_T$ (FIG. 8) extending through the thumb grasp body 56.

Figure 8:
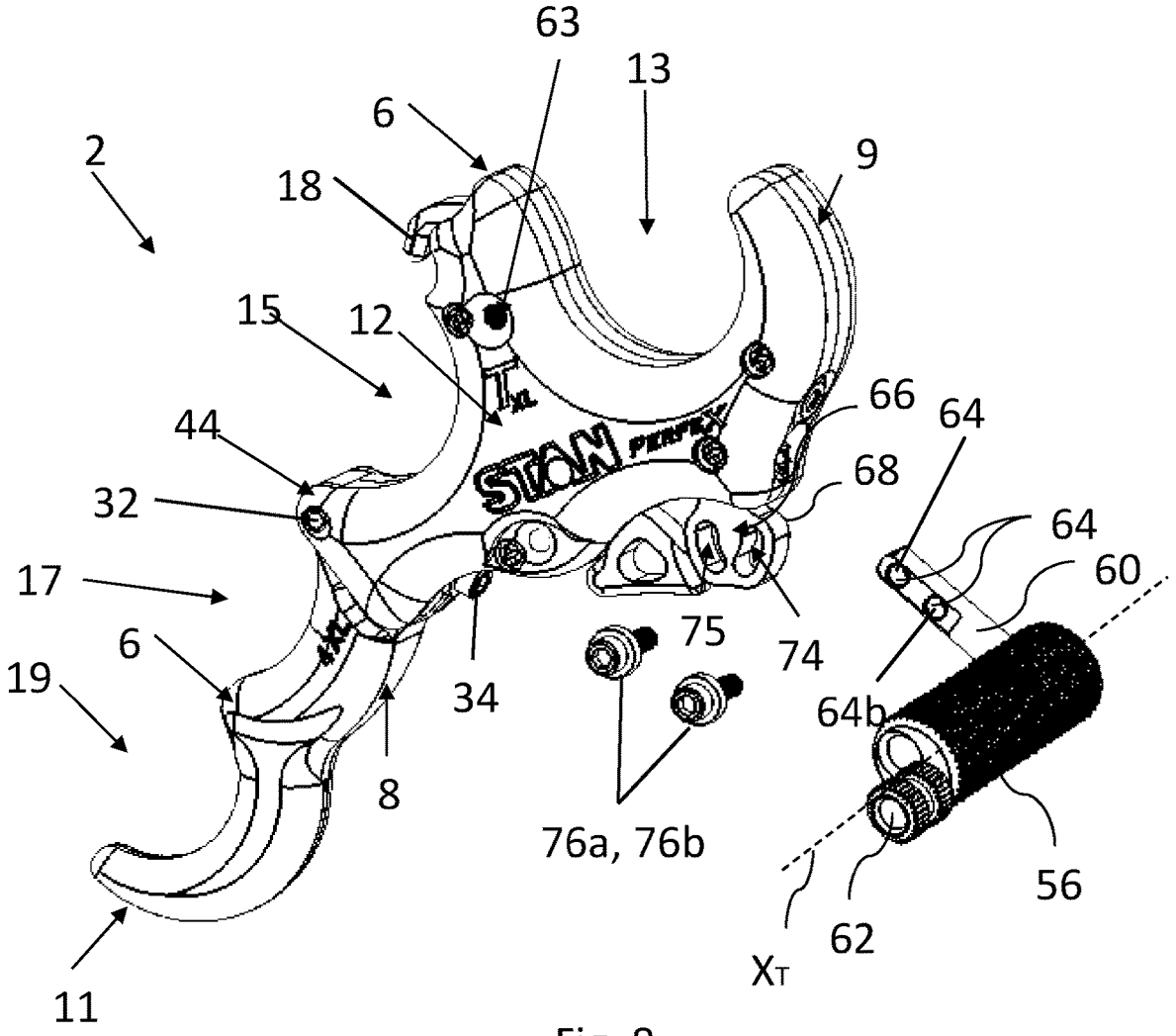
FIG. 8 is a bottom isometric view of an embodiment of a release body for an archery release device.

The archery release device 2 has a thumb rest anchor or engagement member 66 (FIG. 8) positioned within the housing 4 and at least a portion of which extends through the rear surface 8 of the housing 4. The portion of the anchor member 66 extending through the housing 4 defines a thumb grasp engagement surface 68. As illustrated in FIG. 8, the engagement surface 68 has a curved profile and has a first side surface 70 and second side surface 71 joined by a perimeter surface 72. A first guide track 74 and a second guide track 75, each defining an opening, extend through the engagement surface 68 from the first side surface 70 to the second side surface 71. Each guide track 74, 75 has a curved or arc shape.

Figure 9A:
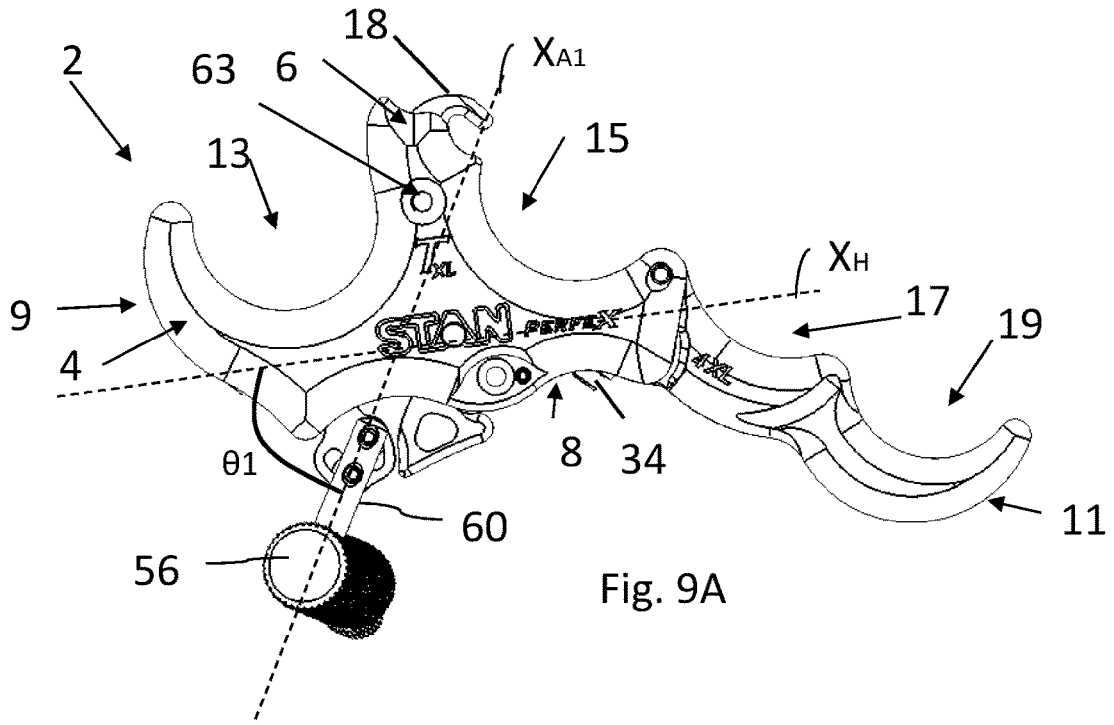
FIG. 9A is a side isometric view of the release body of FIG. 8, illustrating an arm member positioned along a first axis.
Figure 9B:
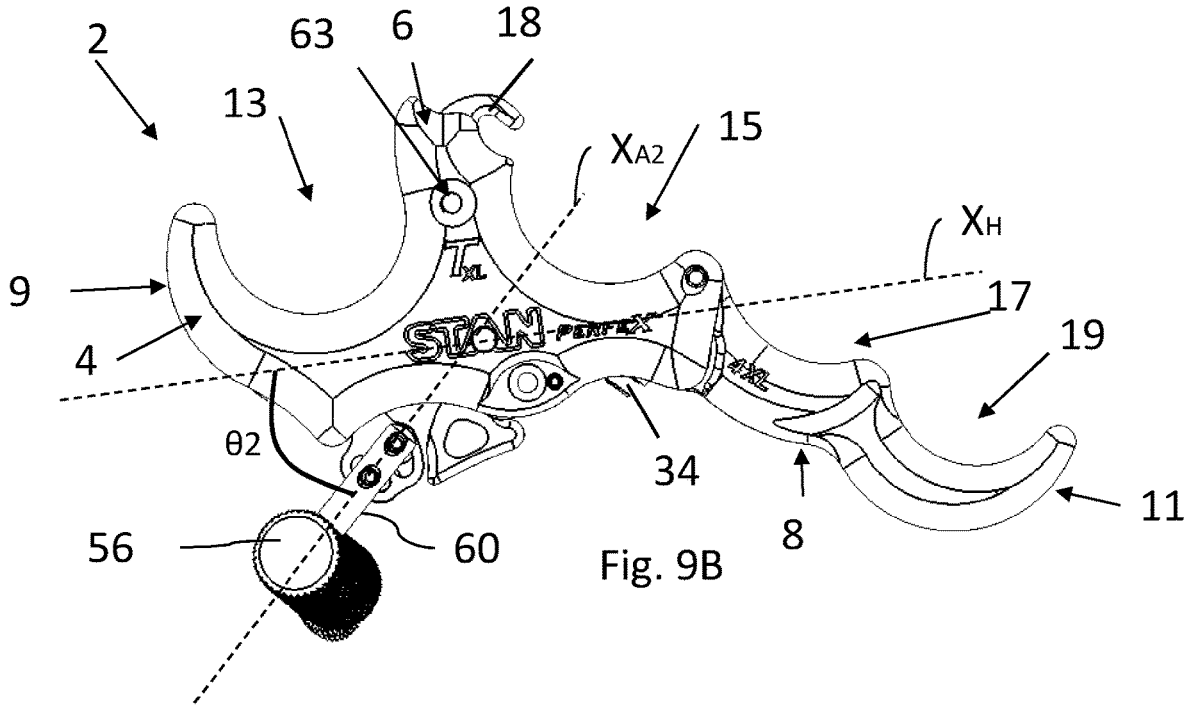
FIG. 9B is a side isometric view of the release body of FIG. 8, illustrating an arm member positioned along a second axis.
Figure 9C:
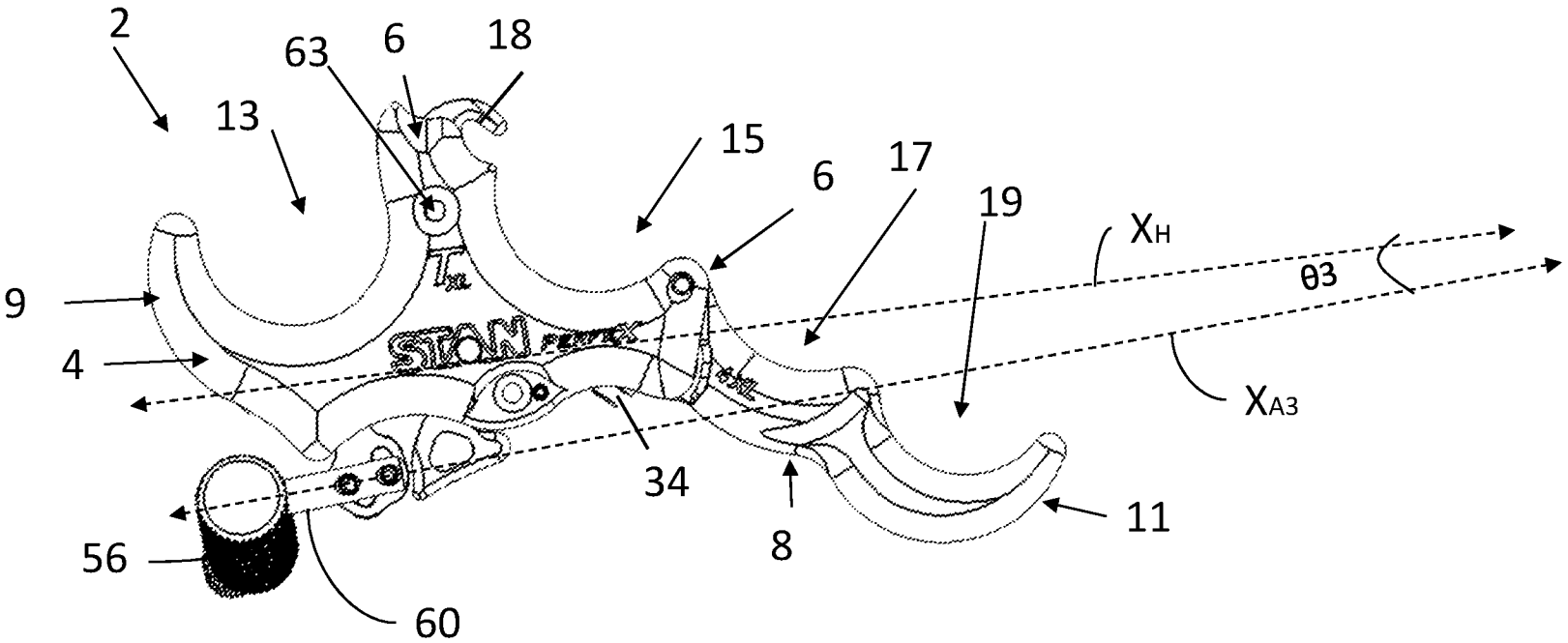
FIG. 9C is a side isometric view of the release body of FIG. 8, illustrating an arm member positioned along a third axis.

With particular reference to FIGS. 9A-9C, the arm member 60 is coupled to the engagement surface 68. In particular, the first and second bores 64*a*, 64*b* are aligned with the first and second guide track 74, 75, respectively, and a first and second anchor fastener 76*a*, 76*b* are inserted through the first bore 64*a* and first guide track 74 and through the second bore 64*b* and second guide track 75 to couple the arm member 60 to the engagement surface 68. In the illustrated embodiment, the anchor fasteners 76*a*, 76*b* are screws. In this embodiment, the anchor fasteners 76*a*, 76*b* can be loosened in order to change the position of the thumb grasp assembly 54 and tightened to lock the position of the thumb grasp assembly 54 relative to the engagement member 66.

As further illustrated by FIGS. 9A-9C, the thumb grasp assembly 54 can be pivotally or rotationally adjusted relative to the housing 4. In particular, the first and second anchor fasteners 76*a*, 76*b* can be positioned at various locations within the guide tracks 74, 75 to change the angle of the thumb rest assembly 54 relative to the housing 4. Referring to FIG. 9A, an axis $X_H$ extends longitudinally through the housing 4. In this embodiment, the thumb rest assembly 54 is coupled to the engagement surface 68 in a first configuration in which the axis $X_{A1}$ of the thumb grasp assembly 54 intersects the axis $X_H$ to form a first angle $\theta_1$. As illustrated in FIG. 9B, the thumb rest assembly 54 is coupled to the engagement surface 68 in a second configuration in which the thumb rest assembly 54 is rotated toward the housing 4, as compared to the configuration illustrated in FIG. 9A. In the embodiment illustrated in FIG. 9B, the axis $X_{A2}$ of the thumb grasp assembly 54 intersects the axis $X_H$ at a second angle $\theta_2$, which is smaller than the first angle $\theta_1$ (FIG. 9A). As illustrated in FIG. 9C, the thumb rest assembly 54 is coupled to the engagement surface 68 in a third configuration. In this embodiment, the axis $X_{A3}$ of the thumb rest assembly 54 intersects the axis $X_H$ at a third angle $\theta_3$, which is smaller than the first angle $\theta_1$ (FIG. 9A) and the second angle $\theta_2$ (FIG. 9B). While such positions have been illustrated here, it is to be understood that the thumb rest assembly 54 can be coupled to the engagement surface 68 in a variety of configurations to achieve variable positions. The position of the thumb rest assembly 54 can be selected by the archer.

Returning to FIGS. 1-7, the archery release device 2 can include a release body 14 and a finger extension 16 coupled to the release body 14. As further illustrated by FIGS. 7-11, the release body 14 includes the draw cord hook 18 and the thumb grasp assembly 54. The release body 14 further includes concave-shaped index finger engagement surface 36 defining an index finger space 13. As shown in FIGS. 7-11, the release body 14 also has a concave-shaped middle finger engagement surface 37 contoured to define a middle finger space 15. The finger extension 16 includes: (a) a concave-shaped ring finger engagement surface 39 contoured to define a ring finger space 17; and (b) a concave-shaped pinky finger engagement surface 41 contoured to define a pinky finger space 19. The rear surface 8 can be straight, flat or contoured or have any suitable combination thereof.

Figure 10:
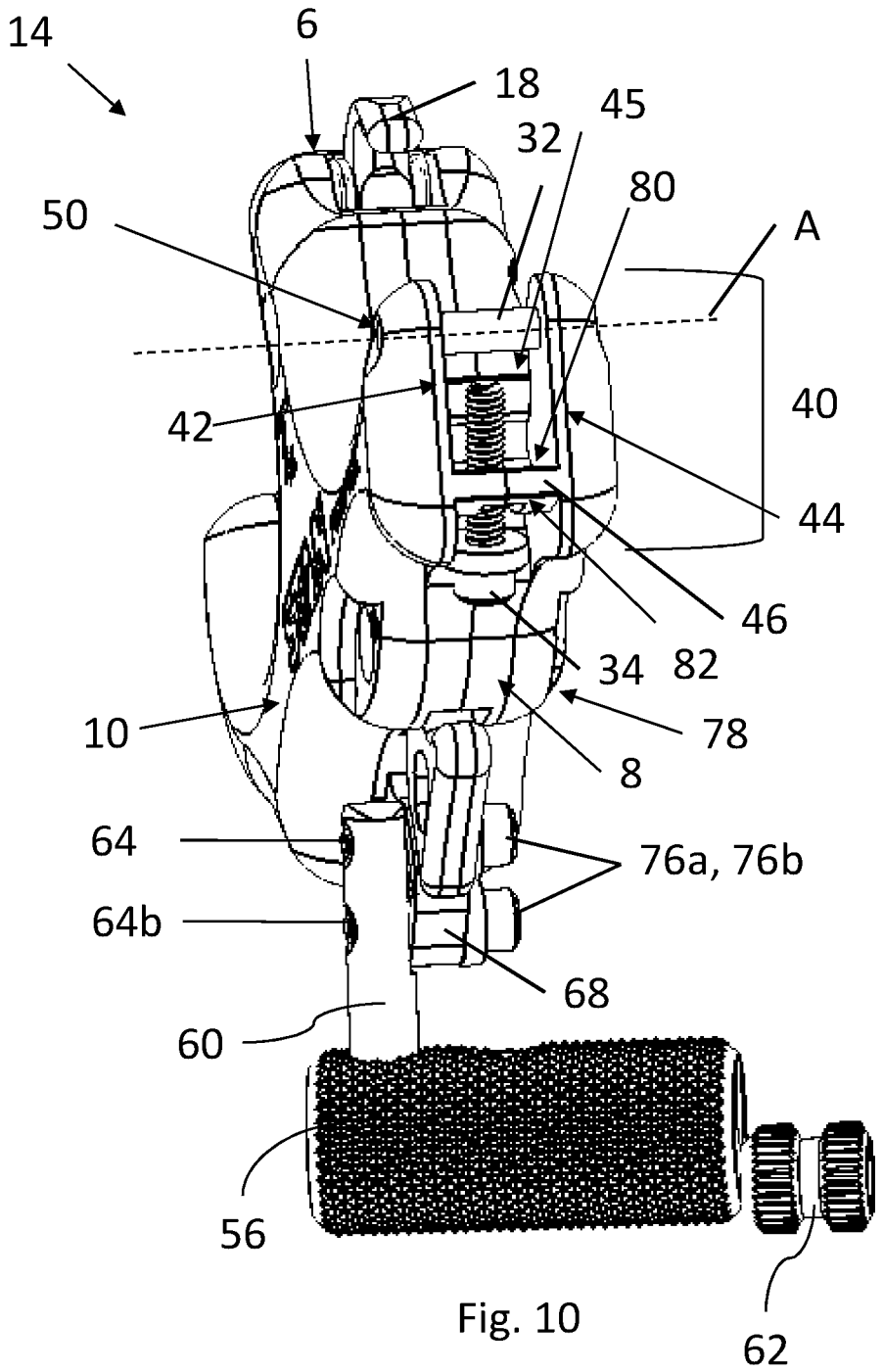
FIG. 10 is a rear isometric view of the release body of FIG. 8.
Figure 11:
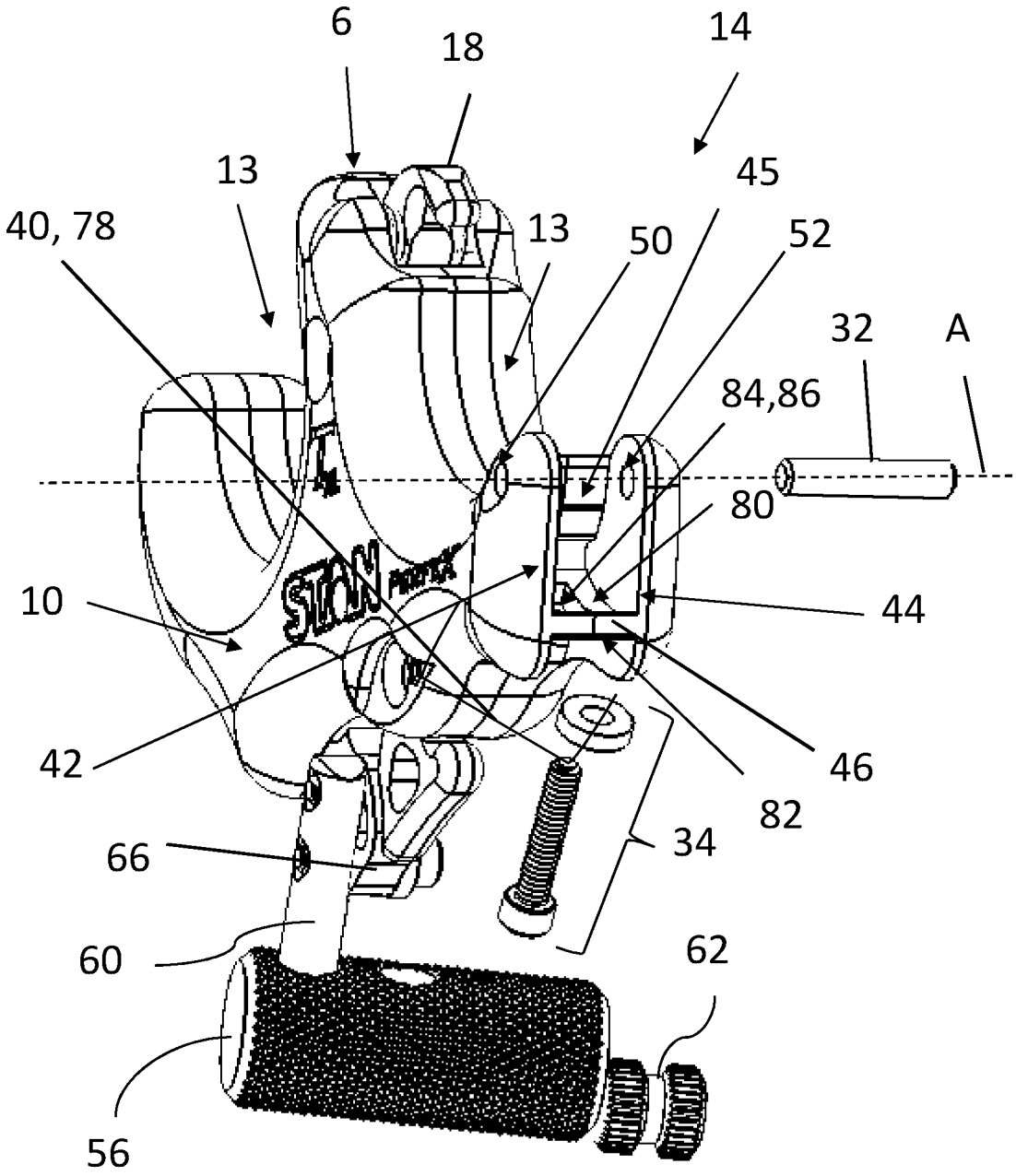
FIG. 11 is a rear isometric exploded view of the release body of FIG. 8.
Figure 12:
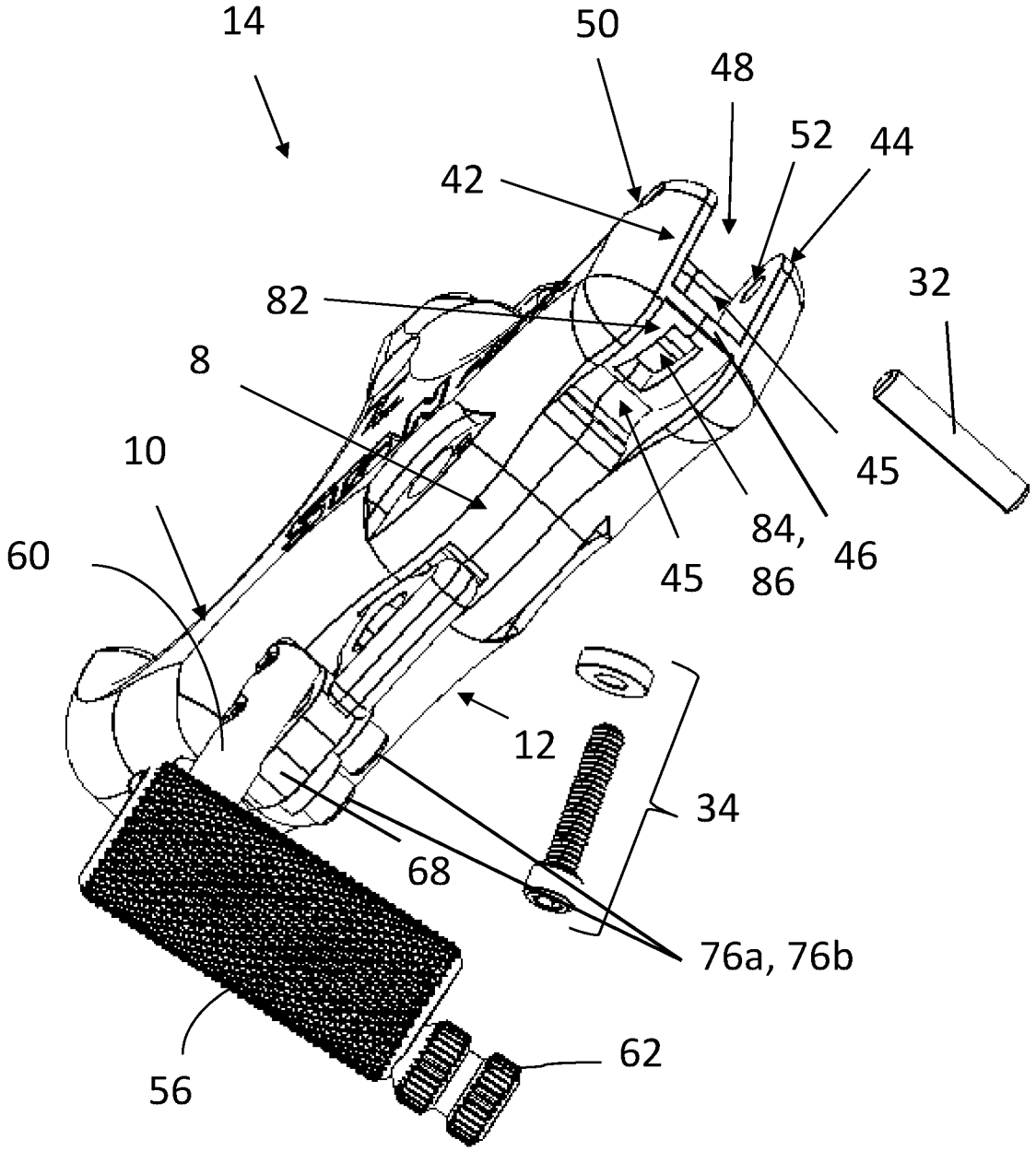
FIG. 12 is a rear isometric exploded view of the release body of FIG. 8, illustrating a cavity defined by the release body.
Figure 13:
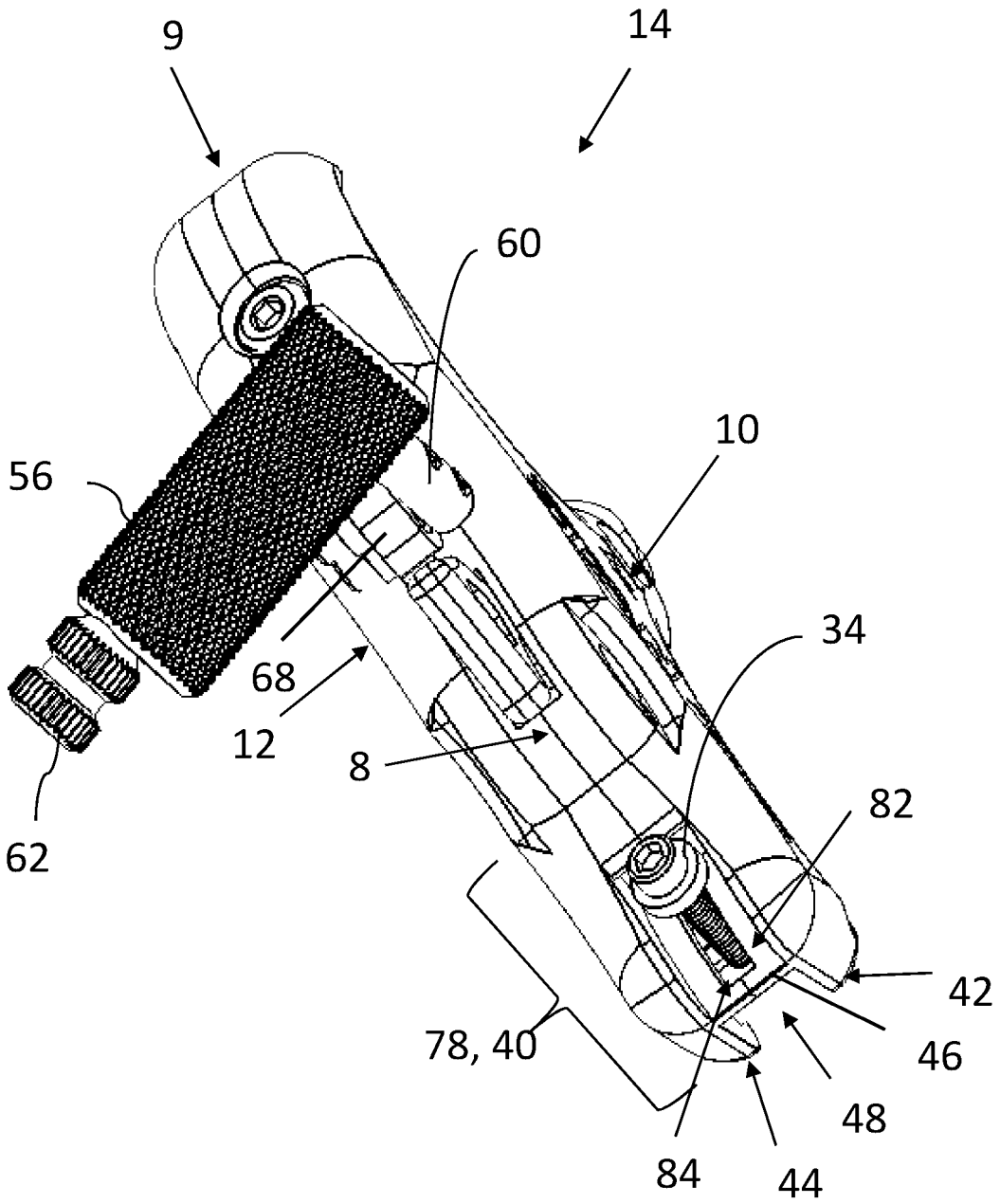
FIG. 13 is another rear isometric exploded view of the release body of FIG. 8, illustrating the cavity defined by the release body.

As illustrated in FIGS. 10-12, the bottom section 78 of the release body 14 defines an body mount or coupling portion 40. In the illustrated embodiment, the body mount 40 includes a first sidewall 42 and a second sidewall 44 spaced apart from the first sidewall 42. A first sidewall bore or aperture 50 and a second sidewall bore or aperture 52 extend through each of the first and second sidewalls 42, 44, respectively, and are aligned along an axis A (FIG. 11). In this embodiment, the first sidewall 42 is joined to the second sidewall 44 by a back surface 45, with a gap, space, or cavity 48 (FIG. 12) extending between the first and second sidewalls 42, 44. A guide member 46 extends through the gap 48 between the first sidewall 42 and the second sidewall 44 and extends backward to intersect the back surface 45. The guide or guide member 46 has a top surface 80 (FIG. 11) and a bottom surface 82 (FIG. 12), each of which is exposed to the gap 48. A bore, aperture, or opening 86 (FIG. 12) extends through the guide member 46 from the top surface 80 to the bottom surface 82 and defines a guide track or cavity 84. In the illustrated embodiment, the guide member 46 has a curved, arc-shaped profile extending in multiple planes. It should be appreciated that, in other embodiments not shown, the guide member can have a flat profile extending in a singe plane.

Figure 14:
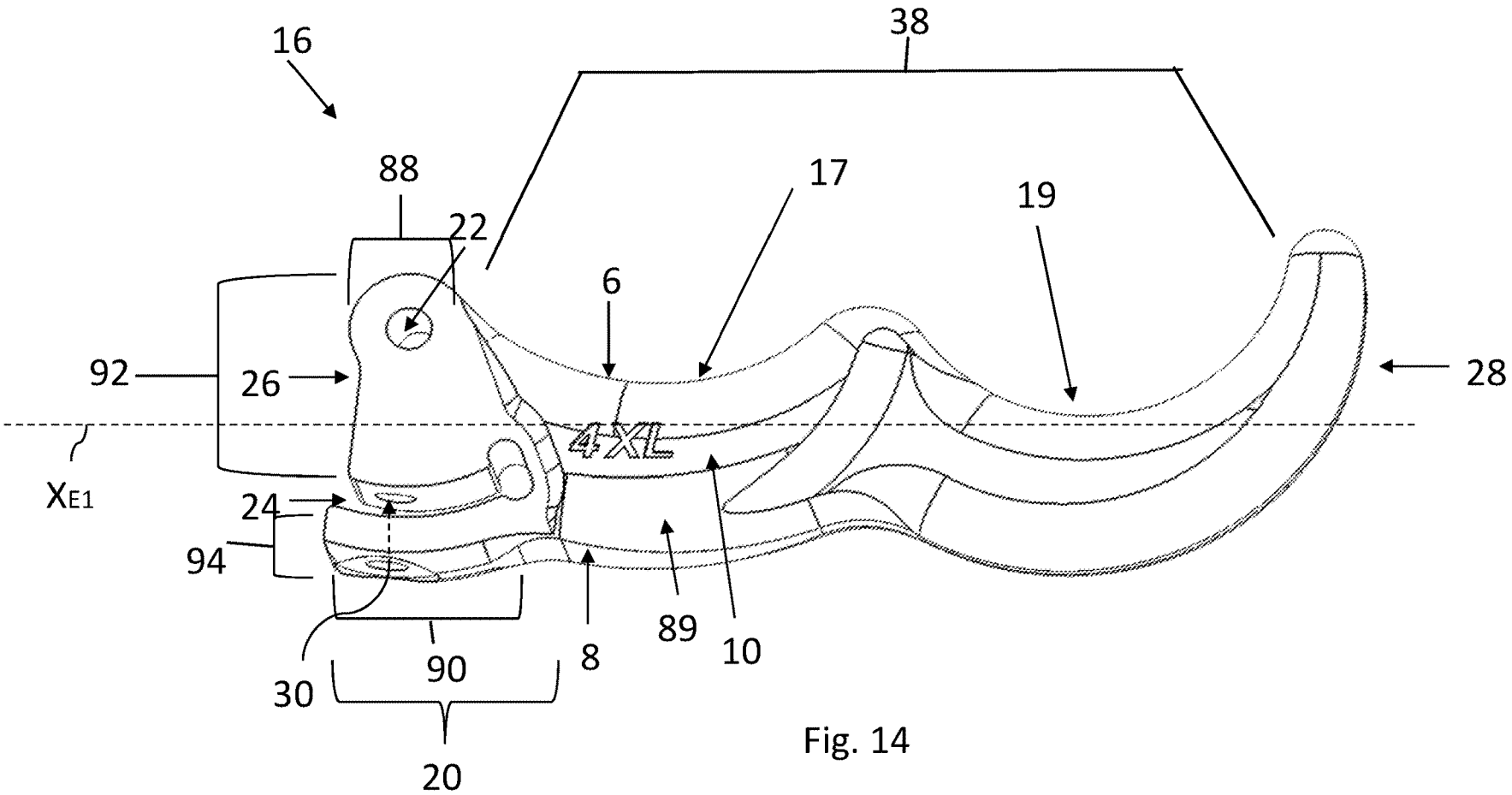
FIG. 14 is a side isometric view of an embodiment of an extension for an archery release device.
Figure 15:
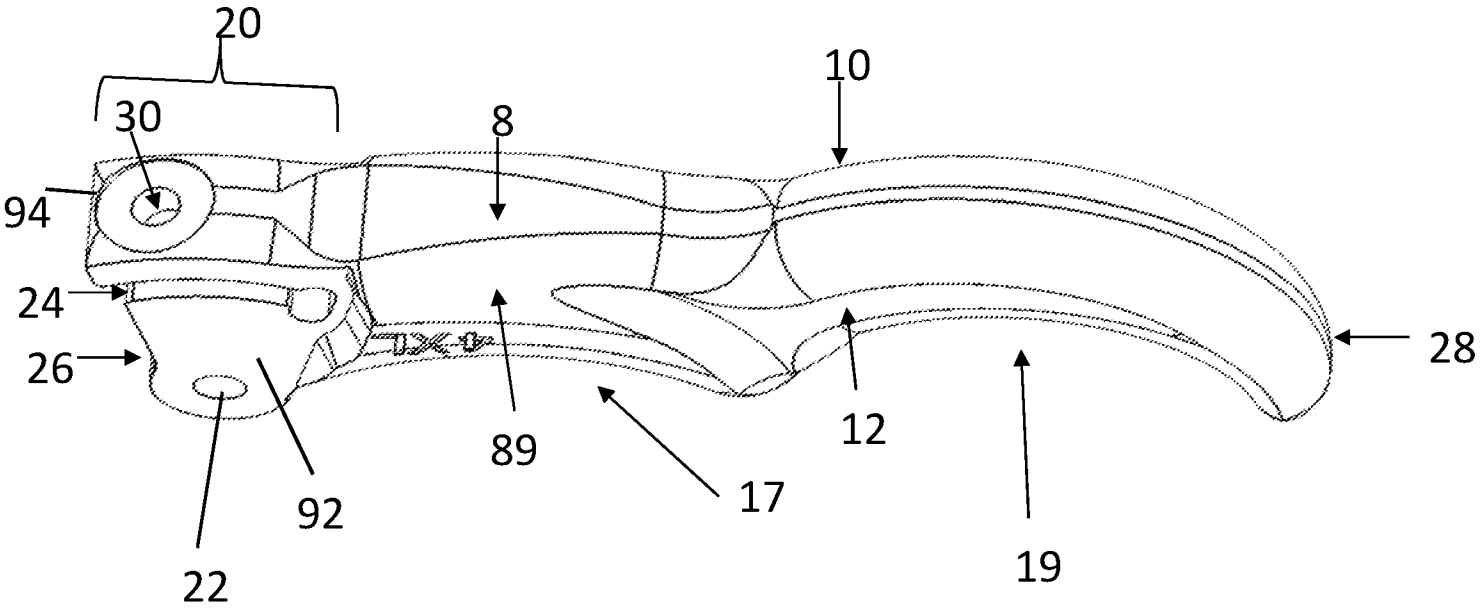
FIG. 15 is a bottom isometric view of the extension of FIG. 14.
Figure 16:
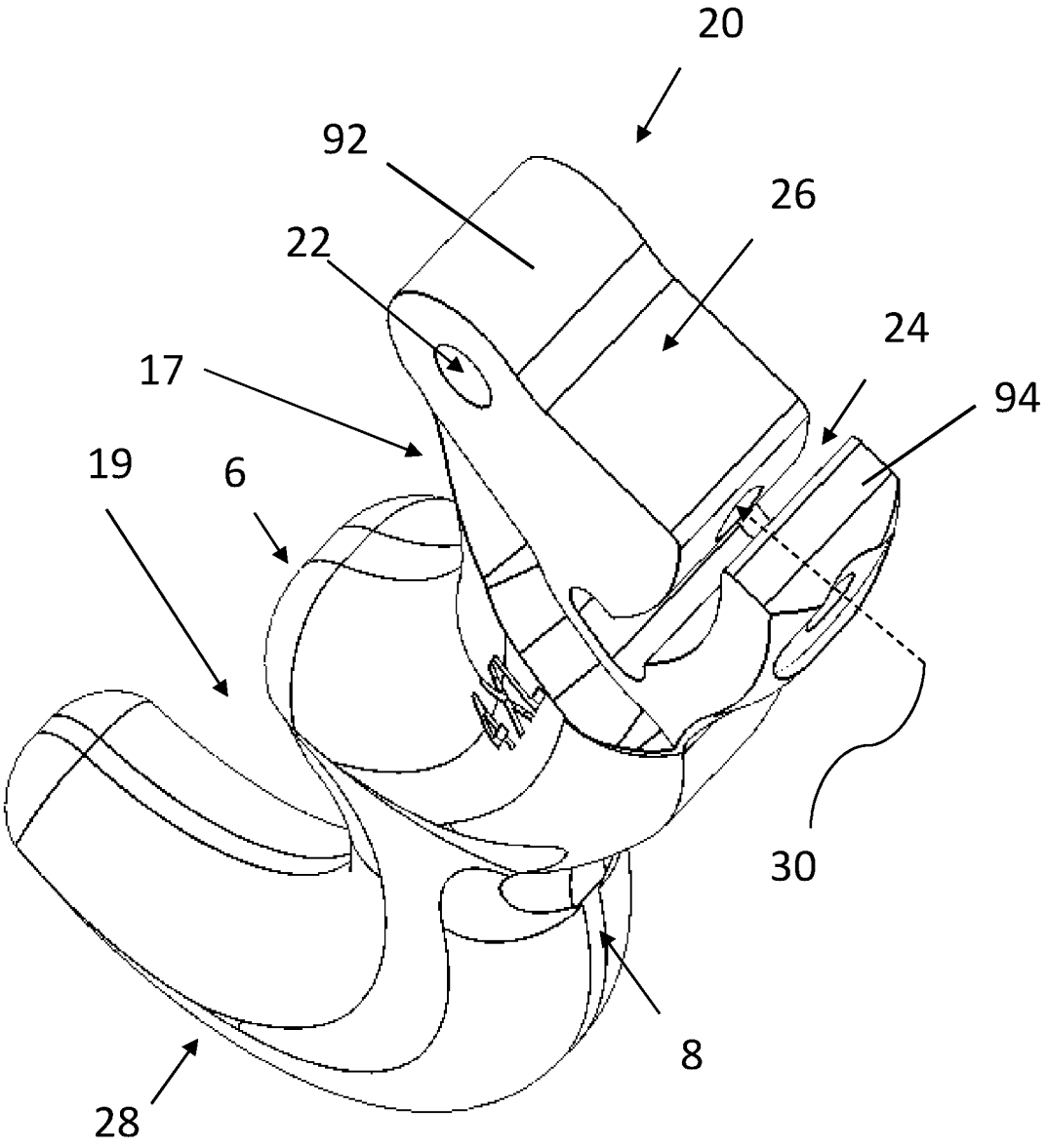
FIG. 16 is a top isometric view of the extension of FIG. 14.
Figure 17:
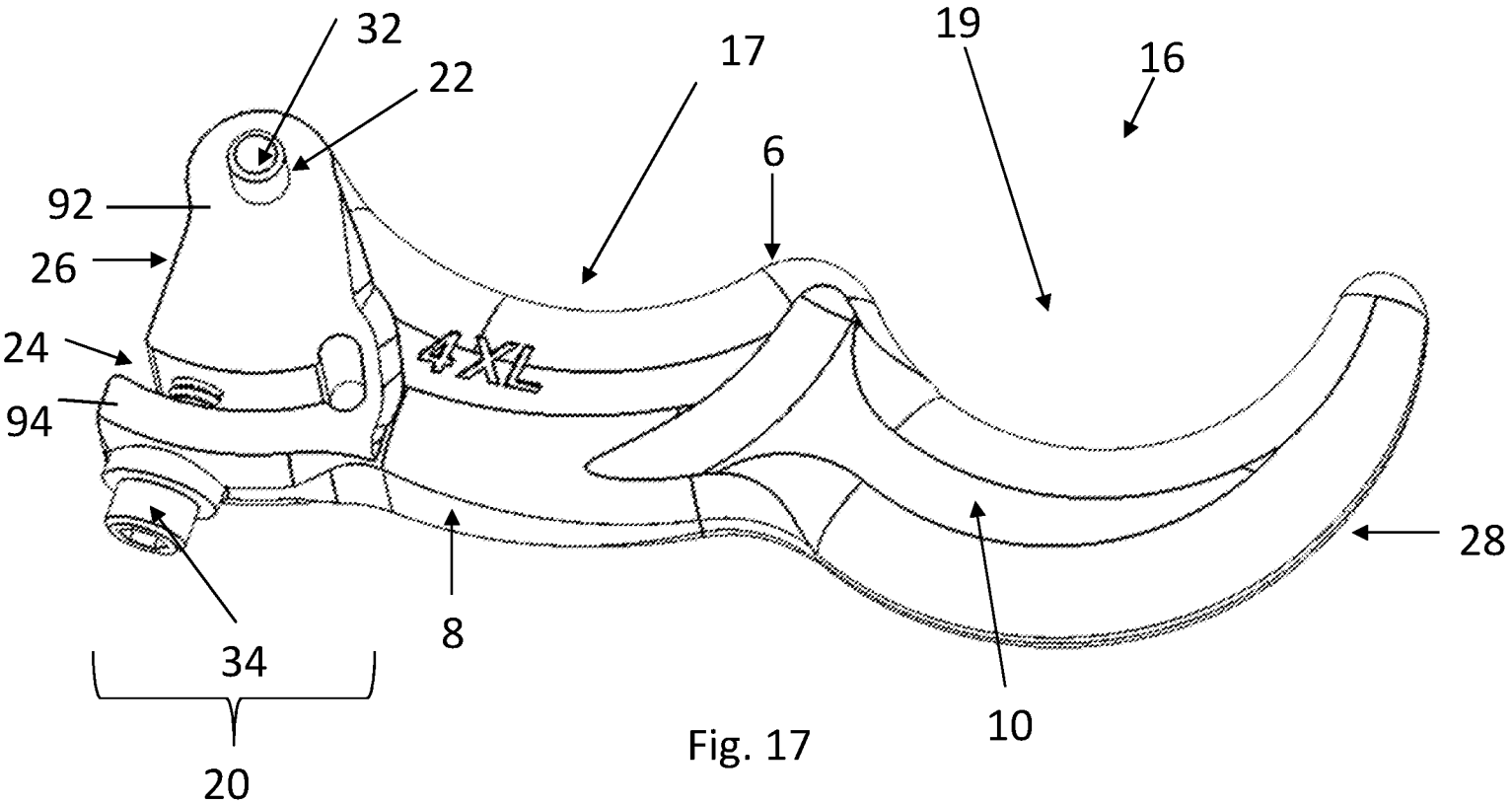
FIG. 17 is another side isometric view of the extension of FIG. 14.
Figure 18:
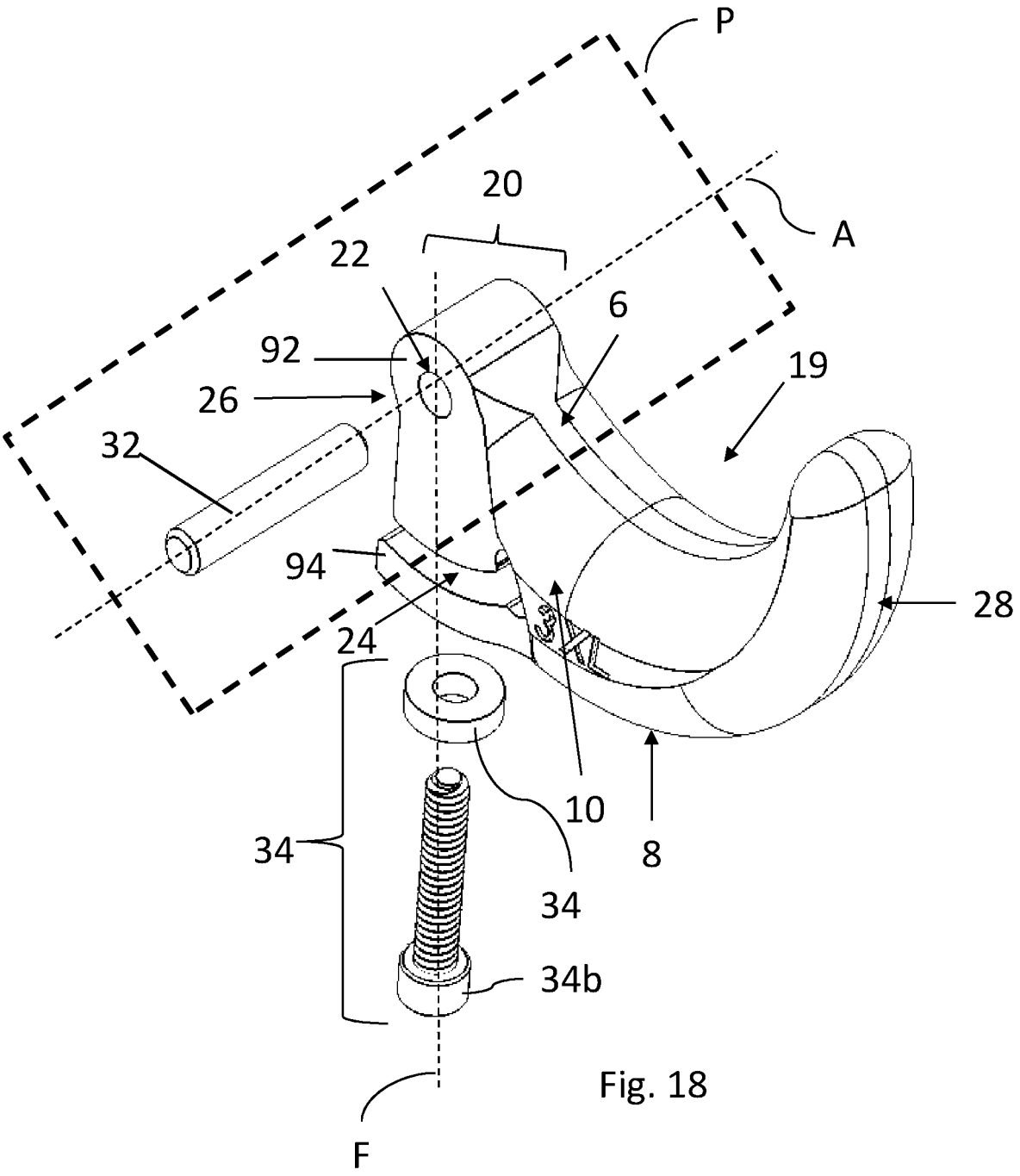
FIG. 18 is a bottom isometric exploded view of another embodiment of an extension for an archery release device.
Figure 19:
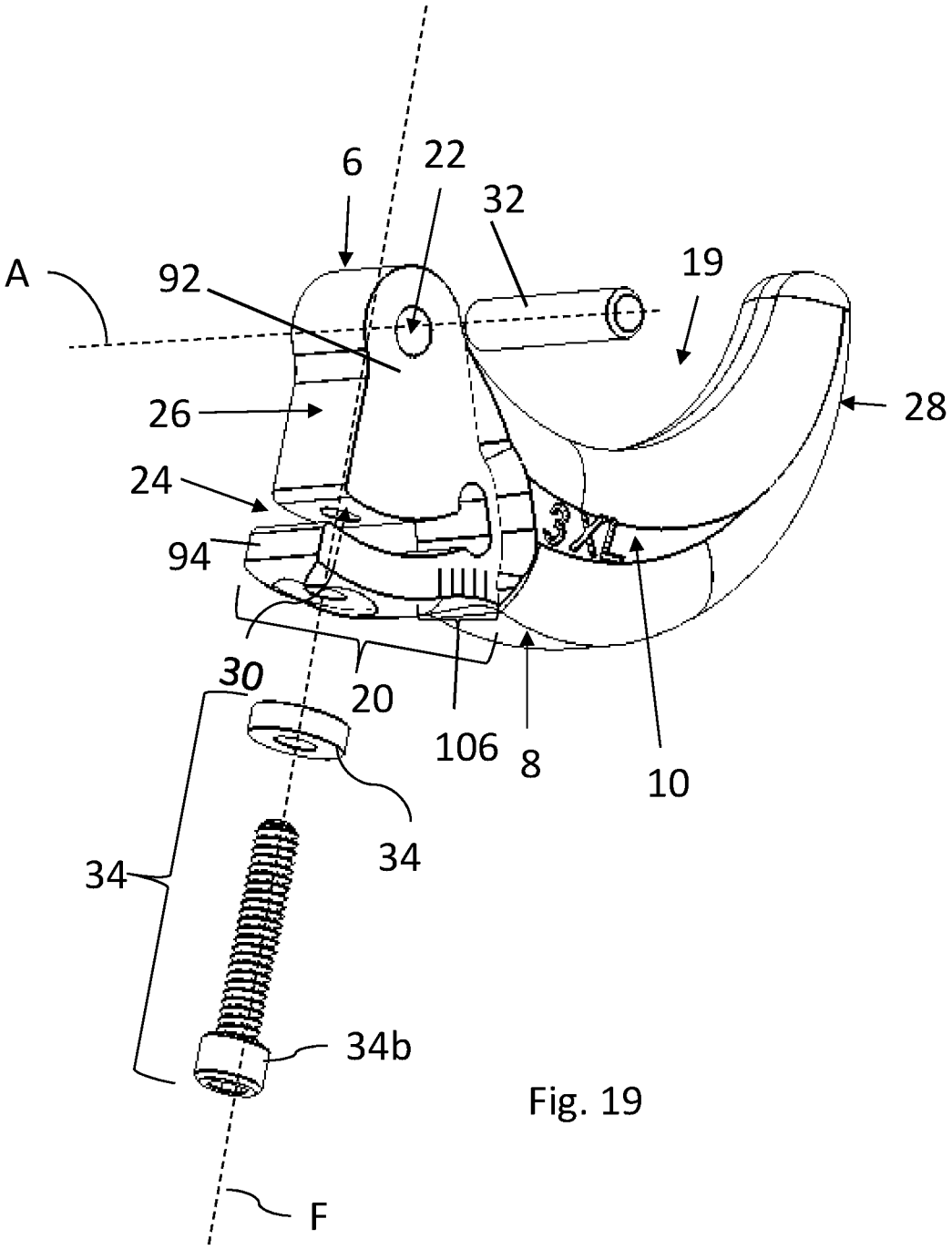
FIG. 19 is top isometric exploded view of the extension of FIG. 18.
Figure 20:
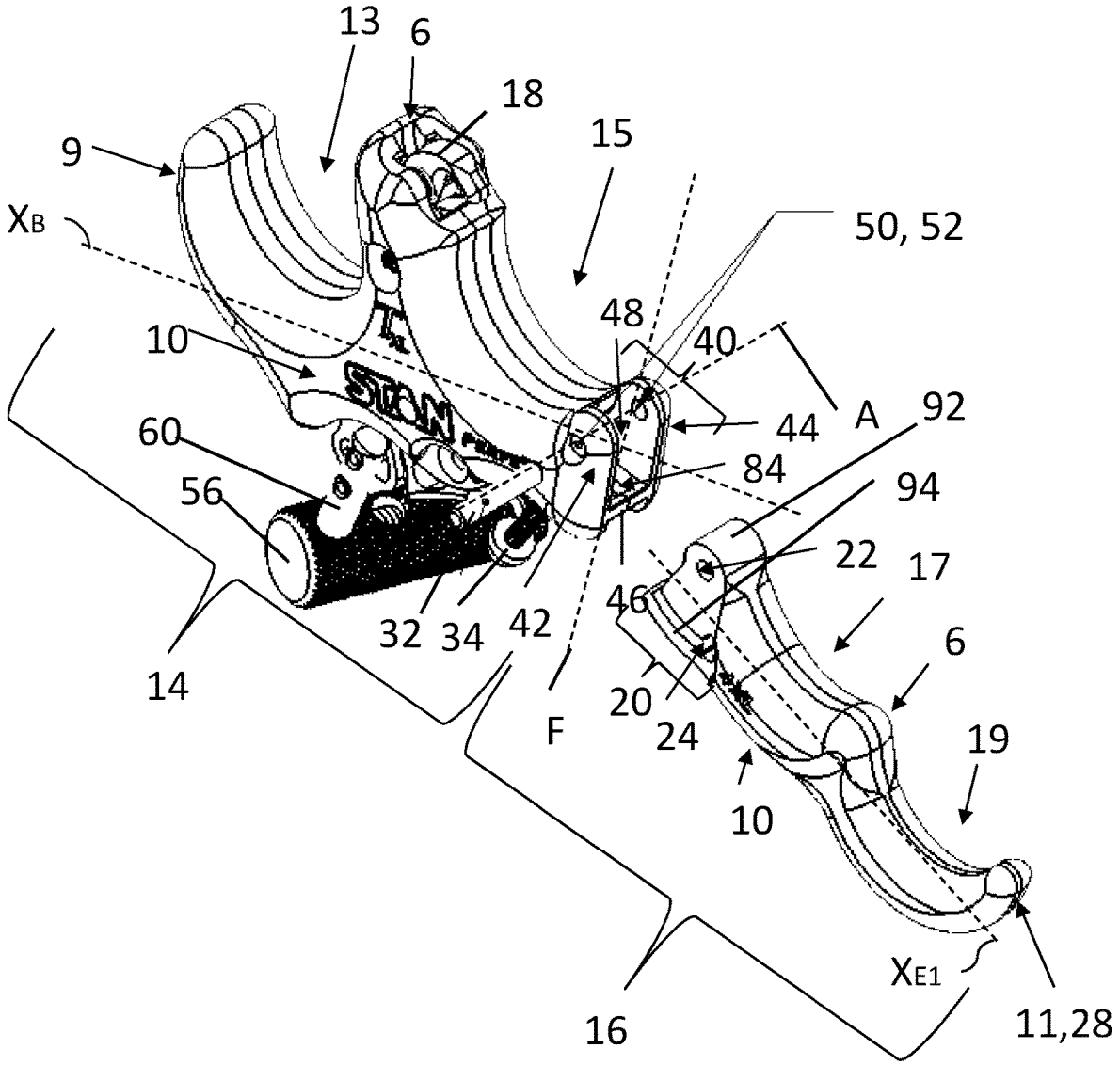
FIG. 20 is a side isometric exploded view of an embodiment of an archery release device.
Figure 21:
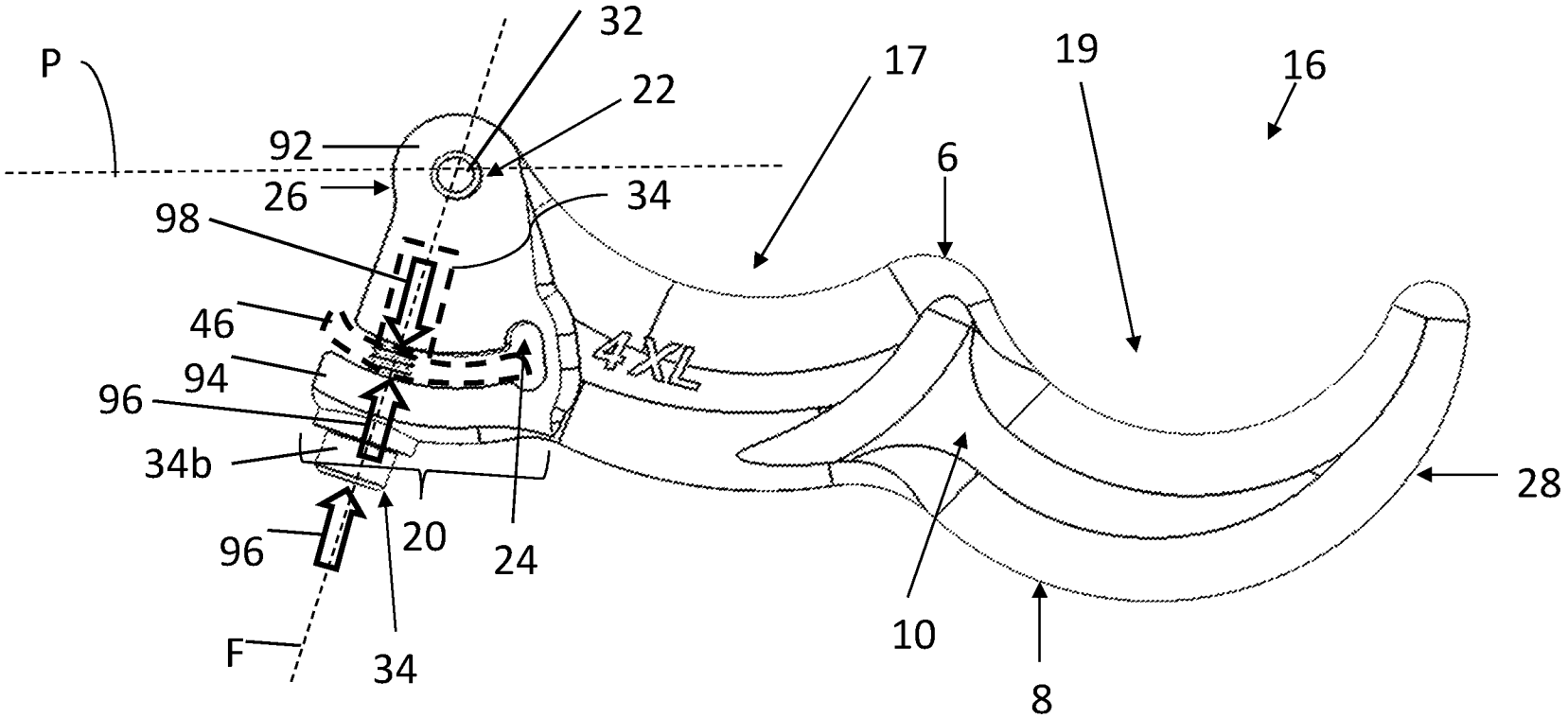
FIG. 21 is a side view of an embodiment of an extension for an archery release device showing securement forces.

Referring to FIGS. 14-21, the finger extension 16 includes a extension interface 20. In an embodiment, as illustrated in FIGS. 19-20, the extension interface 20 has a dimension along axis A that is less than the dimension of the grasp portion 89 along axis A. In this embodiment, when viewed in profile, the extension interface 20 has a generally triangular shape with an upper, narrower "point" section 88 and a longer lower section 90, as illustrated in FIG. 14. The extension interface 20 includes a horizontal bore or aperture 22, positioned near the front surface 6, extending through the upper section 88 of the extension interface 20 and a guide opening, space, or track 24 extending at least partially through the lower portion 90 of the extension interface 20 from the top surface 26 of the finger extension 16 toward the bottom surface 28 of the finger extension 16 to define a first portion 92 and second portion 94 of the extension interface 20. In an embodiment, the guide track 24 has a curved or arc shape. In the illustrated embodiment, the second portion 94 of the extension interface 20 is thinner than the first portion 92 and is configured to flex or move relative to the first portion 92. The flex zone or flex space 95, defined by the extension interface 20, increases the flexibility of the section portion 94. Accordingly, the second portion 94 functions as a flexible extension member. Alternatively, both the first portion 92 and second portion 94 can be configured to flex or move relative to each other or relative to the grasp portion 89.

A vertical bore, aperture, or opening 30 (FIG. 14), positioned near the top surface 26, extends through the extension interface 20, transverse to the track 24 and the horizontal bore 22. In an embodiment, the vertical bore 30 extends substantially perpendicularly to the track 24 and the horizontal bore 22. In this embodiment, the vertical bore 30 extends from the rear surface 8, through the second section portion 94, into and through the track 24, and at least partially into the first portion 92.

With particular reference to FIGS. 1 and 20, the finger extension 16 is configured to be pivotally coupled to the release body 14. In particular, in the illustrated embodiment, the extension interface 20 of the finger extension 16 is configured to be inserted in the gap 48 of the body mount 40 so that the horizontal bore 22 aligns with the first and second sidewall bores 50, 52, and the guide member 46 of the body mount 40 is inserted within the guide track 24 (FIG. 19) of the extension interface 20. In this example, the shape of the guide track 24 corresponds to the shape of the guide member 46. For example, the arc shape of the guide track 24 can have the same, or substantially the same, radius as the arc shape of the guide member 46.

As illustrated by FIG. 20, in this embodiment, a pivot member 32, such as a pin, is positioned within the horizontal bore 22 and the first and second sidewall bores 50, 52 along the axis A. A position adjuster, position securement, position setter, or position locking member 34, such as a set screw and washer, is positioned in the vertical bore 30 and extends through the guide track 84 of the guide member 46. In an embodiment, illustrated in FIG. 21, when the position locking member 34 is tightened or advanced into the vertical bore 30, the leg 34*a* threadably engages the first portion 92, and the head 34*b* engages the second portion 94. During the screwing process, the head 34*b* applies a force 96 (a first securement force) to the second portion 94 of the extension interface 20, causing the second portion 94 to flex or move toward the first portion 92 of the extension interface 20. At the same time, the leg 34*a* applies a force 98 (a second securement force) to the first portion 92. The force 98 acts to urge the first portion 92 toward the second portion 94. As shown, the guide member 46 is positioned within the guide track 84 between the first portion 92 and second portion 94. The forces 94, 98 act toward each other to generate a compression force acting on the guide member 46. This results in a squeezing and clamping of the guide member 46 to lock or secure the position of the finger extension 16 relative to the release body 14. In this example, due to the relative positions of the vertical and horizontal bores 30, 22, the forces 96, 98 and the resulting compression force are exerted along an axis F (securement axis) that intersects with the pivot plane P (FIGS. 19 and 21), the plane in which pivot member 32 extends.

This cooperative configurations of the extension interface 20 and the body mount 40 provide several advantages and improvements. The second portion 94 is relatively flexible and facilitates the ease in locking or securing the finger extension 16 to the release body 14. Also, the compression force, acting along axis F, is transverse to or intersects with the pivot plane P, the plane of the axis A about which the finger extension 16 pivots. Such direction of the compression force, relative to the pivoting action of the finger extension 16, enhances the securement of the finger extension 16 to the release body 14. Furthermore, the contact surfaces 80, 82 of the second portion 94 have relatively large surface areas. These relatively large surface areas increase the frictional forces between the guide member 46 and the finger extension 16. This increase in frictional force enhances the securement of the finger extension 16 to the release body 14. In addition, these relatively large surface areas improves the stability of the finger extension 16 on the release body 14.

Figure 22:
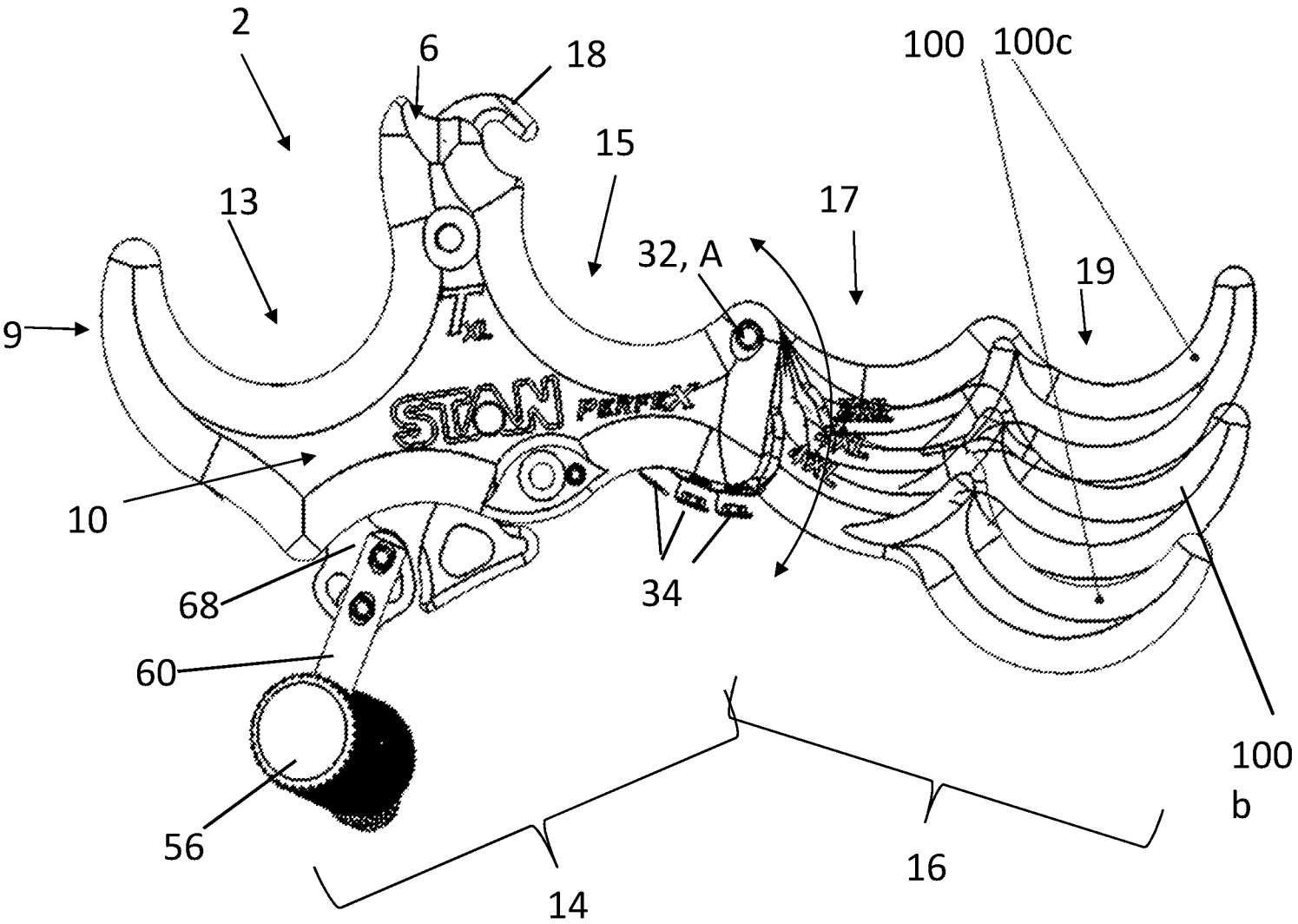
FIG. 22 is a side view of an embodiment of an archery release device with an adjustable extension showing a variety of extension positions.
Figure 23A:
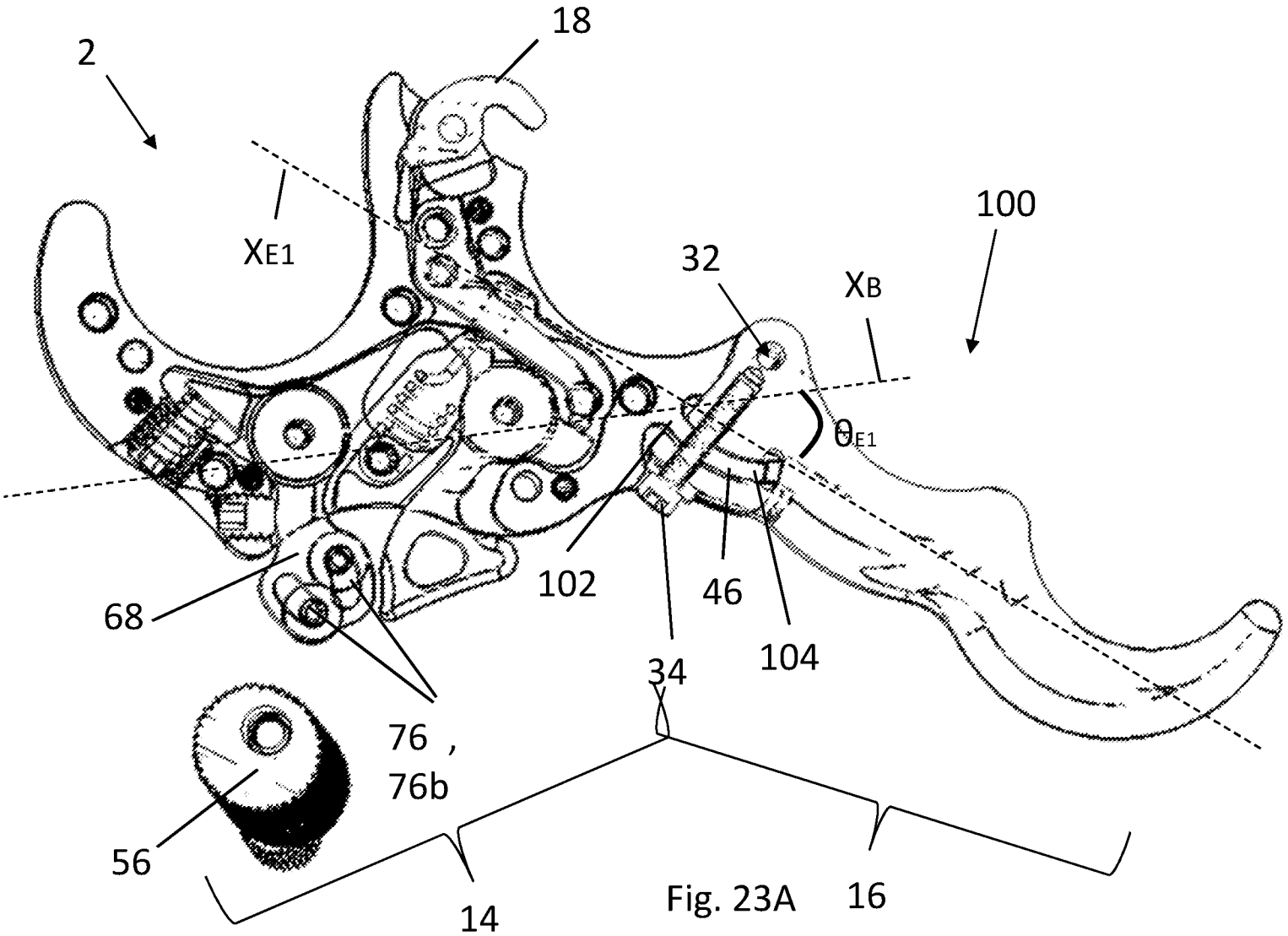
FIG. 23A is a cross-sectional view of the archery release device of FIG. 22 with the extension in a first position.
Figure 23B:
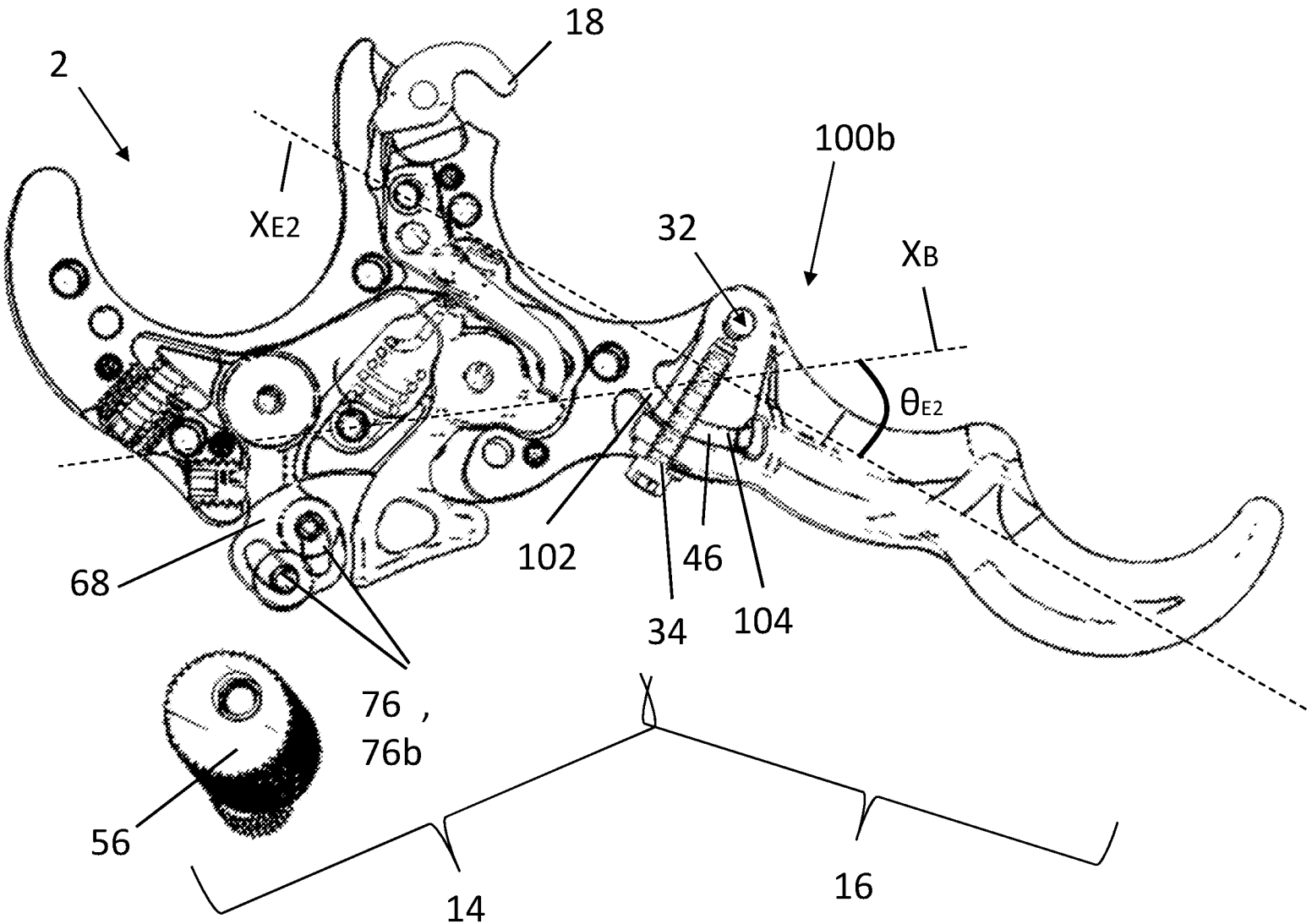
FIG. 23B is a cross-sectional view of the archery release device of FIG. 22 with the extension in a second position.
Figure 23C:
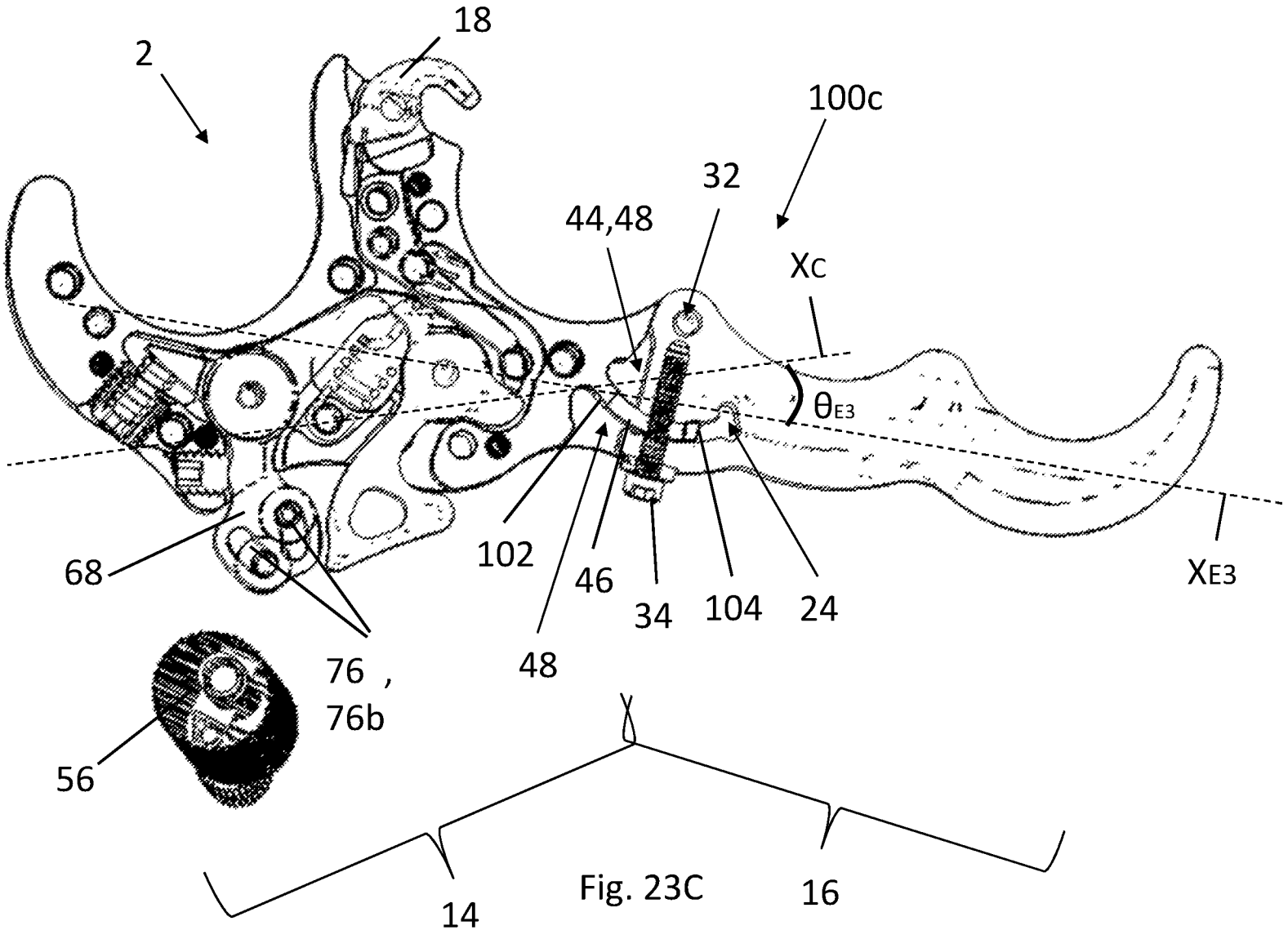
FIG. 23C is a cross-sectional view of the archery release device of FIG. 22 with the extension in a third position.

Referring to FIGS. 22-23C, when the position locking member 34 is not fully tightened in the finger extension 16, the finger extension 16 can pivot or rotate about the pivot member 32, causing a slide engagement between the guide member 46 and the guide track 24 in which the guide track 24 slides along the guide member 46. In an embodiment, the guide member 46 and guide track 24 can have a corresponding curved shape to facilitate the rotational movement of the finger extension 16.

To adjust the angular position of the finger extension 16 relative to the release body 14, the user can partially unscrew the position locking member 34. This results in an adjustment mode. During the adjustment mode, the finger extension 16 is coupled to the release body 14 such that the finger extension 16 can pivot or rotate relative to the release body 14. In this embodiment, the pivot member 32 extends along axis A about which the finger extension 16 rotates or pivots. As illustrated by FIG. 22, the finger extension 16 can rotate or pivot between a variety of positions 100*a*, 100*b*, 100*c*. In an embodiment, when the finger extension 16 is in the desired position, the user can tighten the position locking member 34 (screwing it into the finger extension 16), securing the position of the finger extension 16 to prevent movement relative to the release body 14. While only three positions 100*a*, 100*b*, 100*c* are illustrated here, it should be under stood that the finger extension 16 can pivot between an unrestricted quantity of positions relative to the release body 14. In another embodiment, not illustrated, the finger extension 16 freely rotates between a variety of positions without locking into any particular position. Furthermore, while the finger extension 16 is described as moving relative to the release body 14, it is to be understood that the reverse, in which the release body 14 moves relative to the finger extension 16, can also occur.

As illustrated in FIG. 20, the finger extension 16 extends along a longitudinal finger extension axis $X_{E1}$, and the release body 14 extends along a longitudinal release body axis $X_B$. In the example shown in FIG. 23A, when the finger extension 16 is at position 100*a*, the axis $X_E$ of the finger extension 16 intersects the axis $X_B$ of the release body 14 at a first angle $\theta_{E1}$. In this position 100*a*, the position locking member 34 extends through the guide member 46 at a first end 102 of the guide member 46. In the example shown in FIG. 23B, when the finger extension 16 is at position 100*b*, the axis $X_E$ of the finger extension 16 intersects the axis $X_B$ of the release body 14 at a second angle $\theta_{E2}$, which is smaller than the first angle $\theta_{E1}$. In this position 100*b*, the position locking member 34 extends through the guide member 46 between the first end 102 and the second end 104. In the example shown in FIG. 23C, when the finger extension 16 is at position 100*c*, the axis $X_E$ of the finger extension 16 intersects the axis $X_B$ of the release body 14 at a third angle $\theta_{E3}$, which is smaller than the first angle $\theta_{E1}$ and the second angle $\theta_{E2}$. In this position 100*c*, the position locking member 34 extends through the guide member 46 at the second end 104.

In an embodiment illustrated by FIG. 19 the extension interface 20 includes a position indicator 106 to indicate the angular position of the finger extension 16 relative to the release body 14. In this embodiment, the position indicator 106 includes a series of marks or lines equally spaced apart from each other. Depending upon the embodiment, the release body 14 can include a complimentary position indicator (not shown) positioned adjacent to the position indicator 106. The complimentary position indicator can include an arrow, line, symbol or other mark. During the adjustment mode, the user can view the a position indicator 106, alone or in conjunction with the complimentary position indicator, to arrive at a desired position setting for the finger extension 16. This facilitates the process of achieving repeatable position settings for the finger extension 16, providing an improvement in fine tuning functionality.

It is to be understood that while the body mount 40 of the release body 14 and the extension interface 20 are described as having particular respective structures, the reverse is also possible in which the release body 14 includes the structural disposition of the extension interface 20 and the finger extension 16 includes the structural disposition of the body mount 40.

By permitting the finger extension 16 to rotate between various positions relative to the release body 14, a variety of hand shapes can be comfortably accommodate and the release 2 can be optimized to a particular archer's hand shape, resulting in more comfort for the archer and, potentially, improved shooting accuracy.

FIGS. 24-33 illustrate another embodiment of an archery release device 250. Similar to the archery release device 2 described above, the archery release device 250 includes a release body 252 and an extension 200. However, as will be further described below, the archery release device 250 additionally includes a position controller 226.

Figure 25:
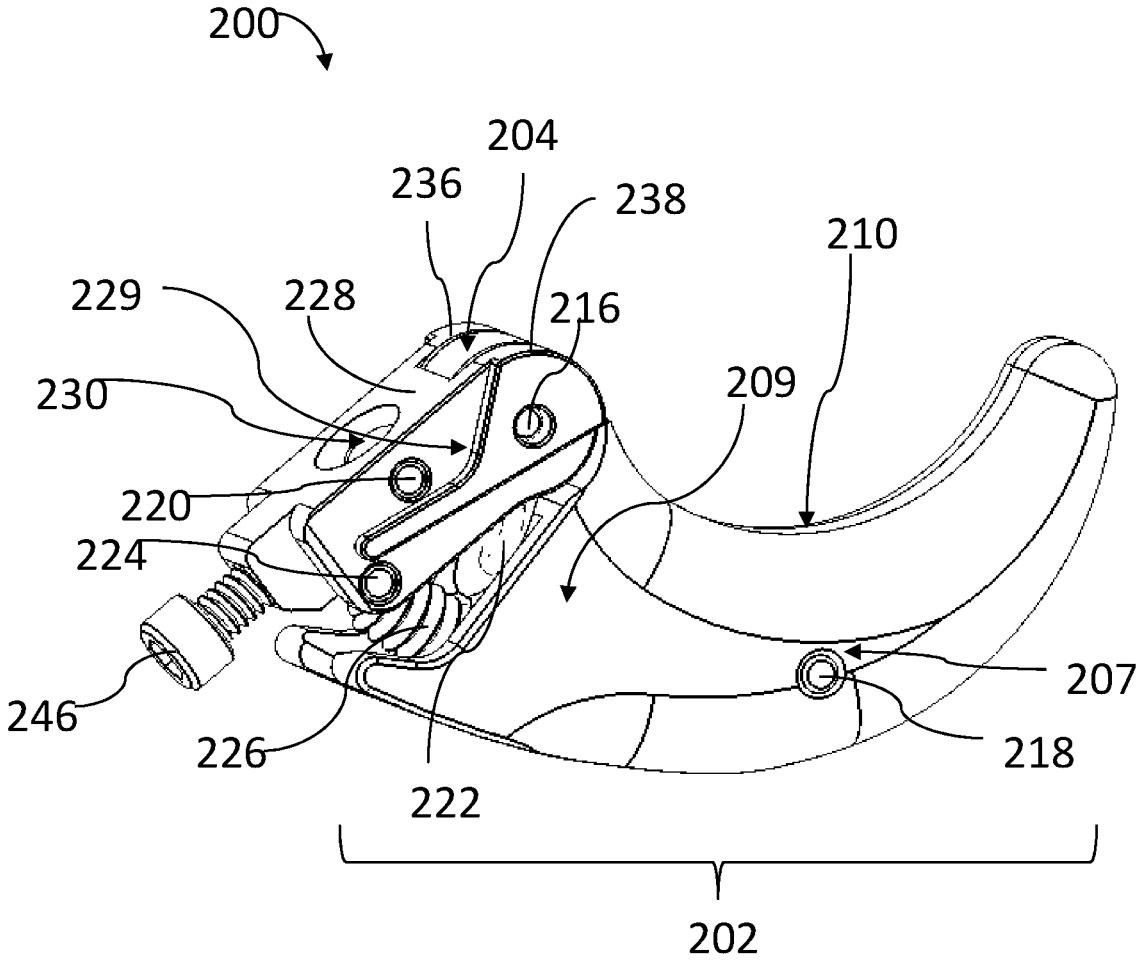
FIG. 25 is a side isometric view of an embodiment of an extension for the archery release device of FIG. 24.
Figure 26:
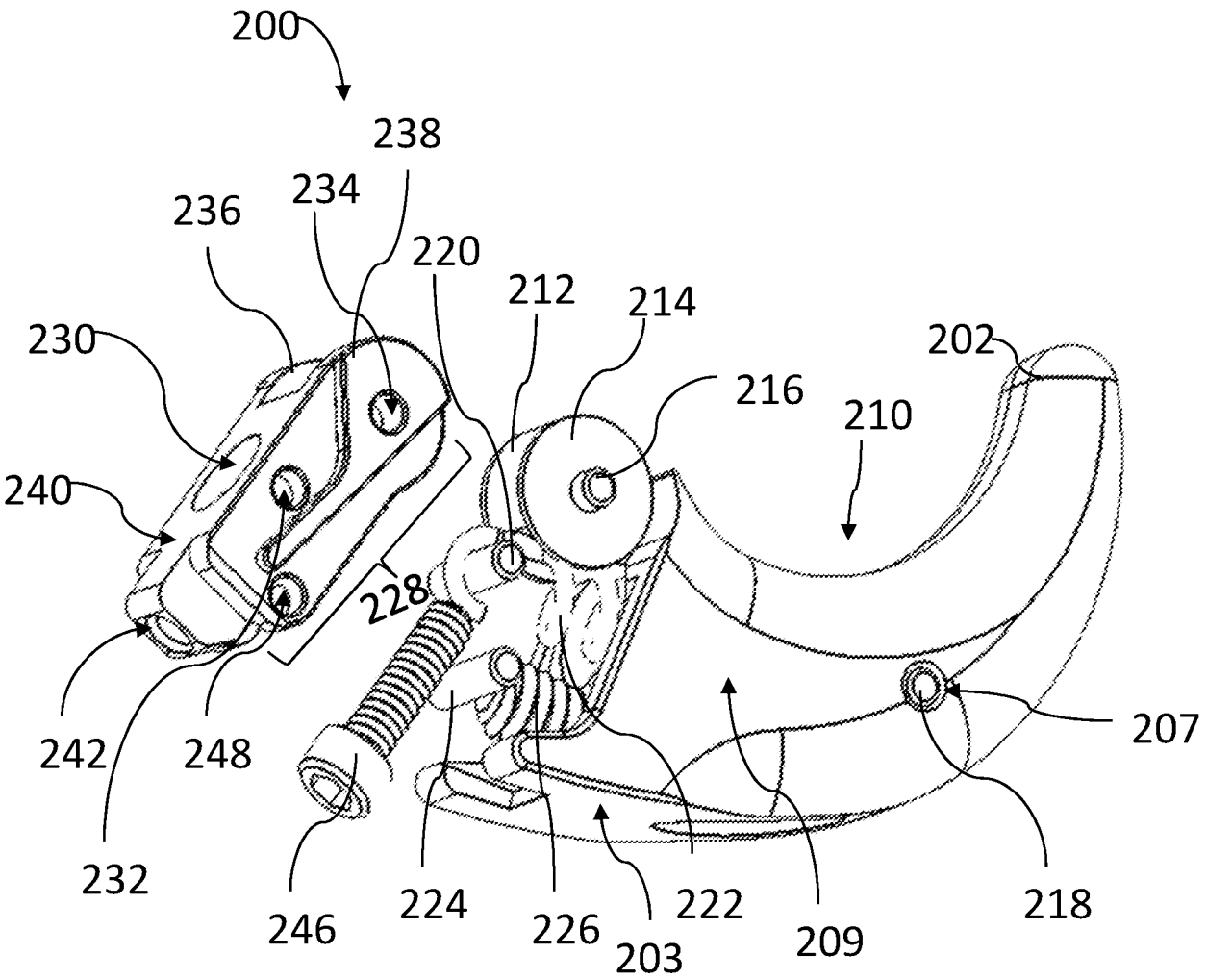
FIG. 26 is a partially exploded side isometric view of the extension of FIG. 24.

With particular reference to FIGS. 25-31, the extension 200 includes an extension body or housing 202. The extension housing 202 has a first side 205, and a second side 209, a front surface 201 , and a rear surface 203 (FIG. 26). Joining the first and second sides 205, 209 is a finger engagement surface 210. As described above with regard to archery release device 2, the finger engagement surface 210 is shaped to accommodate one or more fingers, such as the ring finger and/or pinky finger, of an archer. An opening, aperture, or bore 207 extends through the release body 202 from the first side 205 to the second side 209. Each side 205, 209 has a curved or arc shape with an leg 211, 213 extending beyond the bottom of the front surface 201.

Figure 28:
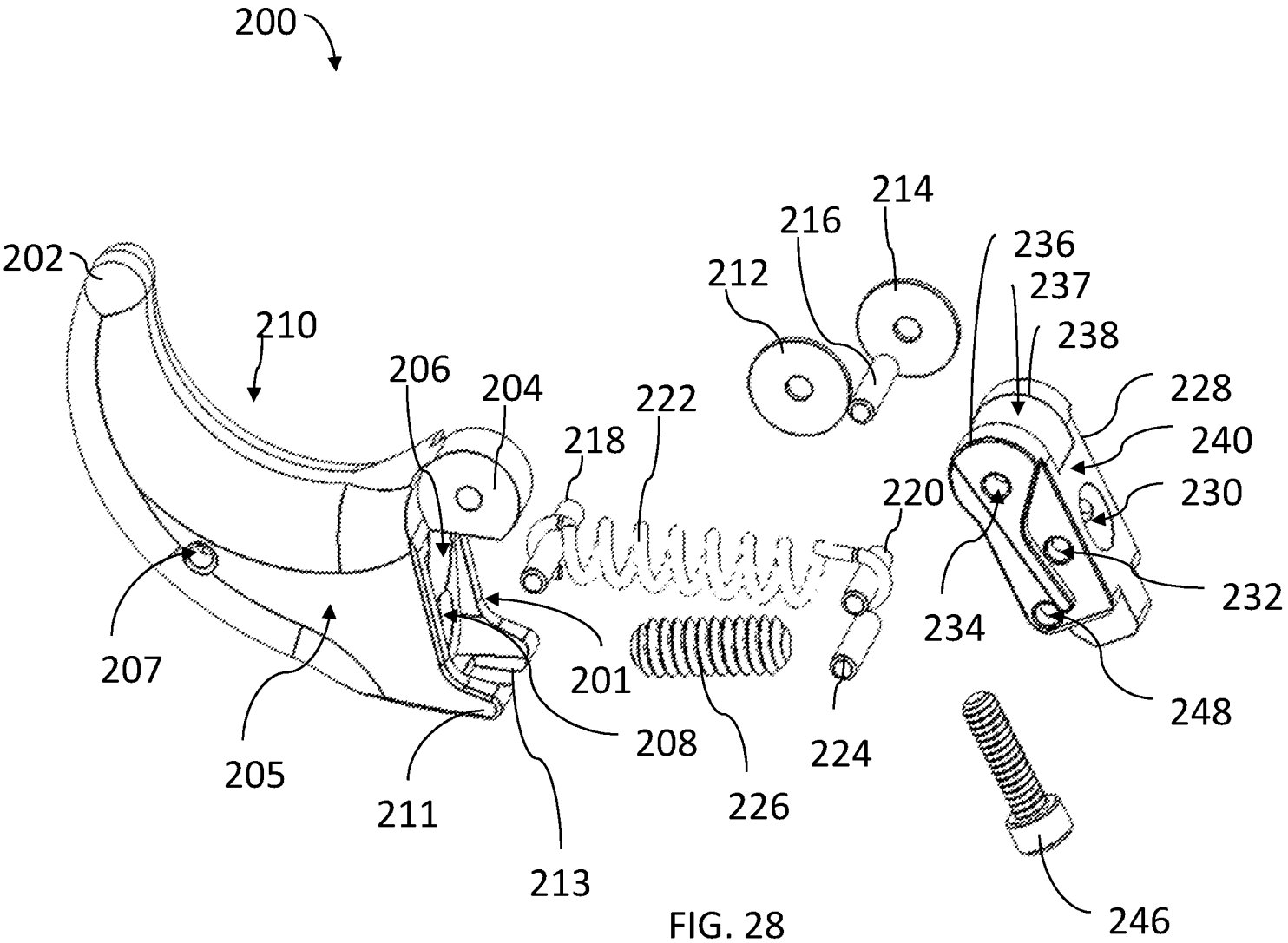
FIG. 28 is an exploded side isometric view of the extension of FIG. 24.
Figure 29:
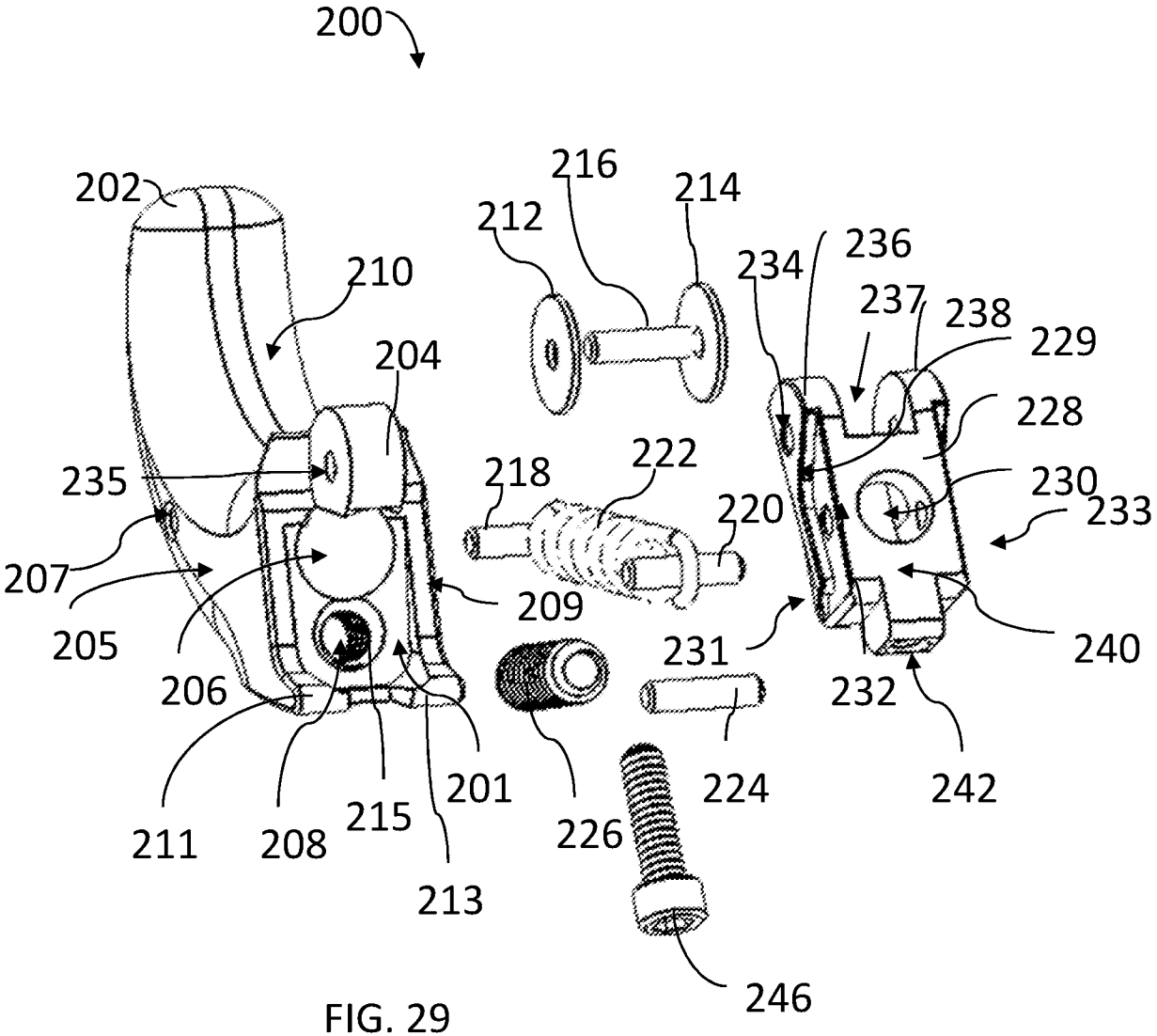
FIG. 29 is an exploded front isometric view of the extension of FIG. 24.

As particularly illustrated by FIG. 28, a pivot interface 204, having the shape of a hollow cylinder, protrudes from the front surface 201 of the extension body 202 with a pivot bore or opening 235 extending through the pivot interface 204 from side 205 to side 209. A first aperture 206 extends from the front surface 201 into the release body 202. A second aperture 208, located below the first aperture 206, extends through the release body 202 from the front surface 201 to the rear surface 203. As illustrated by FIG. 29, at least a portion of the second aperture 208 has a threaded interior surface 215.

Figure 27:
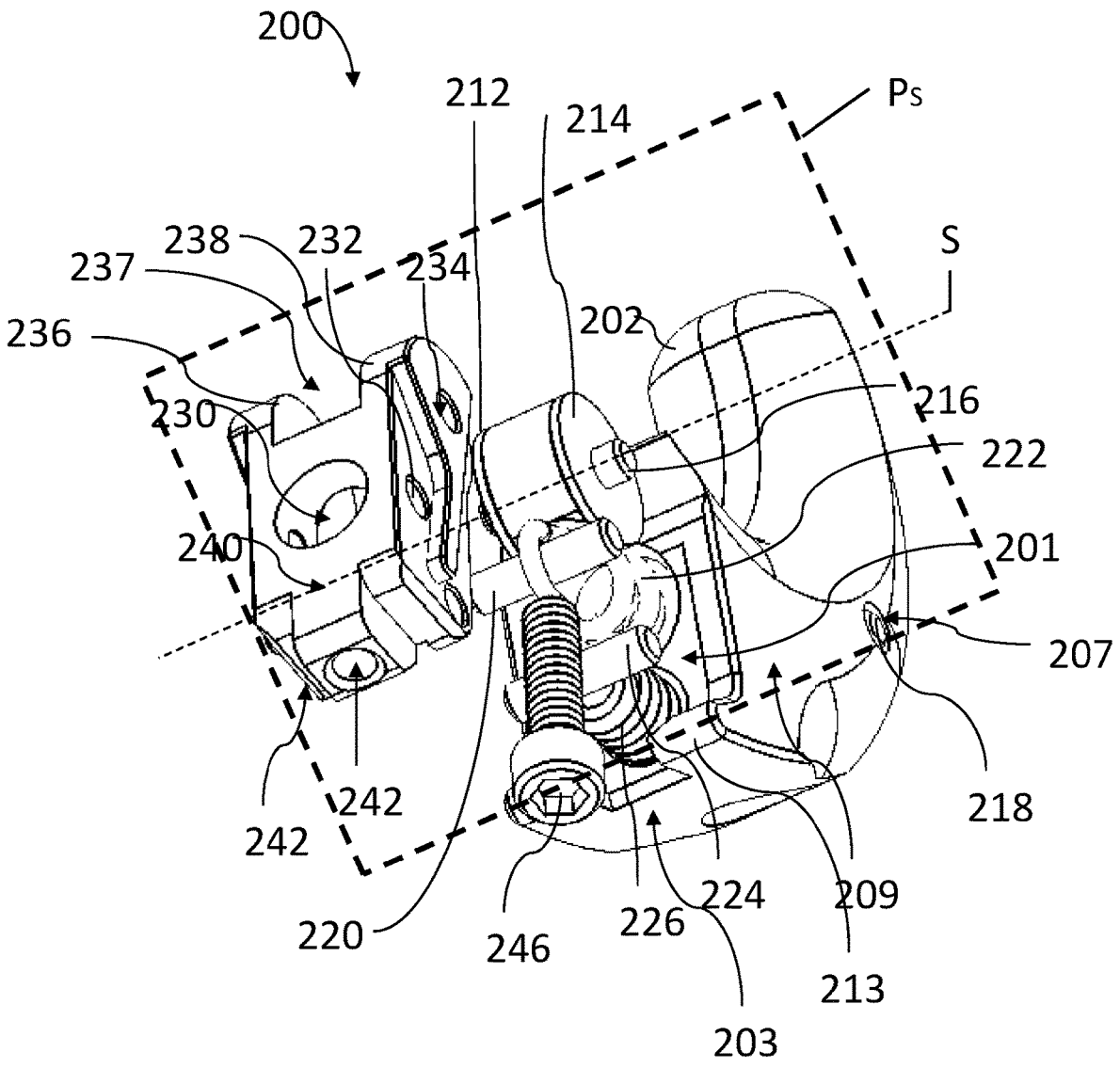
FIG. 27 is a partially exploded front isometric view of the extension of FIG. 24.

The extension 200 also includes an interface member 228. The interface member 228 has a first side surface 231 and a second side surface 233 (FIG. 29) joined by a front surface 240 and a bottom surface 244 (FIG. 27). An aperture 230 extends through the front surface 240. A securement aperture 242 extends through the bottom surface 244.

Each side surface 231, 233, has a leg or extension member 236, 238 extending above or beyond the front surface 240, opposite the bottom surface 244, and defining a gap 237 between the extension members 236, 238. Each side surface 231, 233 has a molded or shaped surface in which a y-shaped protrusion 229 extends outward. Each side surface 231, 233 includes a pivot aperture 234 extending through the protrusion 229 of each side surface 231, 233 to the gap 237. In addition, an anchor aperture 232 extends through each side surface 231, 233 to the gap 237 and a brace aperture 248 extends through each side surface 231, 233 to the gap 237.

As illustrated by FIG. 25, when the extension is assembly, the interface body 228 is aligned with the extension body 202 so that the pivot interface 204 is positioned within the gap 237 and the pivot bore 235 is aligned with the pivot apertures 234. As particularly illustrated by FIG. 26, a pivot member 216 is received or retained in the pivot aperture 235 of the extension body 202 and the pivot apertures 234 of the interface body 228. The pivot member 216 extends along a pivot axis S, extending in a pivot plane $P_S$ (FIG. 27). A first washer 212 and second washer 214 are disposed on either end of the pivot member 216 between the pivot interface 204 and the sides 231, 233. Due to this pivot connection, the extension body 202 is able to pivot or rotate about the pivot axis S relative to the interface body 228, or vice versa.

Figure 30:
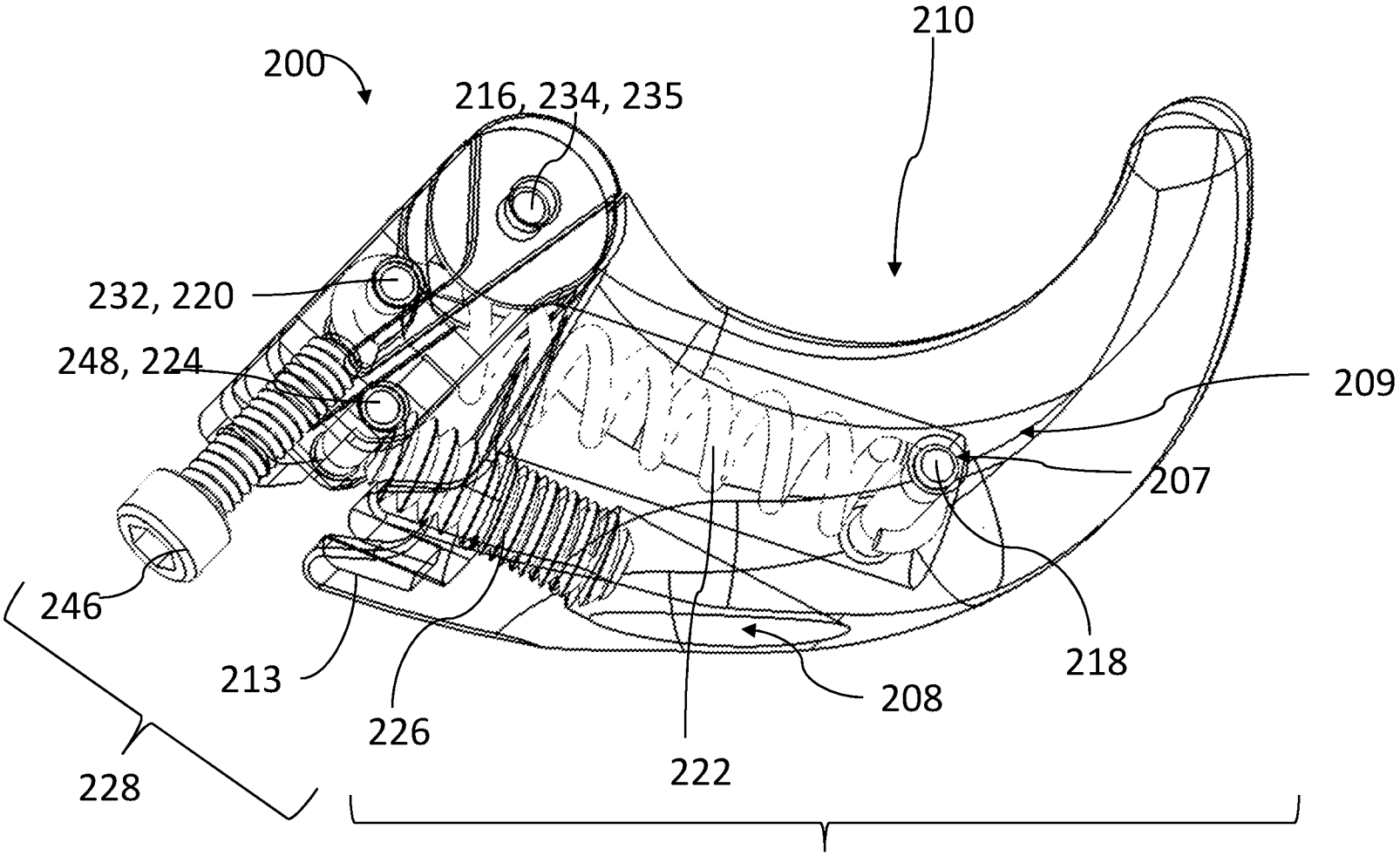
FIG. 30 is a side view of the extension of FIG. 24 showing the internal components.
Figure 31:
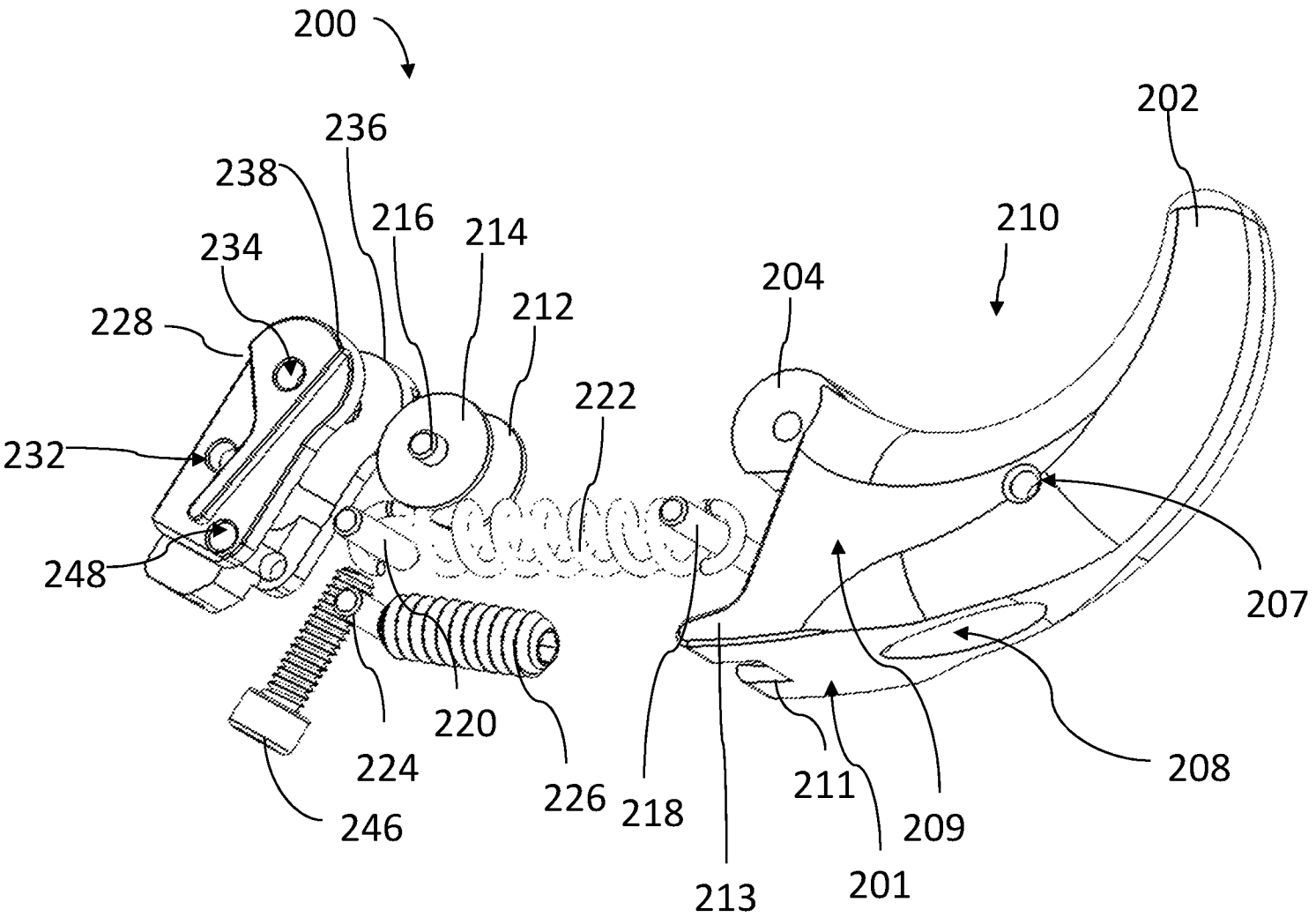
FIG. 31 is a partially exploded rear isometric view of the extension of FIG. 24.

As illustrated by FIG. 30, a brace member 224, such as a pin, is retained or positioned within the brace apertures 248, spanning the gap 237. A position adjuster 226 is positioned within the second aperture 208 of the extension body 202. In the illustrated embodiment, the position adjuster 226 is a set screw having a threaded surface that engages the threaded surface 215 of the second aperture 208. The position adjuster 226 makes direct physical contact with the brace member 224.

The extension 200 also includes a biasing member 222, such as an extension spring, which is anchored at each end by a first anchor member 218 and a second anchor member 220, respectively, as illustrated by FIG. 28. As particularly illustrated by FIG. 30, the first anchor member 218 is retained or positioned with the aperture 207 of the extension body 202 and the second anchor member 220 is retained within the anchor apertures 232, and spanning the gap 237, of the interface body 228. The biasing member 222 is retained at least partially within the aperture 206, extending into the extension body 202 and is anchored at either end to the first anchor member 218 and the second anchor member 220. In operation, the biasing member 222 biases the interface body 228 and the extension body 202 towards each other in order to maintain physical contact between the brace member 224 and the position adjuster 226.

In operation, the position adjuster 226 can be rotated, such as by inserting a tool (not shown) in the second aperture 208. The rotation of the position adjuster 226 engages the threaded surface 215 of the second aperture 208. As the position adjuster 226 is in physical contact with the brace member 224, as maintained by the biasing member 222, the engagement of the threaded surface 215 causes the extension body 202 to rotate about the pivot member 216. This rotation changes the angle of the extension body 202 (or the longitudinal axis extending therein) relative to the release body 252. For example, each revolution of the position adjuster 226 causes a designated change in the degree of such angle. This enables the user to fine tune the extension body 202 with a relatively high amount of incremental control or micro control. It should be appreciated that even a partial rotation of the position adjuster 226 will correspond to a designated change in such angle that may be desired by the user. After the user has reached the desired angle of the extension body 202 relative to the release body 252, the user can grasp the archery release device 250 for aiming and shooting purposes. While the user is applying a grasping force to the extension body 202, counteracting the pulling force of the draw cord, there will be physical contact between the brace member 224 and the position adjuster 226. When the user removes the user's grasp force, for example, when temporarily disengaging the archery release device 250 from the draw cord, the biasing member 222 ensures that the extension body 202 maintains the desired angle. To achieve this, the biasing member 222 applies a constant biasing force that keeps the position adjuster 226 in physical contact with the brace member 224. This operates to maintain the desired angle of the extension body 202 without relying upon the user's grasping force.

Figure 32:
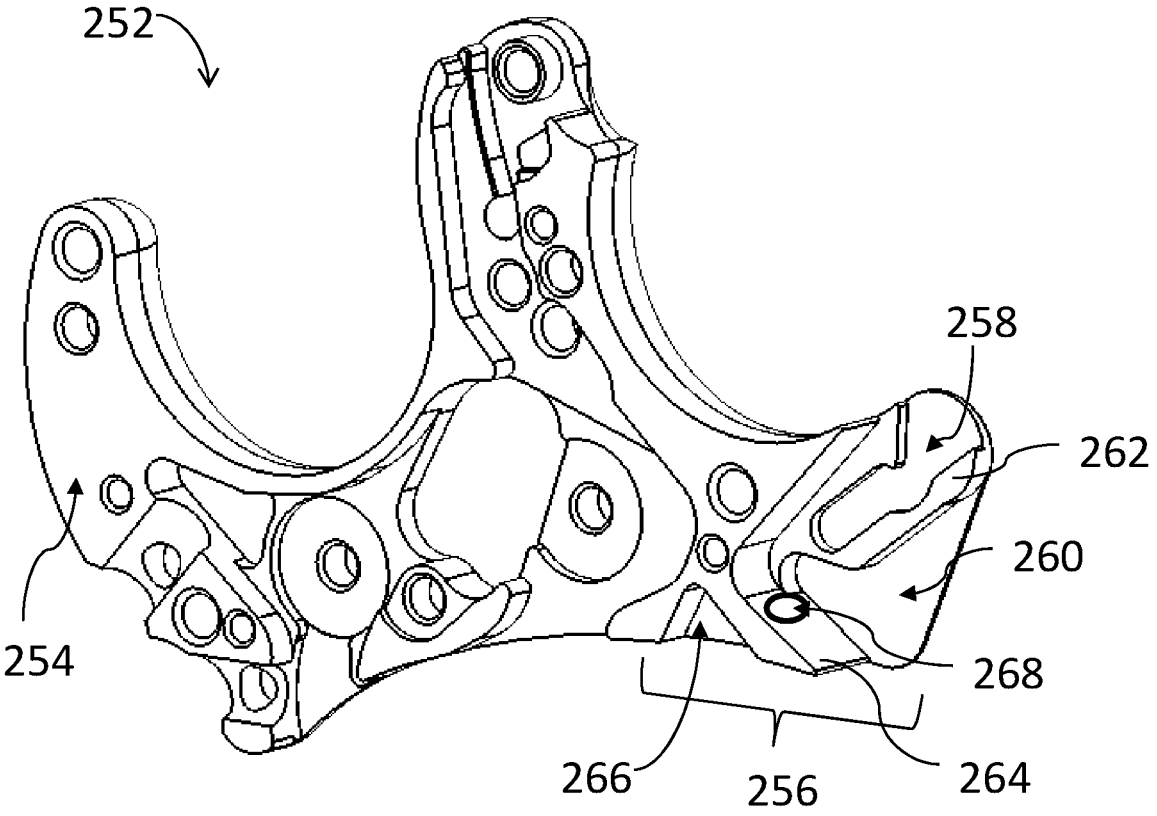
FIG. 32 is a cross-sectional view of an embodiment of a release body housing of the archery release device of FIG. 24.
Figure 33:
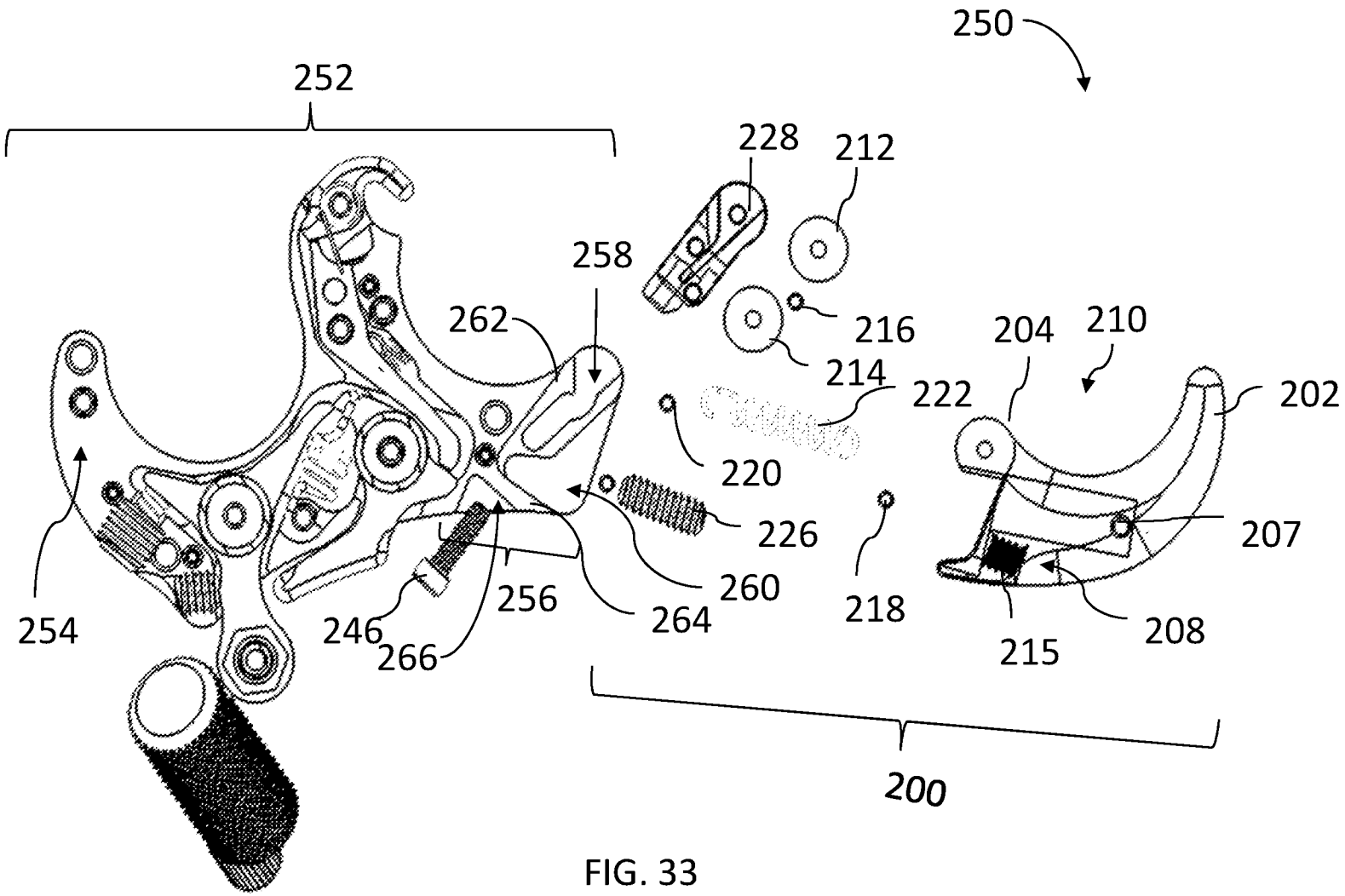
FIG. 33 is an exploded cross-sectional view of the archery release device of FIG. 24.
Figure 34:
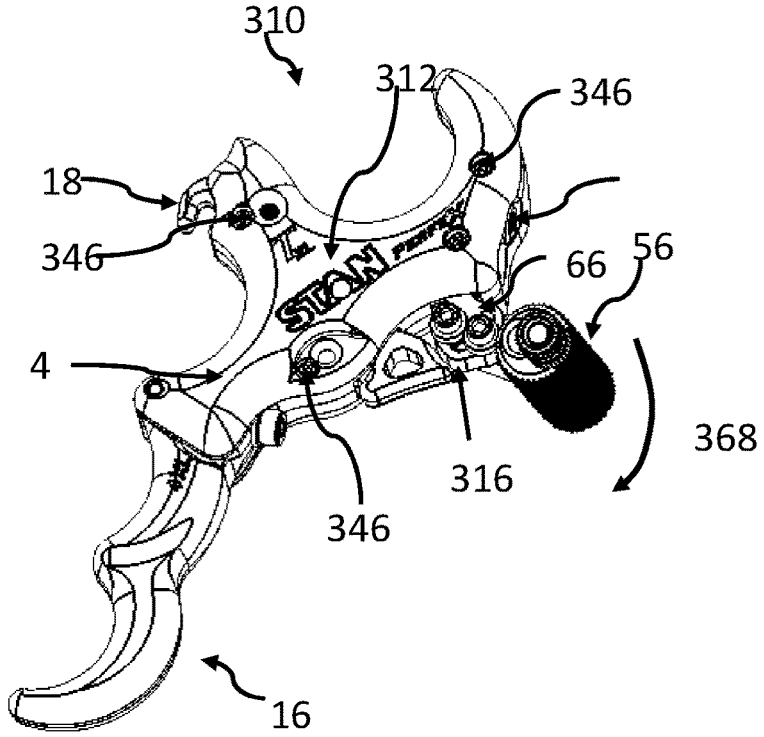
FIG. 34 is a top isometric view of yet another embodiment of the archery release device.
Figure 35:
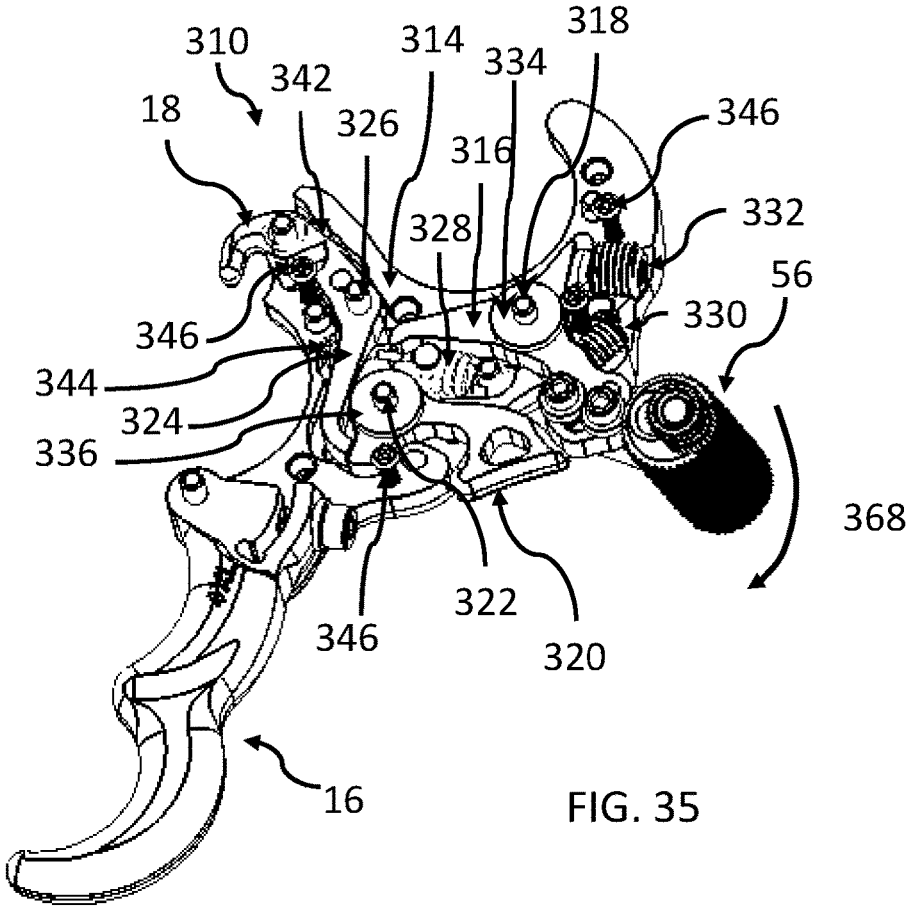
FIG. 35 is a fragmentary view of the archery release device of FIG. 34, illustrating the internal components with the upper housing portion removed.
Figure 36:
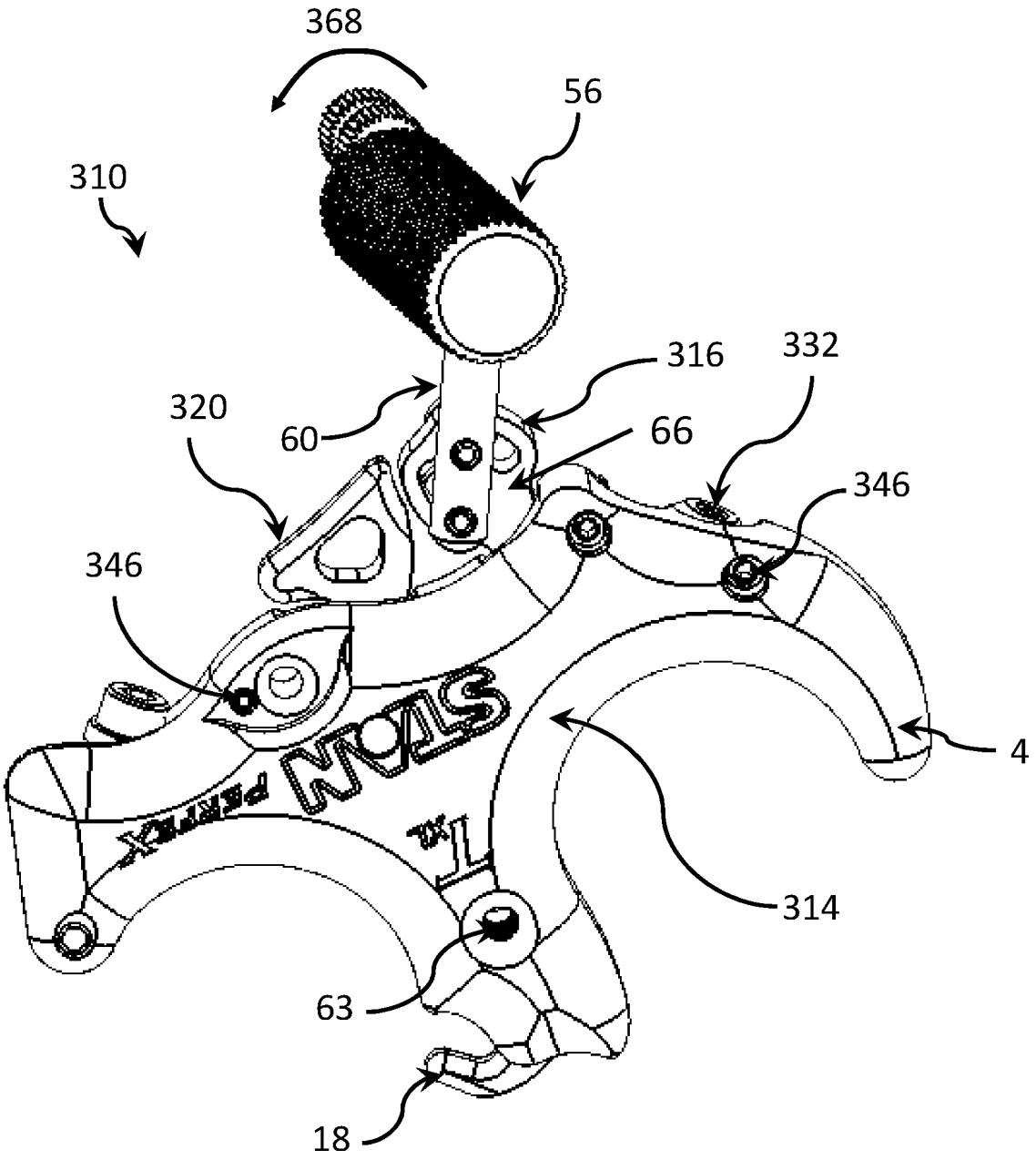
FIG. 36 is an isometric view of the lower housing portion of the archery release device of FIG. 34.

Referring to FIG. 32, the release body 252 includes a housing 254. The housing 254 has a similar overall shape to the housing 4 of the archery release device 2 described above. In this embodiment, the housing 254 includes a body interface 256 for coupling to the extension 200. In the illustrated embodiment, the body interface 256 has a molded shape that conforms or cooperates with the shape of the interface body 228. In this embodiment, the body interface 256 has a y-shaped cutout area that corresponds to the y-shaped protrusion 229 of the interface body 228 and a surrounding protruding area 262. Below the protruding area 262, a second cutout or depression area 260 corresponds to the shape of the front edge and legs 211, 213 of the sides 205, 209 of the extension body 202. An interior ledge 264 separates the second cutout area 260 and the protruding area 262 from a third cutout area 266. An aperture or bore 268 extends through the ledge 264.

Figure 24:
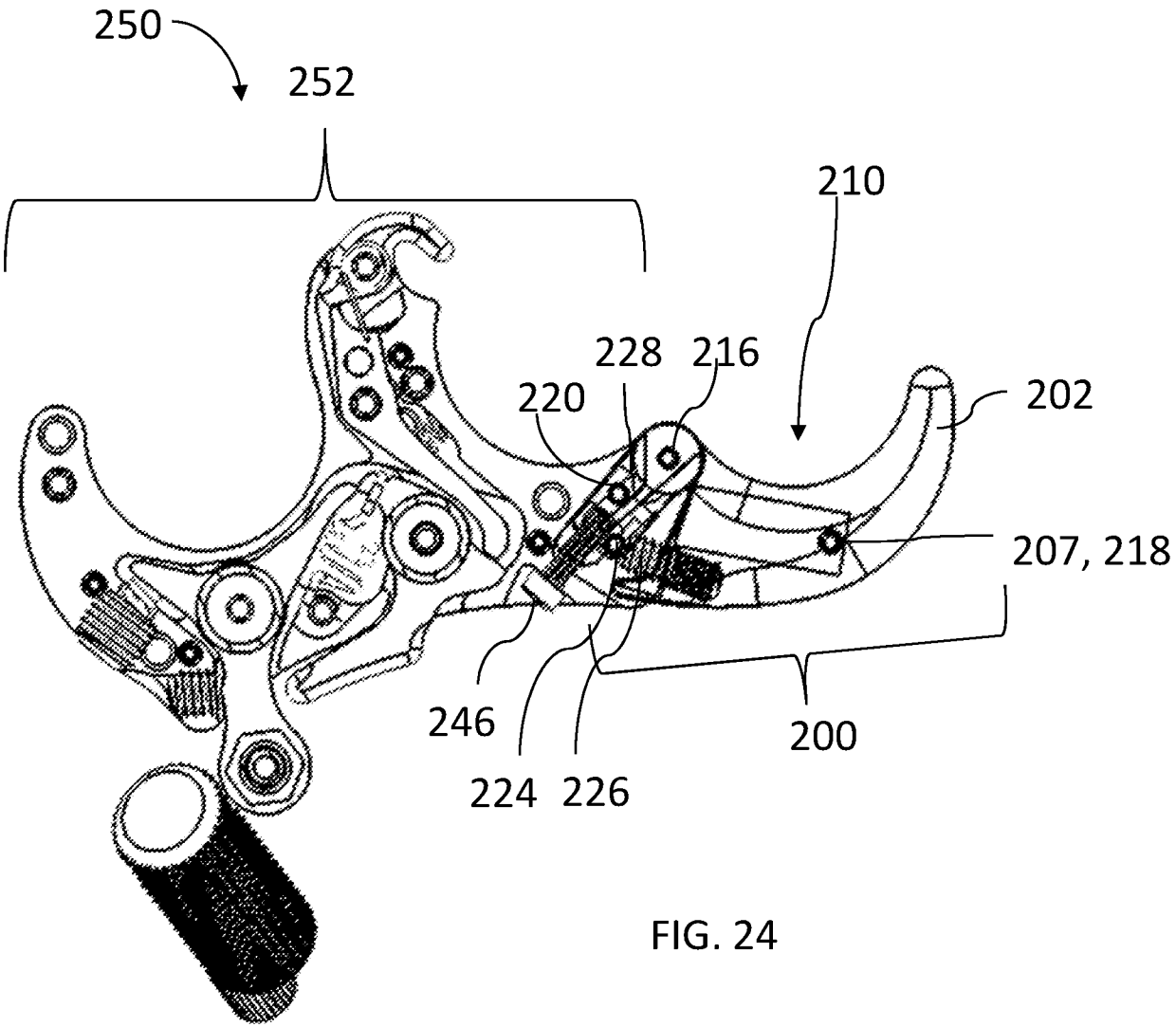
FIG. 24 is a cross-sectional view of another embodiment of an archery release device, having a position adjuster.

As particularly illustrated by FIG. 24, the interface body 228 and extension body 202 are positioned within the body interface 256. In order to secure the interface body 228, a fastener 242, such as a screw, is inserted, via the third cutout area 266, through the aperture 268 and into the securement aperture 242 of the interface body 228. When the extension 200 is secured within the body interface 256, the position or angle of the extension body 202 can be adjusted relative to the interface body 228 and the release body 252 as described above using the position adjuster 226. It is to be understood that while the interface body 228 has been described here as a separate body coupled to the release body 252, the structural features of the interface body 228 could alternatively be directly incorporated in the housing 254 of the release body 252.

Figure 39:
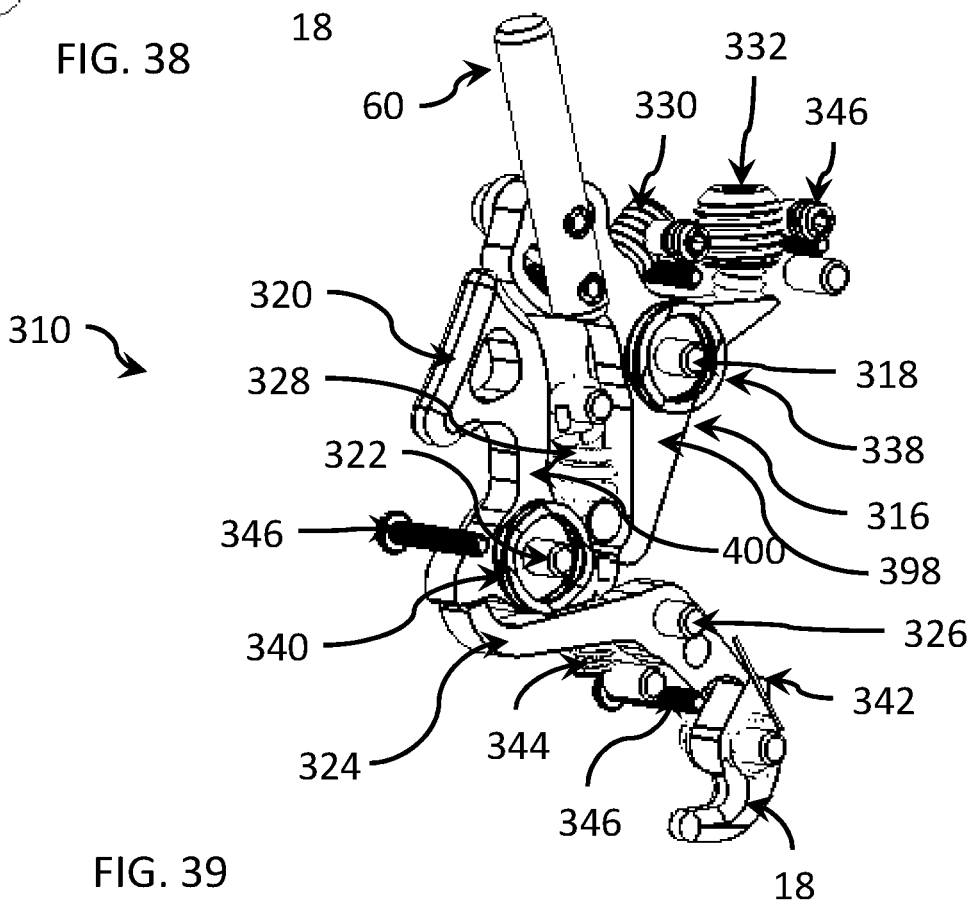
FIG. 39 is an isometric view of the internal components of the archery release device of FIG. 34, illustrating the bottom surfaces of the trigger, driver and other elements.

Referring to FIGS. 34-53, in another embodiment, the archery release device 310 includes the same structure, components, elements and functionality as the archery release device 2 in addition to: (a) an upper housing portion 312; (b) a lower housing portion 314; (c) a trigger 316 pivotally coupled to the lower housing portion 314 through a post, boss or pivot member 318; (d) a hammer or driver 320 pivotally coupled to the lower housing portion 314 through a post, boss or pivot member 322; (e) a stay unit or retainer 324 pivotally coupled to the lower housing portion 314 through a post, boss or pivot member 326; (f) a release force generator 328 coupled to the lower housing portion 314 and the driver 320 as described below; (g) a trigger motion limiter 330 threadably engaged with the lower housing portion 314 and configured to engage the trigger 316; (h) a trigger pressurizer 332 threadably engaged with the lower housing portion 314 and configured to apply an adjustable force or pressure to the trigger 316; (i) a plurality of stabilizing interfaces 334 and 336 engaged with the trigger 316 and the driver 320, respectively; (j) a plurality of base biasing members 338 and 340 (FIG. 39) positioned underneath the trigger 316 and the driver 320, respectively; (k) a torsion spring 342 (FIG. 40) that couples the draw cord holder 18 to the retainer 324 and applies a rotational biasing force to the draw cord holder 18; (l) a supplemental biasing member 344 (e.g., a compression spring or coil spring) supported by the lower housing portion 314 and configured to apply a supplemental biasing force to the driver 320 or the retainer 324; and (m) a plurality of screws, bolts or other fasteners 346 configured to secure the upper housing portion 312 to the lower housing portion 314.

Figure 37:
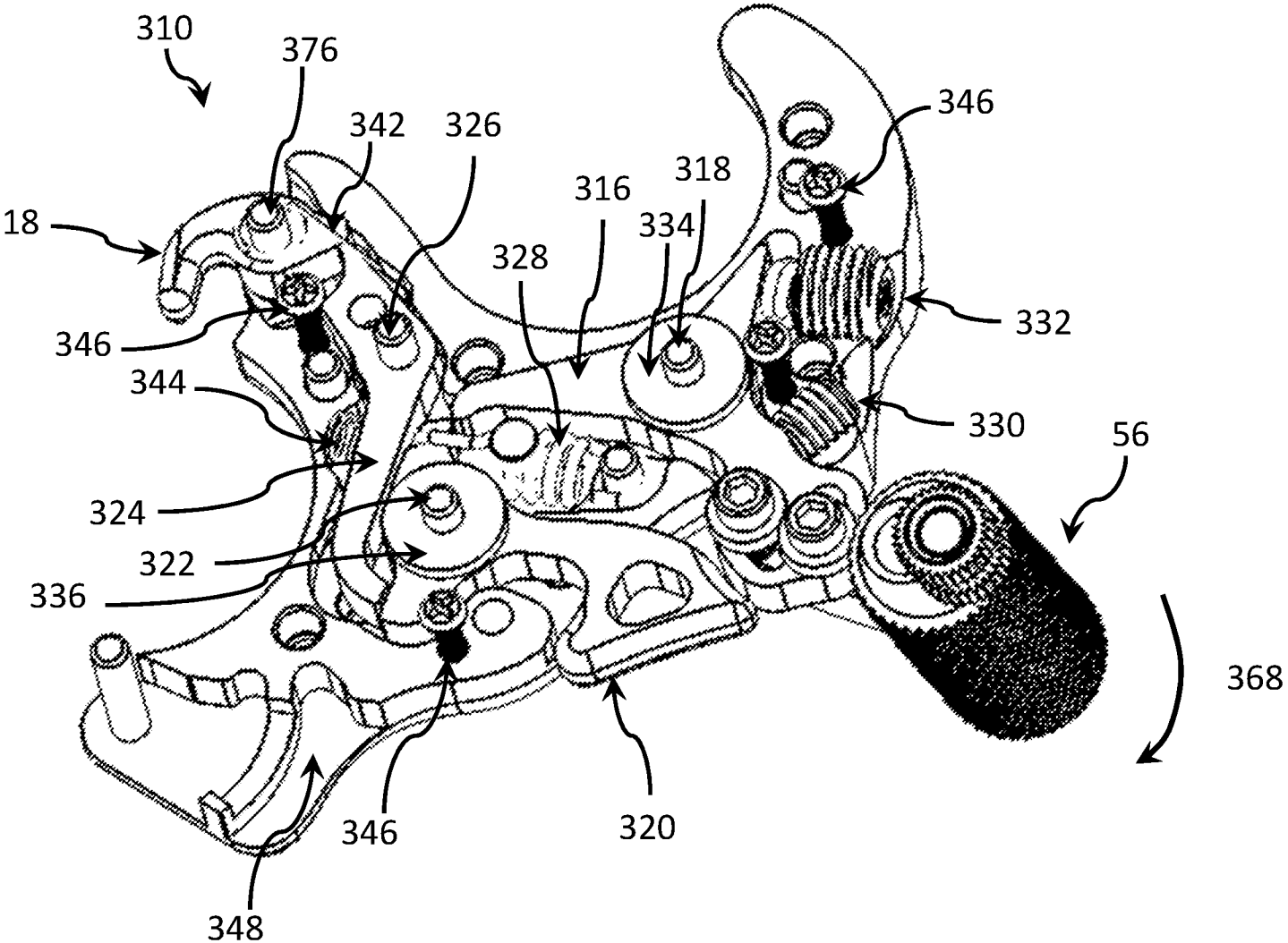
FIG. 37 is a top isometric view of the internal components of the archery release device of FIG. 34.
Figure 38:
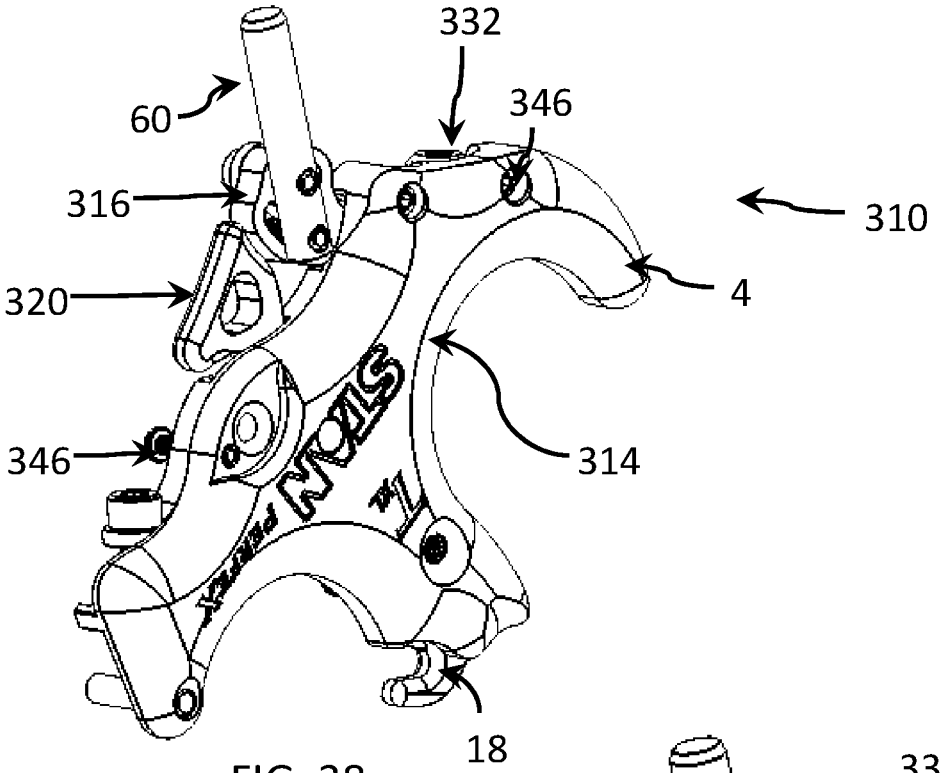
FIG. 38 is another isometric view of the lower housing portion of the archery release device of FIG. 34.

The upper and lower housing portions 312, 314 cooperate to define an interior housing space 348, as illustrated in FIG. 37. In the example shown, the archery release device 310 is in the cocked position or cocked condition. In the cocked condition, the cord holder 18 would secure or hold the draw cord 350 (FIG. 42) retracted by the user. In the embodiment illustrated in FIGS. 42-44, the release force generator 328 includes an extension spring having a plurality of force generator ends 352, 354. Also, as illustrated in FIG. 44, the driver 320 has a right driver arm 356 that defines a space, recess or notch 358, and the archery release device 310 has a boss or post 360 extending from the lower housing portion 314. The force generator end 352 has a hook or U-shape that fits within the notch 358 and partially wraps around the force generator end 352. The force generator end 354 also has a hook or U-shape, and it partially encircles the post 360. In operation, the release force generator 328 applies a spring force to the driver arm 356, urging the driver 320 to rotate clockwise about the pivot member 322.

Figure 43:
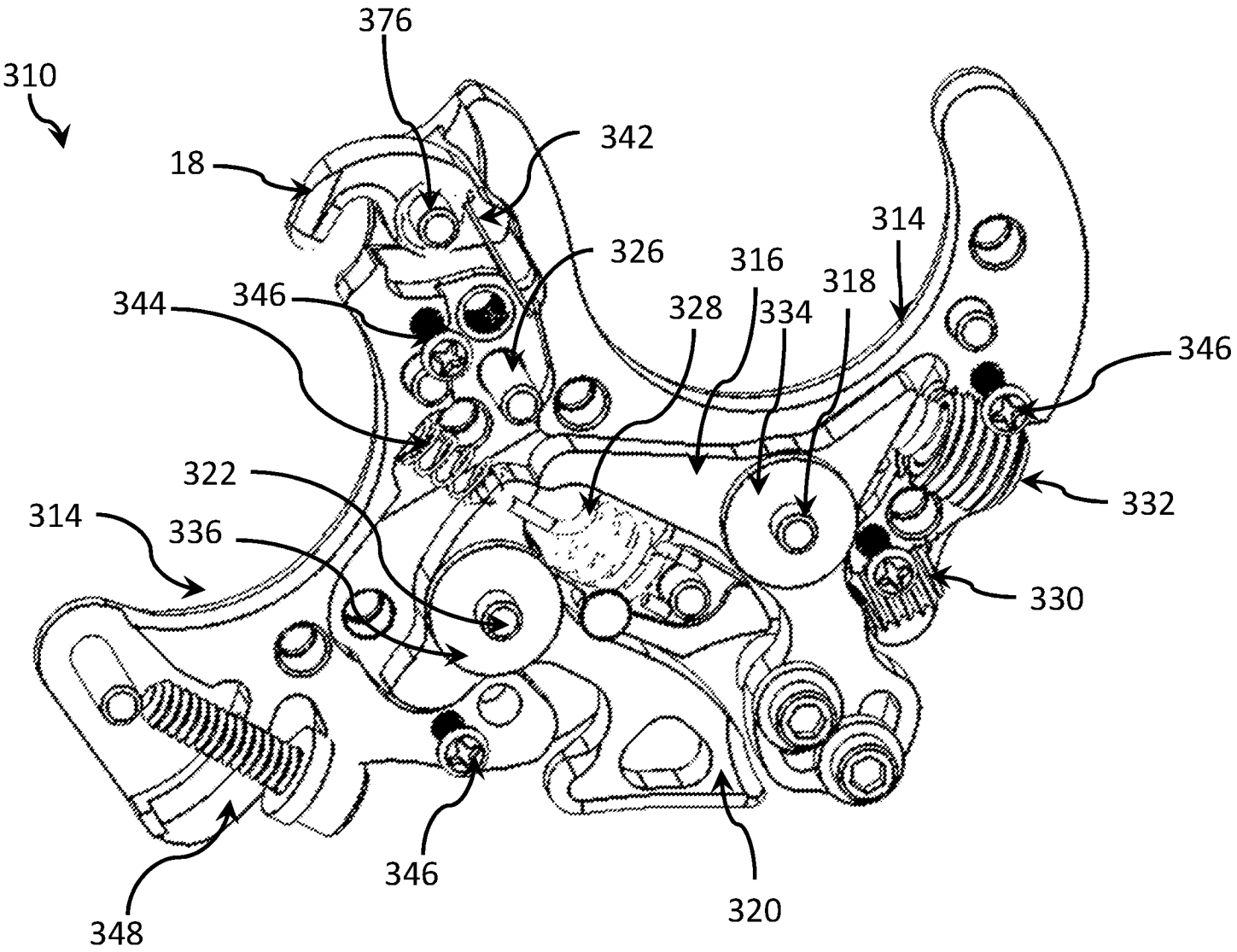
FIG. 43 is another top isometric view of the internal components of the archery release device of FIG. 34, illustrating the top surfaces of the trigger, driver and other elements.
Figure 44:
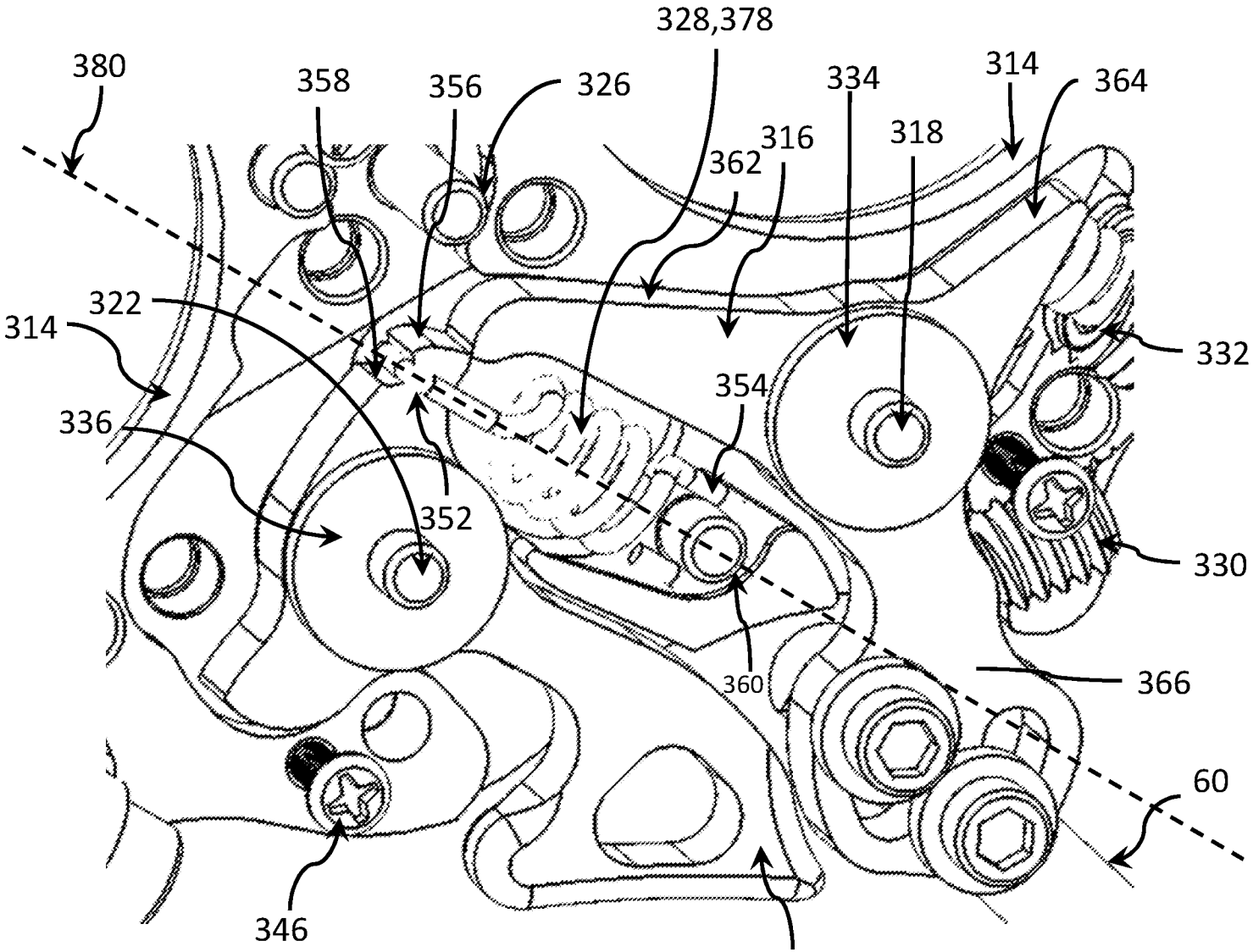
FIG. 44 is an enlarged, fragmentary, top isometric view of the internal components of the archery release device of FIG. 34, illustrating the release force generator, the trigger, the driver and other elements.

In addition, the supplemental biasing member 344 can apply an additional biasing force to the driver arm 356, as shown in FIG. 43. In another embodiment, the archery release device 310 excludes the supplemental biasing member 344 because the release force generator 328, alone, produces sufficient spring force on the driver arm 356. In yet another embodiment, the supplemental biasing member 344 is configured and positioned to apply a spring force to the retainer 324, not the driver 320. It should be appreciated that the archery release device 310 can be fully operational with or without the supplemental biasing member 344.

Figure 42:
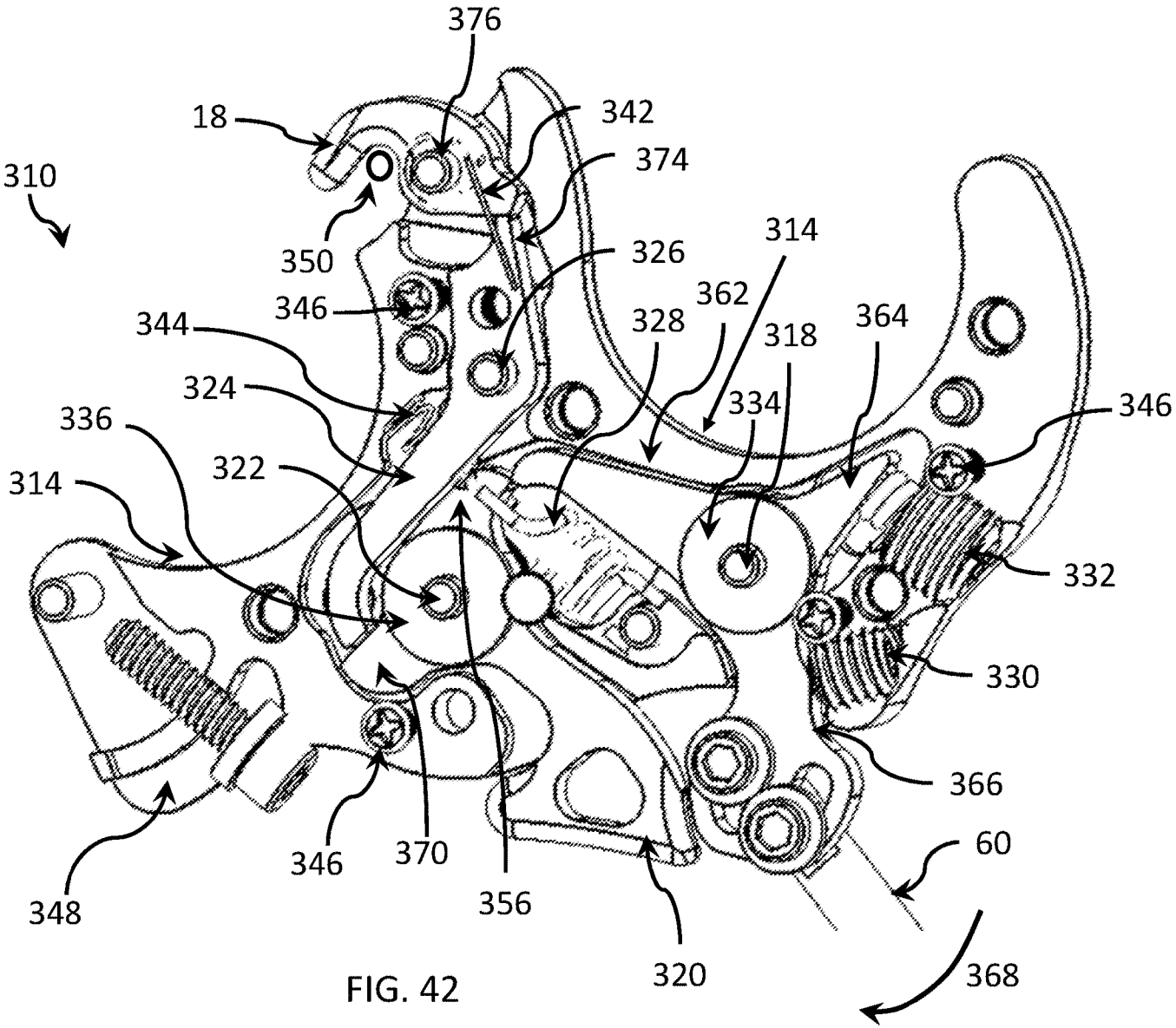
FIG. 42 is a top isometric view of the internal components of the archery release device of FIG. 34, illustrating the top surfaces of the trigger, driver and other elements.

In the cocked condition, the trigger 316 blocks the rotation of the driver 320. The blocked driver 320 immobilizes the retainer 324, which, in turn, immobilizes the cord holder 18. The trigger 316 has a Y-shape including a left arm 362, a right arm 364 and a body 366. The body 366 is coupled to the arm member 60 which, in turn, is coupled to the thumb grasp body 56. In the cocked condition, the left arm 362 interferes with or otherwise overlaps the driver arm 356. When ready to shoot, the user can pull the thumb grasp body 56, causing the arm member 60 to pivot clockwise 368 (FIG. 42). In response, the left arm 362 rotates clockwise 368 and disengages the driver arm 356. Because of the spring forces of the release force generator 328 (and, depending upon the embodiment, the supplemental biasing member 344) the driver 320 then rotates clockwise 368, causing the left driver arm 370 to apply an upward force to the retainer end 372 of the retainer 324. This causes the retainer 324 to pivot or rotate clockwise 368 about the pivot member 326. As a result, the retainer end 374 disengages the cord holder 18, enabling the cord holder 18 to rotate about the pivot member 376. As the cord holder 18 rotates, the draw cord 314 slides off of the cord holder 18 to launch an arrow or projectile toward a target.

As illustrated in FIG. 44, the release force generator 328 has an intermediate portion 378. The intermediate portion 378 includes a plurality of loops of wire arranged in a helical or spiral shape. The intermediate portion 378 is positioned between the ends 352, 354. The intermediate portion 378 is configured to resist being pulled along the force axis 380. When release force generator 328 is coupled to the right driver arm 356 and the post 360, the release force generator 328 produces a spring force acting along the force axis 380. The spring force acts from the right driver arm 356 toward the post 360. In an embodiment, the loops of the intermediate portion 378 are spaced apart from each other and remain spaced apart from each other throughout the transition of the archery release device 310 from the cocked condition to a released or uncocked condition.

Figures 45, 46:
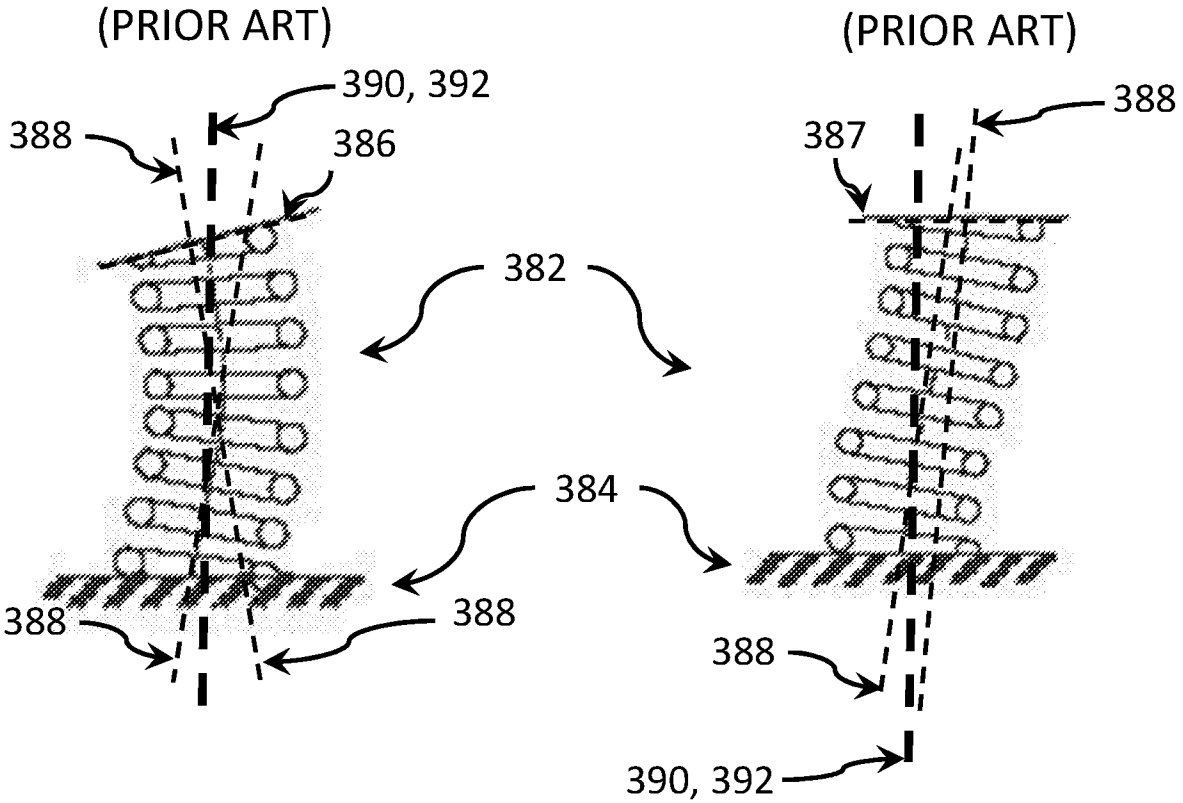
FIG. 45 is a side diagram of a prior art compression spring, illustrating buckling and bending problems occurring during the operation of a prior art archery release aid.
FIG. 46 is a side diagram of the prior art compression spring of FIG. 45, illustrating a different shape of the buckling and bending of the prior art archery release aid.

As illustrated in FIGS. 45-46, prior art release aids rely substantially on or entirely on one or more compression springs (e.g., prior art compression spring 382) to generate a release force. For example, the prior art compression spring 382 is supported by a prior art housing 384, and the prior art compression spring 382 extends to engage a prior art hammer, such as a prior art hammer 386 or 387 of a prior art release aid. As shown in FIG. 45, the prior art compression spring 382 tends to bend and buckle during usage. This can be caused by various factors, including, but not limited to, the geometries of the hammers 386, 387 and the positions of the hammers 386, 387. For example, the hammer 386 extends in a plane that intersects with the plane in which the housing 384 extends. The intersection of these planes is associated with a cause of the bending and buckling. The bending and buckling of the prior art compression spring 382 results in a plurality of extraneous spring forces 388 other than the desired axial force 390 along axis 392. Consequently, a substantial amount of the spring force of the prior art compression spring 382 fails to reach the intended hammer 386 or 387. This results in a substantial inefficiency in force transmission within the prior art release aids which, in turn, impairs the release and triggering performance and responsiveness.

In contrast to the prior art compression spring 382, the release force generator 328 produces a spring force that acts entirely or substantially entirely along the force axis 380 (FIG. 44). This is because the release force generator 328 is operable through tension rather than compression. By avoiding compression, the release force generator 328 is not vulnerable to buckling or bending like the prior art compression spring 382. Consequently, the release force generator 328 provides substantial improvement in the efficiency of force transmission, and in release and triggering performance, reliability and responsiveness.

Figure 47:
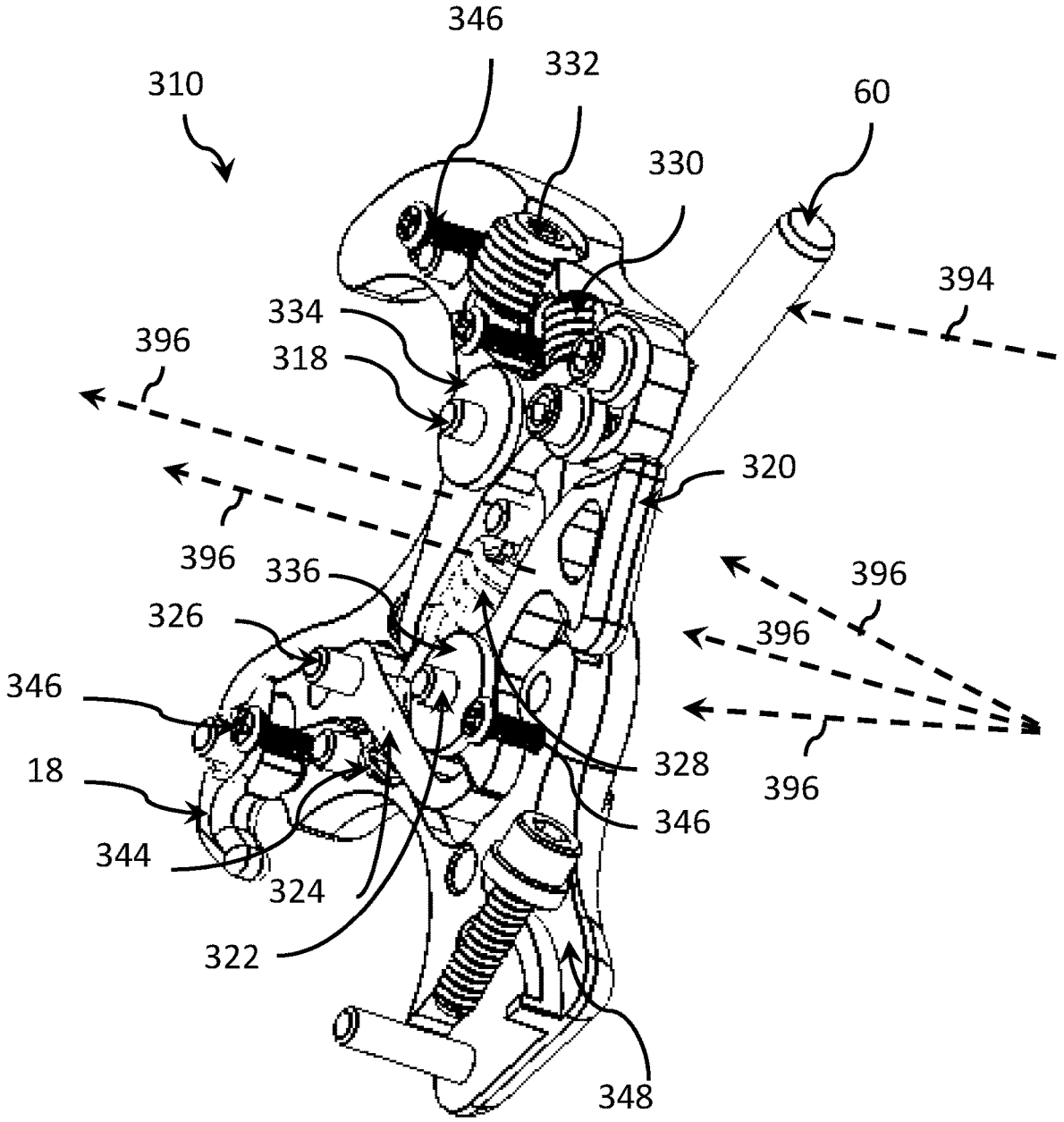
FIG. 47 is an isometric view of the internal components of the archery release device of FIG. 34, illustrating the exertion of destabilization forces on the trigger, driver and other elements.

Referring to FIG. 47, various destabilization forces can act upon the trigger 316 and the driver 320, including, but not limited to, the user force 394 and other destabilization forces 396 generated by components within the archery release device 310. These destabilization forces can urge or cause the trigger 316 and the driver 320 to become unseated, loose or out of position. The full or partial unseating of the trigger 316 or the driver 320 can substantially impair the release and triggering performance of the archery release device 310.

Figure 41:
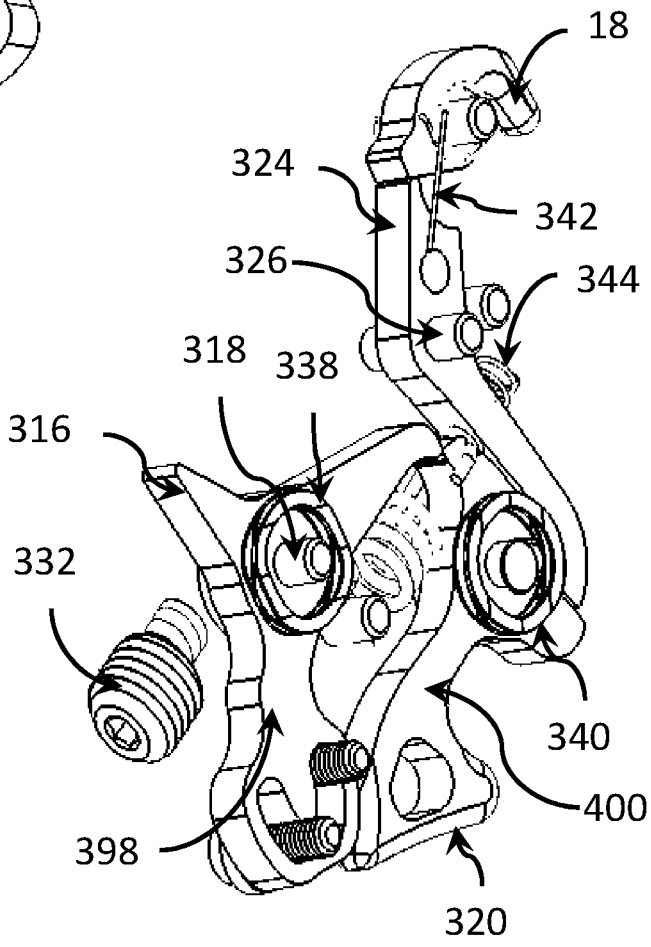
FIG. 41 is another isometric view of the internal components of the archery release device of FIG. 34, illustrating the bottom surfaces of the trigger, driver and other elements.

The trigger 316 and the driver 320 are at least partially encased within or entrapped by the upper and lower housing portions 312, 314. As illustrated in FIG. 41, the base biasing members 338 and 340 apply upward spring forces to the trigger bottom surface 398 and the driver bottom surface 400, respectively. Depending upon the embodiment, the base biasing members 338, 340 can include wavy washers, compression springs, elastic rings or other suitable elastic, biasing or shock-absorbing members. The base biasing members 338, 340 are therefore operable to bias the trigger 316 and the driver 320 toward the upper housing portion 312.

Figure 48:
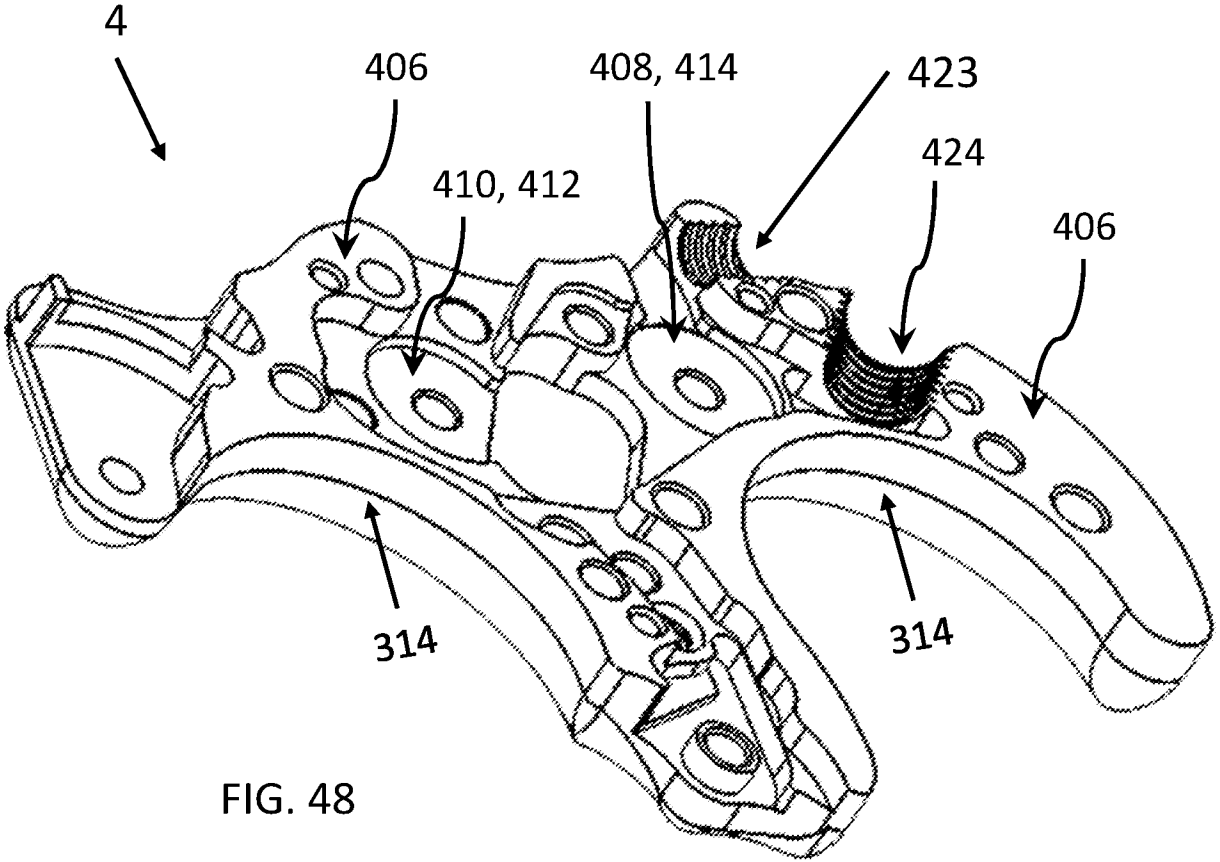
FIG. 48 is an isometric view of the archery release device of FIG. 34, illustrating the interior housing surface of the upper housing portion.
Figure 49:
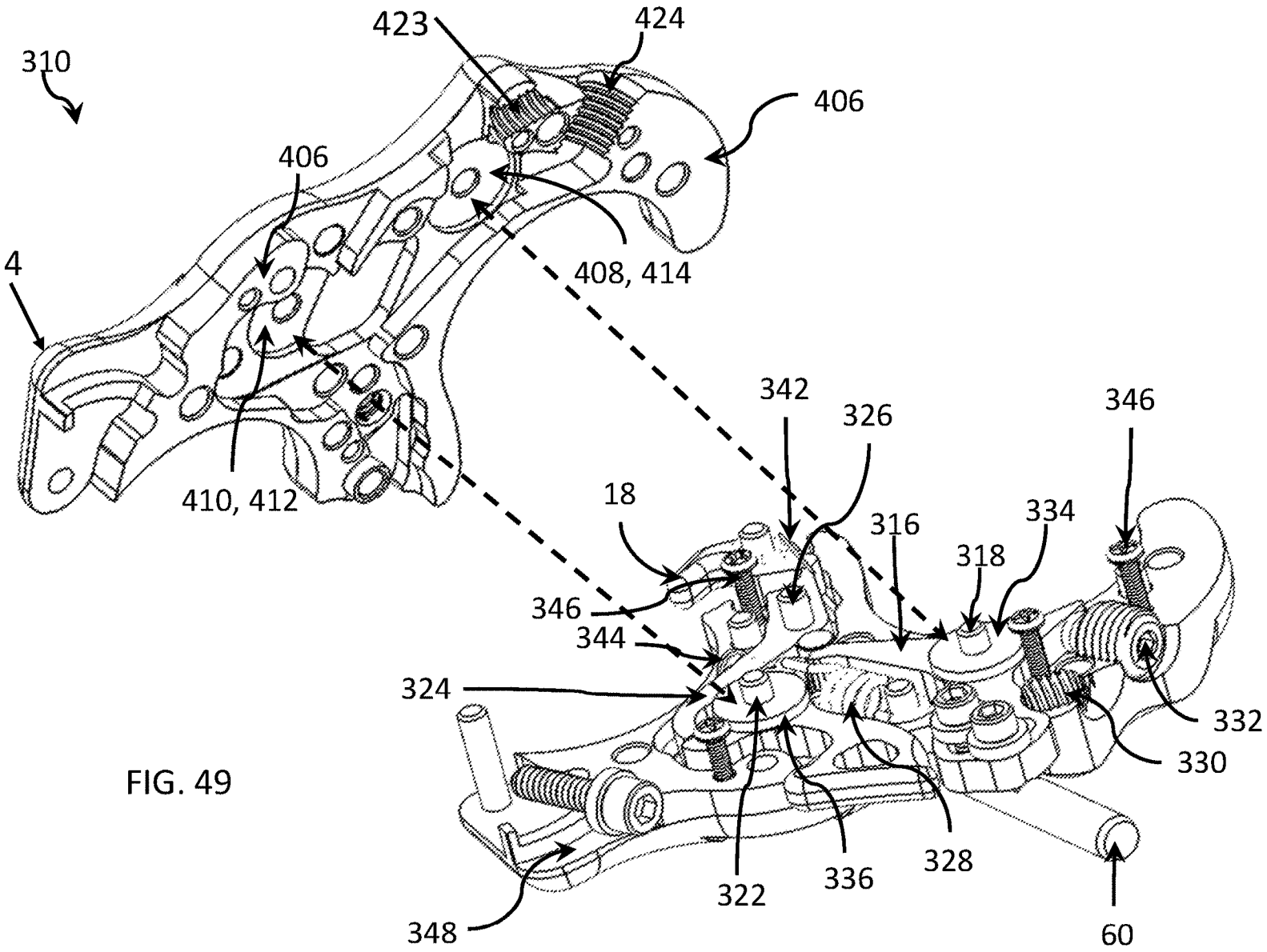
FIG. 49 is an isometric view of the archery release device of FIG. 34, illustrating the union of the upper and lower housing portions to receive, capture and retain the stabilizing interfaces.
Figure 50:
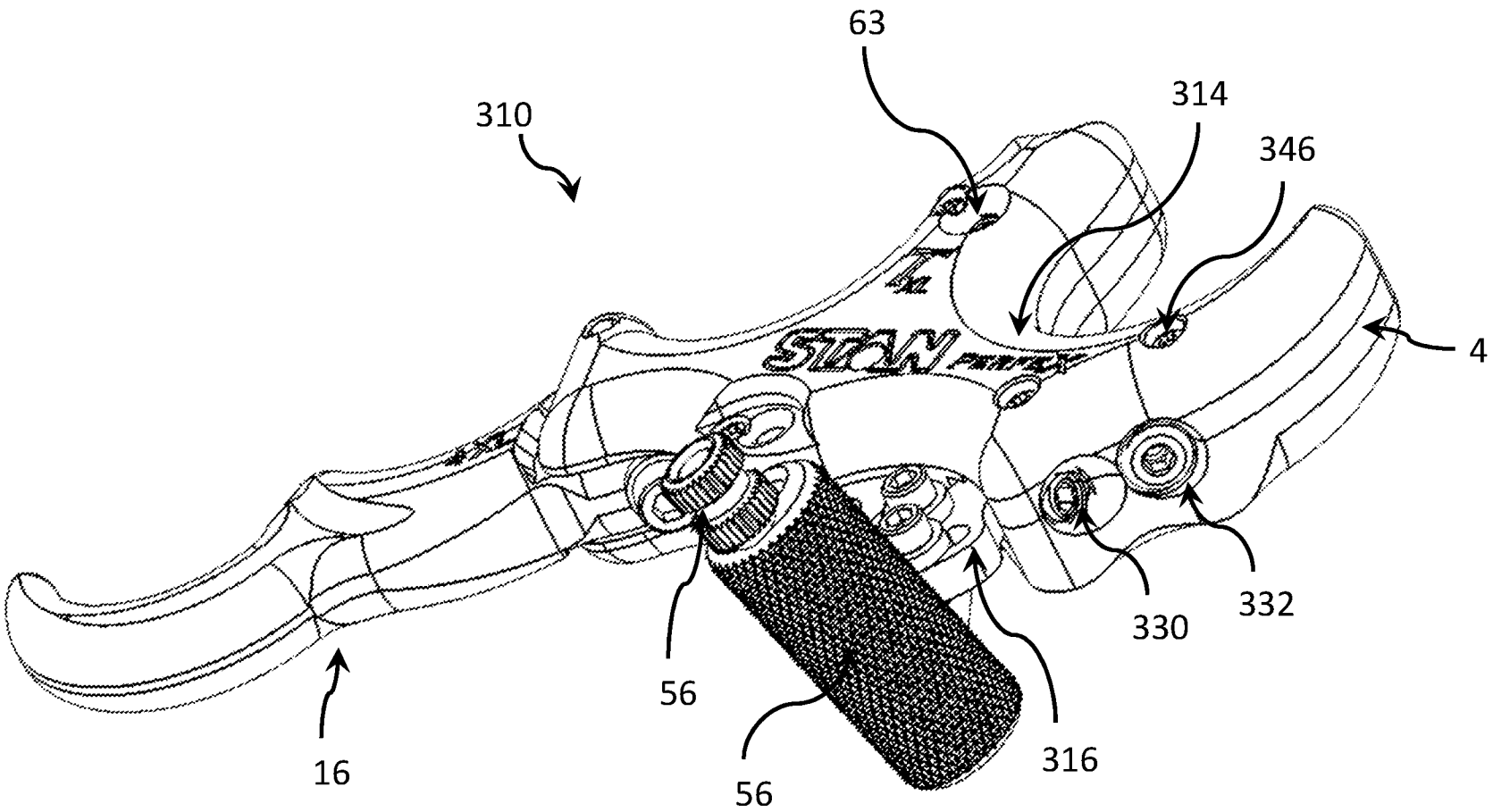
FIG. 50 is an isometric view of the archery release device of FIG. 34, illustrating the trigger motion limiter and the trigger pressurizer.

In the embodiment illustrated in FIGS. 47-49: (a) the stabilizing interface 334 includes a ring defining a circular opening configured to receive the pivot member 318; and (b) the stabilizing interface 336 includes a ring defining a circular opening configured to receive the pivot member 322. Depending upon the embodiment, each of the stabilizing interfaces 334, 336 can include a washer, disk, block or other member configured to receive the pivot member 318 or 322, as applicable. Each of the stabilizing interfaces 334, 336 can be constructed of any suitable material, including, but not limited to, materials associated with relatively low surface friction, such as silicon or other suitable polymers or metals. In an embodiment, the stabilizing interfaces 334, 336 have friction reduction characteristics.

Figure 40:
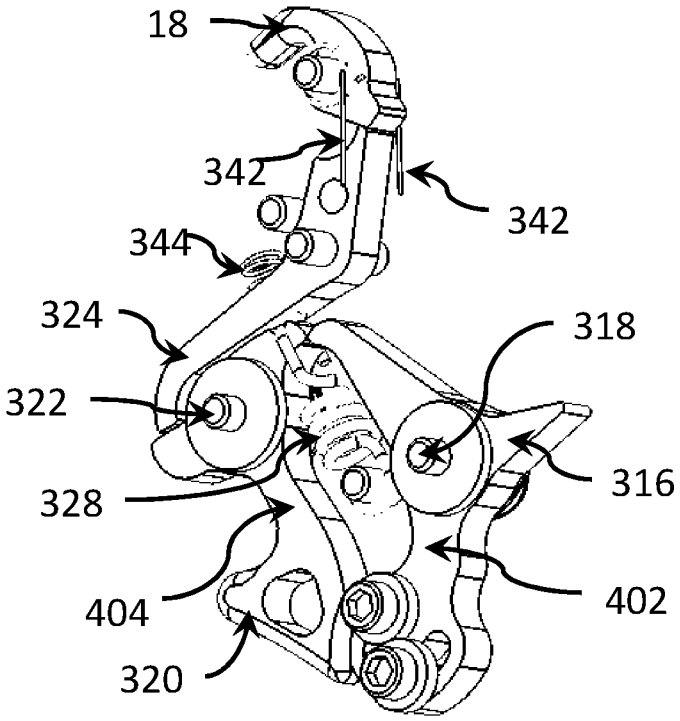
FIG. 40 is an isometric view of the internal components of the archery release device of FIG. 34, illustrating the top surfaces of the trigger, driver and other elements.

As shown in FIGS. 40 and 41, the trigger 316 has relatively large trigger bottom and top surfaces 398, 402, and the driver 320 has relatively large driver bottom and top surfaces 398, 402. As described above, the transition from cocked condition to uncocked condition requires the rotation of the trigger 316 and the driver 320. Once the user pulls the thumb grasp body 56, the frictional forces acting on the surfaces 398, 400, 402, 404 can impede the free movement of the trigger 316 and the driver 320 which, in turn, can impair the triggering responsiveness of the archery release device 310. To reduce such friction, the base biasing members 338, 340 and the stabilizing interfaces 334, 336 isolate the trigger 316 and the driver 320 from the surfaces of the upper and lower housing portions 312, 314. In an embodiment, the base biasing member 338 engages less than 50% of the trigger bottom surface 398, the base biasing member 340 engages less than 50% of the driver bottom surface 400, the stabilizing interface 334 engages less than 50% of the trigger top surface 402, and the stabilizing interface 336 engages less than 50% of the driver top surface 404. This reduced physical engagement facilitates the smooth and free rotation of the trigger 316 and the driver 320 within the upper and lower housing portions 312, 314.

In addition, the stabilizing interfaces 334, 336 function as spacers between the upper housing portion 312 and the trigger 316 and the driver 320. In an embodiment illustrated in FIGS. 48-49, the upper housing portion 312 has an interior housing surface 406 that defines: (a) a trigger stabilizer cavity 408 configured to receive part or all of the stabilizing interface 334; and (b) a driver stabilizer cavity 410 configured to receive part or all of the stabilizing interface 336. When the upper housing portion 312 is secured to the lower housing portion 314, the cavity surfaces 412 and 416 apply securing forces to the stabilizing interfaces 334 and 336, respectively, which, in turn, transfer the securing forces to the trigger top surface 402 and the driver top surface 404, respectively. The securing forces counteract the biasing forces exerted by the base biasing members 338, 340. The sum of these forces on the trigger 316 and the driver 320 help to secure the proper seating of the trigger 316 and the driver 320 within the archery release device 310. Furthermore, because the stabilizing interfaces 334, 336 and the base biasing members 338, 340 engage a relatively small percentage of the surface areas of the trigger 316 and the driver 320, these securing forces have a relatively small impact on restricting the rotational movement of the trigger 316 and the driver 320. This helps to improve the triggering responsiveness of the archery release device 310.

In another embodiment not shown, the interior housing surface 406 of the upper housing portion 312 defines the stabilizing interfaces. In such embodiment, such stabilizing interfaces are not separate components. Instead, such stabilizing interfaces are integrated into, and unitary with, the interior housing surface 406. For example, the interior housing surface 406 can define: (a) a peak, protrusion or raised portion of the same or similar geometry as the stabilizing interface 334; and (b) a peak, protrusion or raised portion of the same or similar geometry as the stabilizing interface 336. Such integrated stabilizing interfaces are configured to perform the same function as the stabilizing interfaces 334, 336 described above.

Referring to FIGS. 42 and 50-53, in an embodiment, the trigger motion limiter 330 is configured to be threadably engaged with the lower housing portion 314. The trigger motion limiter 330 extends into a channel 423 defined by the upper and lower housing portions 312, 314. In an embodiment, the trigger motion limiter 330 includes a set screw. By adjusting or screwing the trigger motion limiter 330 relative to the lower housing portion 314, the user or assembler can cause the trigger motion limiter 330 to engage the body 366 of the trigger 316. By rotating the trigger motion limiter 330 clockwise, the user or assembler can decrease the extent of the engagement, overlap or interference between the trigger left arm 362 and the driver right arm 356. By rotating the trigger motion limiter 330 counterclockwise, the user or assembler can increase the extent of the engagement, overlap or interference between the trigger left arm 362 and the driver right arm 356. As such engagement, overlap or interference is decreased, the triggering sensitivity increases. Accordingly, the user or assembler can adjust the triggering sensitivity by rotating the trigger motion limiter 330 according to the user's preference.

Figure 51:
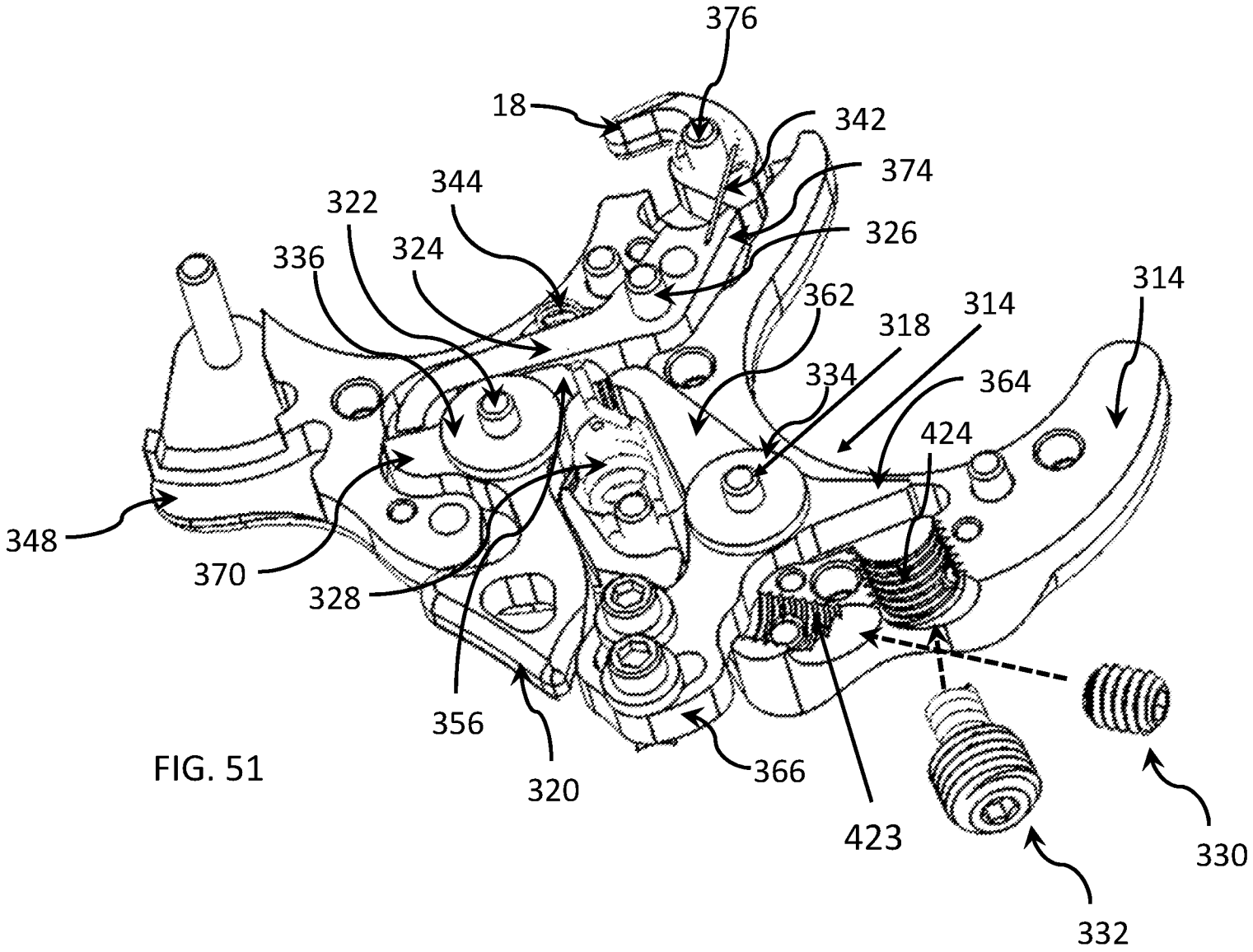
FIG. 51 is an isometric view of the archery release device of FIG. 34, illustrating the insertion of the trigger motion limiter and the trigger pressurizer into the lower housing portion.
Figure 52:
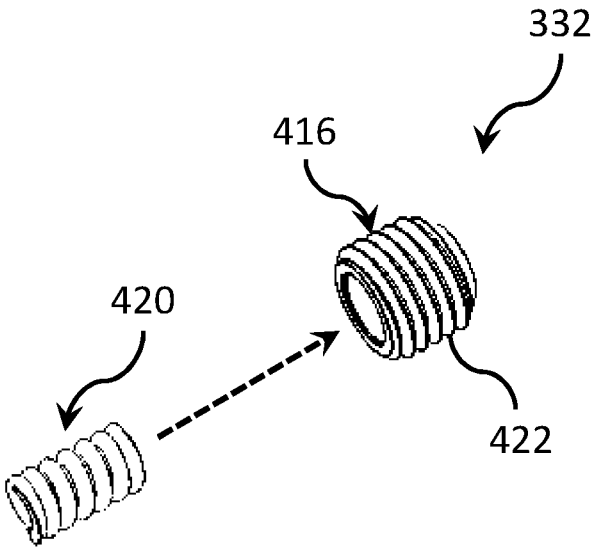
FIG. 52 is an isometric view of the trigger pressurizer of FIG. 51, illustrating the insertion of the biasing member into the pressurizer body.
Figure 53:
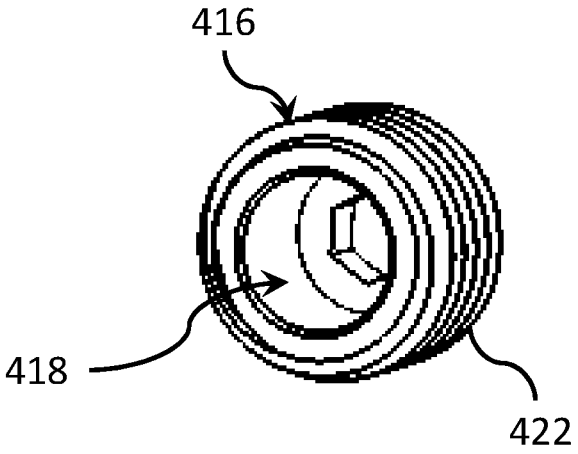
FIG. 53 is an isometric view of the pressurizer body of FIG. 52, illustrating the cavity configured to partially receive the biasing member.

As illustrated in FIGS. 51-53, the trigger pressurizer 332 includes: (a) a pressurizer body 416 that defines a cavity 418; and (b) a biasing member 420 that fits partially within the cavity 418. The exterior 422 of the pressurizer body 416 is threaded and configured to threadably engage the lower housing portion 312. The trigger pressurizer 332 extends into a threaded channel 424 defined by the upper and lower housing portions 312, 314. In an embodiment, the pressurizer body 416 includes a partially-hollowed set screw, and the biasing member 420 includes a compression spring. When the biasing member 420 is unrestrained, less than all of the biasing member 420 fits within the cavity 418, as shown in FIG. 51. As the user screws the trigger pressurizer 332 into the threaded channel 424, the biasing member 420 eventually reaches, and applies a spring force to, the right arm 364 of the trigger 316. This spring forces applies a constant biasing force to the trigger 316. The user can adjust this force, and resulting pressure, by rotating the trigger pressurizer 332 clockwise or counterclockwise. This biasing pressure can affect the triggering sensitivity and, therefore, provides the user with a another setting for fine tuning the archery release device 310.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery release device comprising:
a body defining an interior space;
a first pivotal element pivotally coupled to the body, wherein the first pivotal element comprises a first portion positioned within the interior space;
a second pivotal element pivotally coupled to the body, wherein the second pivotal element comprises a second portion positioned within the interior space;
a support member coupled to the body;
a cord holder pivotally coupled to the body;
a release controller operatively coupled to at least one of the first and second pivotal elements, wherein the release controller is moveable relative to the body by a user; and
a force generator positioned within the interior space,
wherein the force generator comprises:
a first end coupled to the support member; and
a second end coupled to a part of one of the first and second portions,
wherein the force generator is configured to apply a pulling force acting between the support member and the part,
wherein the pulling force pulls the part toward the support member,
wherein, in a cocked condition of the archery release device, the first and second pivotal elements are engaged with each other to impede the cord holder from moving relative to the body,
wherein, in response to a movement of the release controller relative to the body:
the first and second pivotal elements become at least partially disengaged from each other;
the pulling force causes the part to move relative to the body;
the movement of the part enables the cord holder to move relative to the body; and
the movement of the cord holder enables the cord holder to release a draw cord.

2. The archery release device of claim 1, wherein:
the force generator comprises an intermediate portion between the first and second ends;
the intermediate portion is configured to generate the pulling force;
the pulling force acts along a force axis;
the force axis extends between the support member and the part; and
the intermediate portion extends parallel to the force axis constantly throughout the cocked condition and throughout a transition to an uncocked condition of the archery release device.

3. The archery release device of claim 2, wherein:
the support member comprises a first characteristic;
the first characteristic comprises a first shape of the support member and a first position of the support member relative to the body;
the part comprises a second characteristic, wherein the second characteristic comprises a second shape of the part and a second position of the part relative to the body; and
the intermediate portion is configured to continue to extend parallel to the force axis throughout the transition independent of the first and second characteristics.

4. The archery release device of claim 2, wherein the intermediate portion remains in a configuration that extends parallel to the force axis throughout the transition.

5. The archery release device of claim 1, wherein the body comprises a plurality of housing portions.

6. The archery release device of claim 1, wherein:
the first pivotal element comprises a trigger;
the second pivotal element comprises a driver; and
the support member comprises a post.

7. The archery release device of claim 1, wherein the release controller comprises a grasp member.

8. The archery release device of claim 1, wherein the release controller comprises a thumb grasp assembly.

9. The archery release device of claim 1, wherein:
the force generator comprises an extension spring;
the extension spring comprises a plurality of loops of wire;
the extension spring is configured so that the loops are predisposed to be urged toward each other; and
each of the first and second ends comprises a hook shape.

10. The archery release device of claim 1, comprising a finger extension coupled to the body, wherein the finger extension comprises a finger engagement surface.

11. An archery release device comprising:
a body comprising:
a first finger engagement surface that is at least partially concave, and
a second finger engagement surface that is at least partially concave;
at least one element moveably coupled to the body; and
a force generator coupled to the body,
wherein the force generator is configured to apply a pulling force that pulls the at least one element, wherein, as a result of the archery release device being uncocked, the force generator is configured to cause the at least one element to move relative to the body.

12. The archery release device of claim 11, wherein:

the at least one element comprises a first element pivotally coupled to the body;

the archery release device comprises:

a second element pivotally coupled to the body; and a cord holder pivotally coupled to the body, in a cocked condition of the archery release device, the first element and the second element are engaged with each other to impede the cord holder from pivoting relative to the body.

13. A method for manufacturing an archery release device, the method comprising:

configuring a body;

moveably coupling a cord holder to the body;

moveably coupling at least one element to the body; and coupling a force generator to the body, wherein the force generator is configured to apply a pulling force that pulls the at least one element, wherein, as a result of the archery release device being uncocked, the force generator is configured to cause the at least one element to move relative to the body, wherein the cord holder is configured to release a draw cord caused, at least in part, by the pulling force.

14. The method of claim 13, wherein:

the force generator comprises a plurality of ends and an intermediate portion between the ends;

the intermediate portion is configured to generate the pulling force; and the method comprises coupling the force generator to the body so that:

the pulling force acts along a force axis; and the intermediate portion extends parallel to the force axis constantly while the archery release device is cocked.

15. The method of claim 14, wherein:

the method comprises coupling a support member to the body;

engaging one of the ends with the support member;

engaging another one of the ends with a part of the at least one element;

the support member comprises a first characteristic;

the first characteristic comprises a first shape of the support member and a first position of the support member relative to the body;

the part comprises a second characteristic, wherein the second characteristic comprises a second shape of the part and a second position of the part relative to the body; and the intermediate portion is configured to continue to extend parallel to the force axis while the archery release device comprises cocked and uncocked conditions independent of the first and second characteristics.

16. The method of claim 13, comprising:

configuring the body to define an interior space;

positioning the at least one element at least partially within the interior space;

positioning the force generator at least partially within the interior space;

moveably coupling a cord holder to the body so that the cord holder is coupled to the at least one element through one of a first direct connection and a first indirect connection; and coupling a release controller to the at least one element through one of a second direct connection and a second indirect connection so that the release controller is moveable relative to the body by a user.

17. The method of claim 13, comprising:

coupling a support member to the body, wherein the force generator comprises:

a first end coupled to the support member; and a second end coupled to a part of the at least one element, wherein the force generator is configured to apply the pulling force acting between the support member and the part, wherein the pulling force pulls the part toward the support member, wherein, in a cocked condition of the archery release device, the at least one element impedes the cord holder from moving relative to the body, wherein, as a result of a change from the cocked condition to an uncocked condition of the archery release device, the pulling force causes the part to move relative to the body, wherein, in the uncocked condition:

the cord holder is configured to move relative to the body in response to the movement of the part; and the movement of the cord holder enables the cord holder to release a draw cord.

18. The method of claim 13, wherein the configuring of the body comprises:

configuring a first finger engagement surface that is at least partially concave, and configuring a second finger engagement surface that is at least partially concave.

19. An archery release device comprising:

a body;

a cord holder moveably coupled to the body;

at least one element moveably coupled to the body; and a force generator coupled to the body, wherein the force generator is configured to apply a pulling force that pulls the at least one element, wherein, as a result of the archery release device being uncocked, the force generator is configured to cause the at least one element to move relative to the body, wherein the cord holder is configured to release a draw cord caused, at least in part, by the pulling force.

20. The archery release device of claim 19, wherein:

the force generator comprises a plurality of ends and an intermediate portion between the ends;

the intermediate portion is configured to generate the pulling force;

the pulling force acts along a force axis; and the intermediate portion extends parallel to the force axis constantly while the archery release device is cocked.

21. The archery release device of claim 20, wherein:

the archery release device comprises a support member coupled to the body;

one of the ends is engaged with the support member;

another one of the ends is engaged with a part of the at least one element;

the support member comprises a first characteristic;

the first characteristic comprises a first shape of the support member and a first position of the support member relative to the body;

the part comprises a second characteristic, wherein the second characteristic comprises a second shape of the part and a second position of the part relative to the body; and the intermediate portion is configured to continue to extend parallel to the force axis while the archery release device comprises cocked and uncocked conditions independent of the first and second characteristics.

22. The archery release device of claim 19, wherein:

the body defines an interior space;

the at least one element is at least partially positioned within the interior space;

the force generator is at least partially positioned within the interior space;

the archery release device comprises a cord holder moveably coupled to the body, wherein the cord holder is coupled to the at least one element through one of a first direct connection and a first indirect connection; and the archery release device comprises a release controller coupled to the at least one element through one of a second direct connection and a second indirect connection, wherein the release controller is moveable relative to the body by a user.

23. The archery release device of claim 19, wherein:

the archery release device comprises a support member coupled to the body;

the archery release device comprises a cord holder moveably coupled to the body; and the force generator comprises:

a first end coupled to the support member; and a second end coupled to a part of the at least one element, wherein the force generator is configured to apply the pulling force acting between the support member and the part, wherein the pulling force pulls the part toward the support member, wherein, in a cocked condition of the archery release device, the at least one element impedes the cord holder from moving relative to the body, wherein, as a result of a change from the cocked condition to an uncocked condition of the archery release device, the pulling force causes the part to move relative to the body, wherein, in the uncocked condition:

the cord holder is configured to move relative to the body in response to the movement of the part; and the movement of the cord holder enables the cord holder to release a draw cord.

24. The archery release device of claim 19, further configured to be removeably coupled to an archery bow.

* * * * *